US005398632A

United States Patent [19]

Goldbach et al.

[11] Patent Number: 5,398,632

[45] Date of Patent: Mar. 21, 1995

[54] APPARATUS AND METHOD FOR PERFORMING EXTERNAL SURFACE WORK ON SHIP HULLS

[75] Inventors: Richard A. Goldbach; William A. Wagner; Frank E. McConnell; Richard C. Goldbach, all of Norfolk; Joseph W. Kuchta, Hampton, all of Va.

[73] Assignee: MMC Compliance Engineering, Inc., Norfolk, Va.

[21] Appl. No.: 27,802

[22] Filed: Mar. 8, 1993

[51] Int. Cl.[6] ..... B63B 59/00

[52] U.S. Cl. ..... 114/222; 15/1.7

[58] Field of Search ..... 114/222; 15/53.1, 53.2, 15/53.3, 1.7

[56] References Cited

U.S. PATENT DOCUMENTS

| | | | |
|---|---|---|---|
| 4,506,686 | 3/1985 | Bailard et al. | 114/222 |
| 4,784,078 | 1/1988 | Feurt | 114/222 |
| 5,138,963 | 8/1992 | Eichert | 114/222 |
| 5,211,125 | 5/1993 | Garland et al. | 114/222 |

OTHER PUBLICATIONS

"The Original Blastrac" Portable Shot Blast Cleaning Systems, 1–8S Portable Blast Cleaning Systems, specification brochure published by The Wheelabrator Corporation, 108 Pine Road, Newnan, Georgia, 30263, 1988.

*Primary Examiner*—Stephen P. Avila

*Attorney, Agent, or Firm*—Cushman Darby & Cushman

[57] ABSTRACT

Shrouded towers for supporting adjustably cantilevered work platforms for performing external surface work on ship hulls (such as abrading and painting) are modularized for sake of economy and efficient utilization, including shifting of modules using techniques and equipment currently used for shifting shipping containers. Supply and recovery line connections between support barge-mounted equipment, floating drydock and work platform-mounted work applicators is facilitated by fixed installation of some portions and the provision of flexible connectors between these portions. Alternative adjustable cantilevering structures are disclosed for mounting the work platforms to the vertically movable trolleys. Preferably, rotating wheels rather than compressed air, are used to propel the abrasive grit against the hull surface, and abrasive supply systems having degrees of automated recovery of spent grit are disclosed.

22 Claims, 41 Drawing Sheets

APPARATUS AND METHOD FOR PERFORMING EXTERNAL SURFACE WORK ON SHIP HULLS

BACKGROUND OF THE INVENTION

In general, the invention relates to providing an atmospherically controlled sealed enclosure which permits economical staging access to and coating of exposed areas of ships' hulls of varying configurations both afloat and in drydock during the abrasive blasting, spray painting and solvent evaporation phases of the coating process so as to be, so far as practically possible, in full compliance with requirements of the U.S. Clean Air Act and Clean Water Act.

The present invention relates to apparatus and a method for surface work such as cleaning and painting, on exposed external surfaces of ship hulls, which improve upon the apparatus and methods which are disclosed in Garland et al., U.S. patent application 07/782,315, filed Oct. 24, 1991 (now U.S. Pat. No. 5,211,125, issued May 18. 1993) and in the copending U.S. patent application of Goldbach et al., application 07/975,520, filed Nov. 12, 1992 . now U.S. Pat. No. 5,355,823 issued Oct. 18, 1994. These are collectively referred to herein as the baseline apparatus and methods.

For disclosural purposes, the aforementioned U.S. patent applications are incorporated herein by reference.

Ship's hulls are very large and are complexly contoured in both the vertical and longitudinal directions. The world's population of ships has a very significant number of different sizes and shapes.

Coating of the exteriors of ships requires using abrasive blasters for surface preparation and painters for application of paint. Both blasters and painters must be brought into close proximity to the portion of the hull they are working. Neither blasters nor painters can perform their work on much more than 75 square feet of hull surface without moving or being moved to another location.

In earlier times, worker movement from place to place around a ship's hull was accommodated by building staging around the ship.

Also, in earlier times, the coating of the exterior hull above the waterline was most often done with the ship afloat. However, enactment in the U.S. of the Clean Water Acts all but eliminated this practice since coating of this area of a ship afloat deposited significantly more spent abrasive and paint overspray in the water than did coating in a drydock.

More recently, required worker movement has been accomplished through the use of manlifts. A conventional manlift includes a staging basket mounted on an arm which has the capability of being hydraulically lifted, extended and rotated; this arm being mounted on a carriage powered by an internal combustion engine. The carriage has the capability of being moved from place to place on a horizontal surface.

Even more recently for abrasive blasting, efforts have been made to replace the worker in the manlift basket, with an enclosed shotblast head which has the capability of catching, processing and reusing the abrasive. However, this approach has had little acceptance because of the cost to purchase and operate the apparatus, plus operating difficulties with the devices actually available.

Since ships are very large vessels which operate on large bodies of water, their construction and repair including drydocking almost always takes place immediately adjacent to large bodies of water.

Pollution of these large bodies of water including Great Lakes, rivers, seas, bays and oceans has become of much greater concern to societies around the world because of the negative effect of this pollution on the vegetable and animal life which depend upon these bodies of water. This concern has grown as more of the public elects to use these bodies of water for recreation through swimming and boating as well as living adjacent to them in hotels, houses, apartments and condominiums.

Abrasive blasting of a ship's hull necessarily creates a significant quantity of particulate material, usually dust comprised in part of smaller particles of the abrasive medium as it breaks down upon being propelled pneumatically against the ship's hull and in part of small particles of the ship's paint and steel which is removed by the abrasive. While this dust is not currently officially considered to be hazardous, it is nevertheless noxious to the public and does contain toxins in apparently nonhazardous quantities.

Because a portion of this dust inevitably is blown over the adjacent body of water, small quantities of these toxins find their way into the water. Further, if the large percentage of the spent abrasive which lands on the drydock floor is not promptly cleaned up, trace amounts of the toxins leach out during rainstorms or from other sources of water used in ship repair and are deposited into the body of water from the drydock's drainage system. Toxic petroleum products including fuels, lubricants and greases associated with manlift, forklift and compressor operations can similarly be carried through the drydock drainage system into the adjacent body of water.

Recent regulations implementing the U.S. Clean Water Act impose more stringent restrictions on contaminants in storm water runoff. These regulations mandate that either contaminants be eliminated or drydock storm water runoff be collected and treated, a process not currently feasible because of the quantity of water involved.

Typically, a ship has a large quantity of exterior mechanical equipment. This equipment, which is expensive to repair and purchase, is subject to severe damage if infiltrated by the dust from abrasive blasting, which is itself very abrasive. This mechanical equipment, which includes interior ventilation systems, must be temporarily covered with protective covering during abrasive blasting. This temporary covering inhibits operation of the interior ventilation systems when abrasive blasting is underway causing discomfort to ships crew members living aboard as well as to workers inside the ship.

Virtually all the equipment currently used in abrasive blasting has mechanical components. This includes air compressors, manlifts, forklifts, dust collectors and drydock cranes. Since this equipment must operate during abrasive blasting, it cannot be protected. It therefore, experiences very high maintenance cost, extensive out-of-service periods, and shortened operating lives.

Coatings on drydock horizontal surfaces experience short lives as they are abraded off by the combination of spent abrasive and vehicular and personnel movement, including that which accompanies shoveling and sweeping.

Workers who are free to proceed with exterior ship construction and/or repair tasks which do not involve mechanical ship's components are disrupted, made less efficient and exposed to respiratory and eye aggravation when abrasive blasting is proceeding concurrently. Workers and ship's personnel transiting through the abrasive dust cloud to and from the interior of the ship are similarly affected.

Most ships operate in a corrosive saltwater/spray environment. Therefore, the most popular marine paints are solvent-based vinyls and epoxies. Some marine paints contain zinc or copper. During the time that these paints are being applied, overspray is often blown into the adjacent body of water. This same overspray can coat itself on nearby boats, buildings, waterside cafes and cars, causing expensive damage and infuriating the public. Even the portion of the overspray which lands on the drydock floor can find its way back into the adjacent body of water as it attaches itself to dust or dirt particles on the floor of the drydock which are washed by water through the drydock's drainage system.

Non-waterbased paint solvents common in marine coatings release volatile organic compounds (VOCs) into the atmosphere during the time that they are evaporating, during the paint curing process. Regulatory authorities are becoming increasingly concerned that these VOCs are damaging the environment. While VOC emissions from marine paints may not be apparent to the public, they are a matter of growing regulatory oversight, and will ultimately have to be reduced. The only current way to dispose of these invisible VOCs is to contain the air into which they are released, and then process that air through a VOC incinerator.

Best management practices being currently utilized to minimize the amount of abrasive dust and paint overspray being blown beyond the drydock perimeter include placing a curtain over each end of the drydock, performing abrasive blasting downward only, using airless paint spray equipment, and ceasing operations when wind velocities become higher than a predetermined limit. However, these practices nevertheless permit a significant percentage of the airborne abrasive dust and paint overspray to blow outside of the perimeter of the drydock. In addition, these practices do nothing to reduce the many other negative affects of the ship coating process.

Recently, some shipyards have begun shrouding ships, from the weather deck down to the drydock structure, with very large strips of material. This material must be somewhat porous to keep it from shredding in the wind. However, the lives of these large strips of material are short because of damage from wind, handling, errant abrasive blasting and other hazards inherent to the heavy industrial environment prevalent in shipyards. Because of the basic cost of the shrouding material itself, its short life in the shipyard environment itself, the cost of installing, removing, handling and storing it, this approach is very expensive. While this approach contains even more airborne abrasive dust and paint overspray within the drydock perimeter than current generally accepted best management practices, some still escapes through the necessarily porous material and through the joints where the strips of material overlap. In addition, this approach does little to solve the many other negative effects of the ship coating process and does nothing to reduce VOC emissions.

One other technology exists that reduces dust from sandblasting, that is the technology of vacuum blasting. However, this process is very slow and very costly from an equipment and manpower standpoint and does not address painting problems including overspray and VOC emissions.

With regard to approaches to resolving the many problems associated with the coating of ships, as expensive as the coating process is or may become, the major cost consideration is the speed with which a ship may be coated or recoated. This is because of the daily amortization and operation costs of the drydock required to lift the ship out of the water for recoating ($5,000 to $20,000 U.S. per day) and the ship itself which is out of service during recoating ($10,000 to $100,000 U.S. per day). These costs demand that with whatever solutions are developed to solve the existing problems with abrasive blasting and coating of ships, elapsed time of the coating process be of the essence.

The first aforementioned copending U.S. patent application discloses a system for performing external surface work on a ship hull, in which a vertical tower is erected on a support surface beside a ship, e.g., on deck of a drydock in which the ship is berthed. A set of flexible confinement curtains externally surround the tower, but are open towards a vertical segment of the ship hull. The tower mounts a vertically movable trolley, to which a cantilever arm mechanism mounts a work platform. In use, workers and/or roboticly controlled devices operating from the platform use abrasive blasting (e.g., via compressed air-powered abrasive grit-spraying nozzles) and paint or other coating composition spray nozzles to work on the vertical segment of hull surface that is confined within the shroud provided by the curtains. A system of supply lines and recovery lines which extend into and out of the confined space supply air abrasive, paint and other needs, and collect fumes and other expended material for processing, reprocessing or disposal, all with the intent of minimizing contamination of the environment. Similarly, spent abrasive grit, with its burden of paint chips and scale fragments is swept-up for separation, reuse and disposal. As work on each vertical segment of the hull is completed, the tower is shifted to a successive location along the hull. Magnets mounted to edge portions of the curtains are used for removably fastening the front edge of the shroud to the ship hull around the whole of the perimeter of the respective vertical segment. During the course of the work on a segment, the work-applying nozzle is traversed horizontally while aimed at the hull, and after the particular act of work on each horizontal band of the segment has been completed, the trolley is raised or lowered on the tower, so that another band can be worked on. The cantilever arms which mount the work platform to the trolley are extended and retracted, as needed, for maintaining the desired proximity of the work-applying nozzle to the hull surface from one band to the next. Although the baseline apparatus and method as disclosed in this aforementioned U.S. patent contemplate that more than one tower may be in use at the same time for performing respective tasks on respective vertical segments of the same ship hull, this aforementioned U.S. patent does not disclose jointly shrouding plural ones of the towers.

However, this latter improvement is a main topic of the second aforementioned copending U.S. patent application. The baseline apparatus and method as disclosed in that application discloses simultaneously working on adjoining segments of the same hull using a plurality of towers having respective adjustably cantilevered, elevatable work platforms, with the shroud curtains possibly providing interconnected confined spaces for all or some of the towers, with some side curtains subdividing the space in order to isolate the environments of various types of work from one another, as needed. That aforementioned U.S. patent application further discloses providing a support barge for carrying the various air compressors, paint supply tanks, abrasive material hoppers, so that all of these items of equipment need only to be connected to the various nozzles, etc., within the shrouded, confined space, rather than individually transferred to, from and from place to place around the hull. Other elaborations are disclosed, including possibly stationing the towers on a movable barge, so that the above-waterline part of a floating ship can be worked upon using the apparatus and method. In that connection, towers which can be laid-down for transit on their support barge, then easily erected to vertical positions for use are disclosed, as are ways and means for connecting the tower-support barge to the floating ship, and for using inflatable seals and also dams to seal the front edges of the shroud curtains to the hull, and bottom edges of the shroud to the support deck despite possible relative movement of the ship and tower support barge, and for reducing run-off of spent abrasive, paint particles and removed scale from the tower support deck to the body of water around the floating ship, or ship in drydock which is being worked-on.

In practicing the baseline apparatus and methods, as well as those of the present invention, it is a goal to provide sufficient freedom of motion to permit full worker and/or robotic access to all of the external surface of the ship hull that is to be worked on, and also to contain abrasive blast dust, spent abrasive, paint overspray and volatile organic compounds (VOCs), thereby significantly reducing the quantities of these materials which are released to contaminate the air, nearby bodies of water, ship's mechanical equipment, drydock cranes, abrasive blasting and painting support mechanical equipment, local housing, automobiles, nearby yachts and other floating vessels, and in addition significantly reduce the efforts necessary to collect, dispose of, recycle and incinerate waste abrasive and paint residue and significantly reduce the disruption of the concurrent shipboard repair work, all without increasing the drydock utilization times or ship out-of-service times.

For assisting a reader who does not have ready access to the disclosure provided in the above-mentioned copending U.S. applications, most of the detailed description which is provided in most extensively in the second of them and that is substantially germane to preferred practices of the present invention, are repeated below with reference to FIGS. 1–14.

Preferred practices of the baseline apparatus and methods made possible significant improvements in environmental compliance during ship hull coating because of the following:

a. Use of internal combustion equipment is eliminated with its potential to pollute the water through fuel oil, lubricating oil and grease spills which run or wash off the drydock floor.

b. Abrasive dust is collected and processed without leaving the enclosure.

c. Paint overspray is filtered without leaving the enclosure.

d. VOCs are contained and incinerated without leaving the enclosure.

e. Storm water is prevented from running through spent abrasive and debris contaminated with paint.

f. Use of recyclable steel grit abrasive instead of mineral abrasive eliminates disposal of spent abrasive with its contained toxins.

Preferred practices of the baseline apparatus and methods also provided a significant opportunity for improvement in coating quality by preventing negative effects of weather by preventing rain or snow from impacting on hull areas during coating and by providing hotter dehumidified air during coating.

Preferred practices of the baseline apparatus and methods further provided a significant opportunity to shorten coating and drydock span times by:

a. Shortening or eliminating equipment mobilization, setup, teardown and demobilization time through use of the coating support barge.

b. Eliminating weather interruptions.

c. Accelerating paint curing by heating air in the enclosure.

d. Allowing most ship repair work to proceed during hull coating.

e. Reducing drydock cleanup time by confining contaminated or spent abrasive to within the enclosure.

Preferred practices of the baseline apparatus and methods further facilitated very considerable reductions in the cost of the coating process for all the reasons respectively listed immediately previously under opportunities to reduce coating and drydock span times. Even more significant cost reductions can be realized as the very significant costs associated with drydock utilization and ship out-of-service times reduce proportionately to span time reductions. Also:

a. Rework from weather can be eliminated.

b. Transportation and crane handling of support equipment can be eliminated.

c. Abrasive contamination maintenance of manlifts, cranes, forklifts and compressors can be eliminated.

d. Wear and tear on portable hoses and ducting can be virtually eliminated.

e. Temporary covering of ship's mechanical equipment can be eliminated.

f. Purchase and disposal of mineral abrasive can be eliminated.

The present invention builds on the advantages provided by preferred practices of the baseline apparatus and methods, and, in preferred practices thereof, provides additional advantages.

The present invention provides certain improvements on the baseline apparatus and methods, that grew out of experiences with building and operating prototypes of such baseline apparatus and methods, and the making of plans for larger scale, commercial use of such apparatus and methods for performing external surface work on ship hulls.

SUMMARY OF THE INVENTION

Shrouded towers for supporting adjustably cantilevered work platforms for performing external surface work on ship hulls (such as abrading and painting) are modularized for sake of economy and efficient utilization, including shifting of modules using techniques and equipment currently used for shifting shipping containers. Supply and recovery line connections between support barge-mounted equipment, floating drydock and work platform-mounted work applicators is facilitated by fixed installation of some portions and the provision of flexible connectors between these portions.

Alternative adjustable cantilevering structures are disclosed for mounting the work platforms to the vertically movable trolleys. Preferably, rotating wheels rather than compressed air, are used to propel the abrasive grit against the hull surface, and abrasive supply systems having degrees of automated recovery of spent grit are disclosed.

Preferred practices of the apparatus and method of the present invention make possible further significant improvements in environmental compliance during ship hull coating, as follows:

a. By facilitating use of abrasive blasting wheels in place of air blast nozzles, much less compressed air needs to be used inside the enclosure, reducing the possibility of dust being blown out of the enclosure through small openings because of positive pressure.

b. By collecting abrasive dust and paint overspray at the source, less will fall to the floor of the dock where inadequate cleaning could result in it being washed into the body of water during undocking.

c. Use of portable hoses and ducting, especially on the floor of the dock, can be significantly reduced consequently reducing the chance of contamination from disconnection or failure.

Preferred practices of the apparatus and method of the present invention also provide additional significant opportunities for improvement in coating quality:

a. Abrasive blasting using wheels instead of air blast nozzles can improve visibility during blasting for operator and inspector and remove much of the human vulnerability factor.

b. Potential for mechanizing abrasive blasting and painting can remove much of the human vulnerability factor.

c. Permanently installed header systems on coating support facility, drydock and staging devices can provide improved control over the atmosphere inside the enclosure.

Preferred practices of the apparatus and method of the present invention further provide significant additional opportunities to shorten coating and drydock span times by:

a. Significantly reducing the length of temporary hose and ducting to be hooked up, and the time associated therewith.

b. Significantly reducing the incidents of damage to hoses and ducts by raising them off the deck, and the lost time associated therewith.

c. Significantly simplifying the process of remaining hose and duct hookup, and the time associated therewith.

d. Facilitating abrasive and paint equipment setup and replenishment, and the associated lost time.

e. Further reducing the amount of abrasive cleanup, and associated lost time, by using abrasive blasting wheels with collection capability.

f. Use of abrasive blasting wheels instead of air blast nozzles considerably reduces abrasive blasting span times.

g. Using mechanized equipment to move abrasive blasting and paint spraying equipment reduces span time.

h. Facilitating use of multiple abrasive blasting and paint spray units by a single operator saves span times.

i. Using upper staging devices with ventilation ducting and redundant lower staging units allow staging unit setup to be taking place in one enclosure location while abrasive blasting and spray painting are taking place in a second enclosure and VOC collection is taking place in a third enclosure location, thereby reducing overall span time.

j. Greater extensions of modified scissor mechanism and modified parallel mechanism cantilevered arms permit larger areas of hull in bows and sterns to benefit from use of the staging devices, thereby saving time.

k. Use of staging device module lifting pads and crane handling device while moving staging devices, similar to that used to load and unload containers into and from container ships can save considerable span times.

l. Use of a coating support equipment skid can permit the time savings of the coating support barge when barge accessibility to a ship on drydock is not convenient or practical.

Lastly, preferred practices of the apparatus and method of the present invention further provide additional cost-reduction opportunities, including:

a. Providing a centralized hydraulic system can eliminate the cost of purchasing and maintaining individual hydraulic power units for each staging device.

b. Facilitated use of abrasive wheels in place of air blast nozzles can result in less compressed air dispersal of contaminated abrasive and dust and less associated cleanup.

c. Use of abrasive blast wheels instead of air blast nozzles can reduce use of compressed air, and therefore, the compressor size and cost to purchase and operate.

d. Abrasive wheel-contaminated abrasive collection in a discharge reservoir which discharges directly into a collection bin can reduce abrasive cleanup cost.

e. Localized collection of abrasive dust, paint overspray and VOCs can reduce the required size of air handling and contaminate processing equipment and the cost of buying and operating that equipment.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings:

FIGS. 1–8 and the related description have been carried forward (with modifications to FIGS. 2, 3 and 8 from the above-identified copending U.S. patent application No. 07/782,315).

The coating operation which is shown and described is sometimes herein referred to by a term "CAPE".

FIGS. 15–49 illustrate changes and elaborations provided by the principles of the present invention, relative to the baseline apparatus and methods.

FIGS. 15–20 depict improvements to service line layout and connections.

Figure 15:
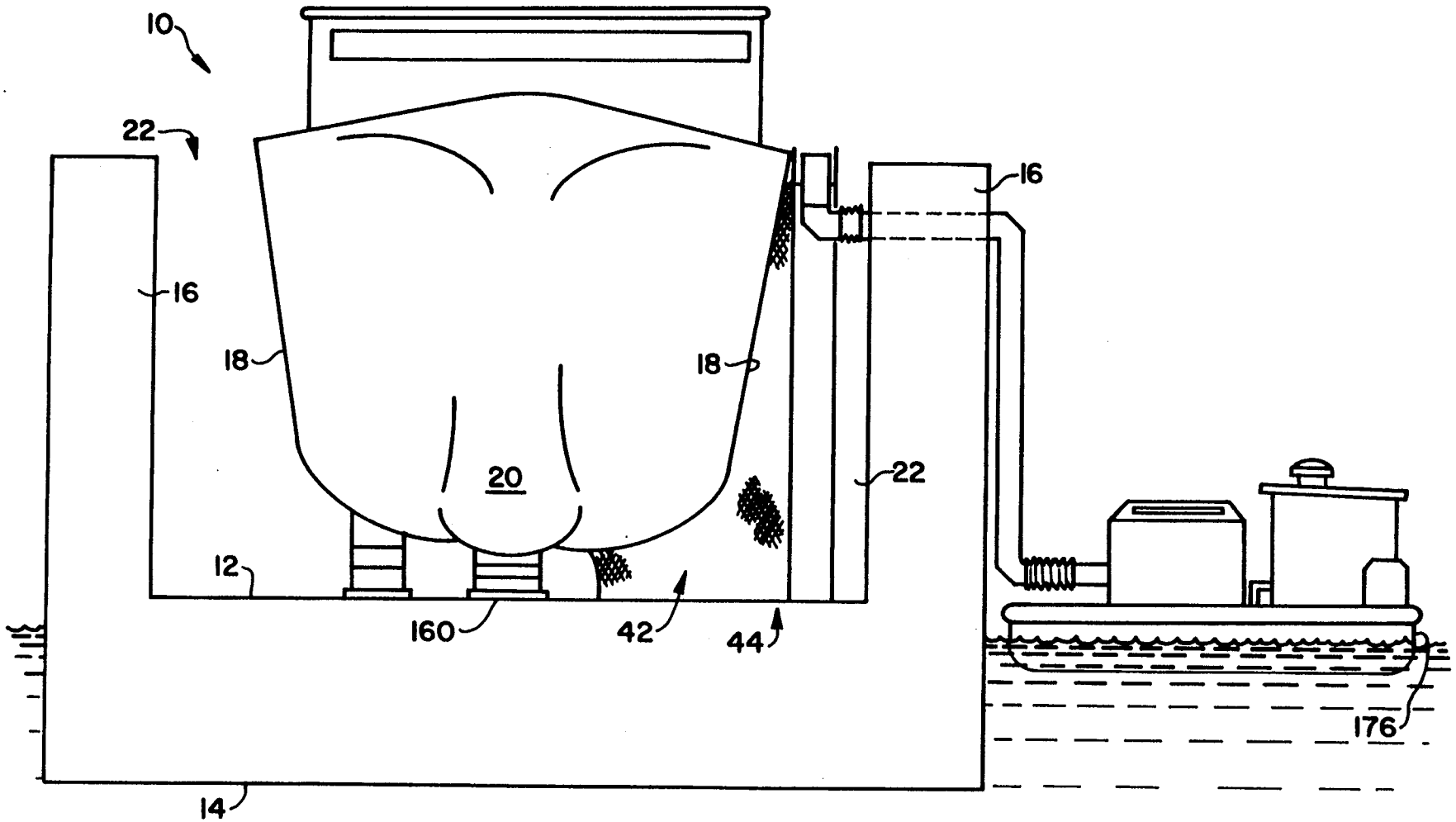
Figure 16:
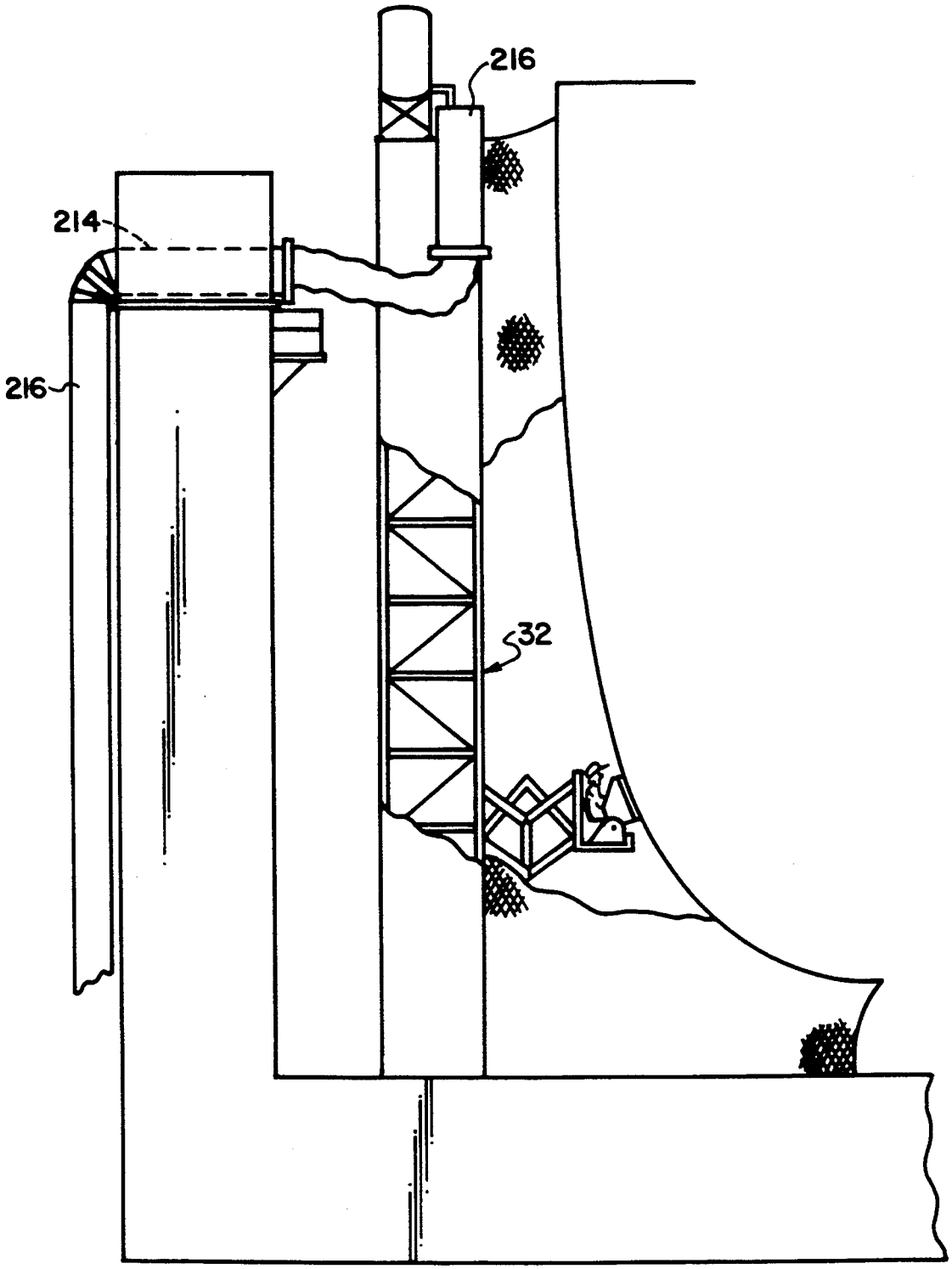
Figure 17:
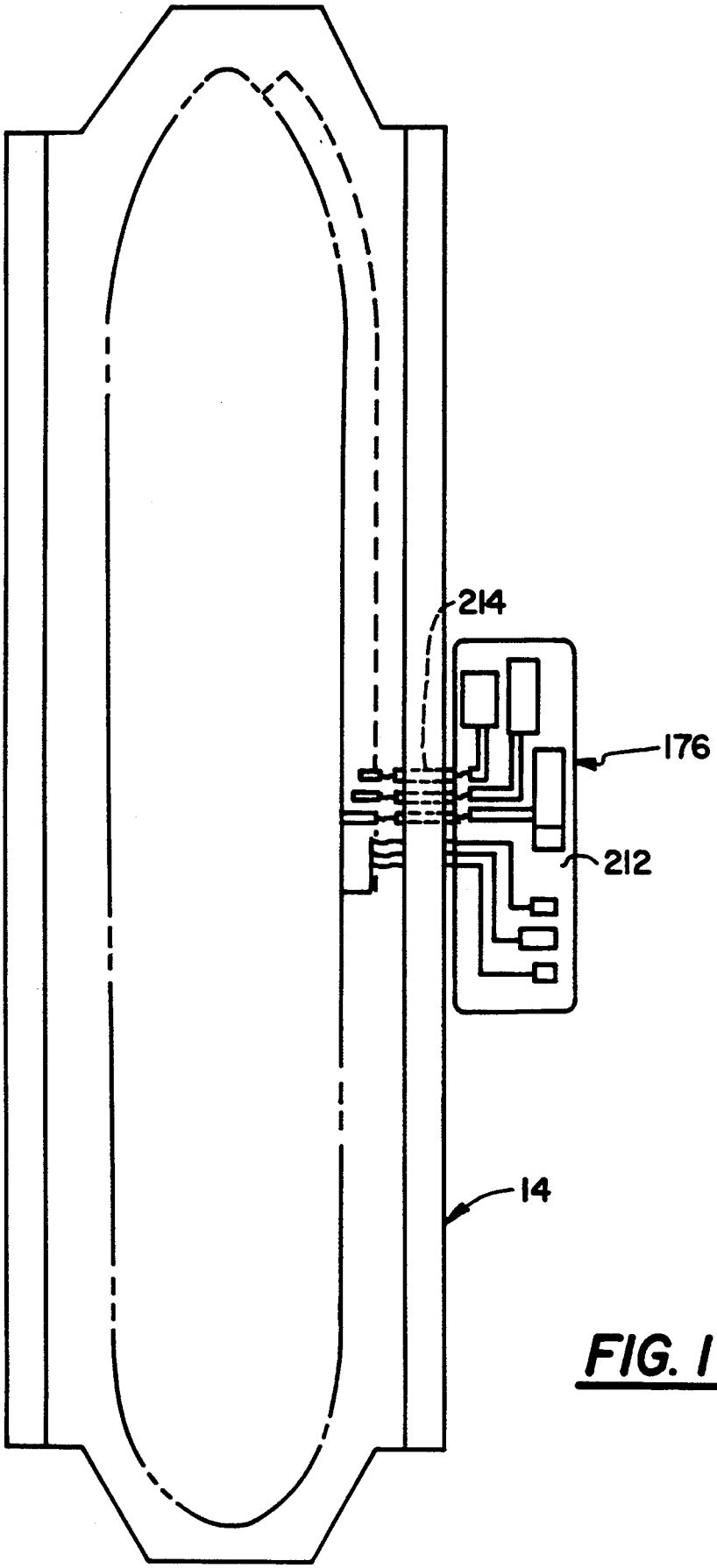
Figure 18:
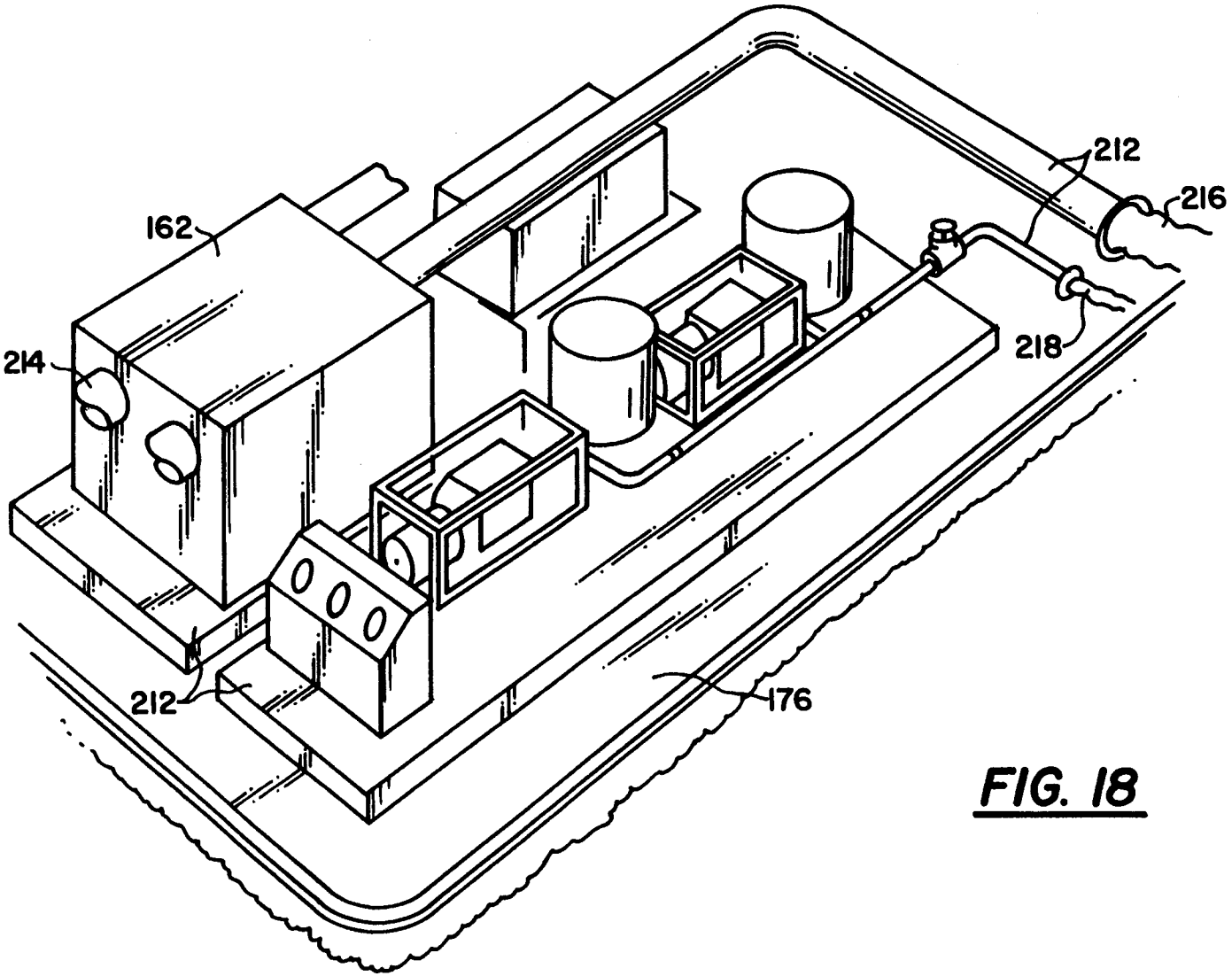
Figure 19:
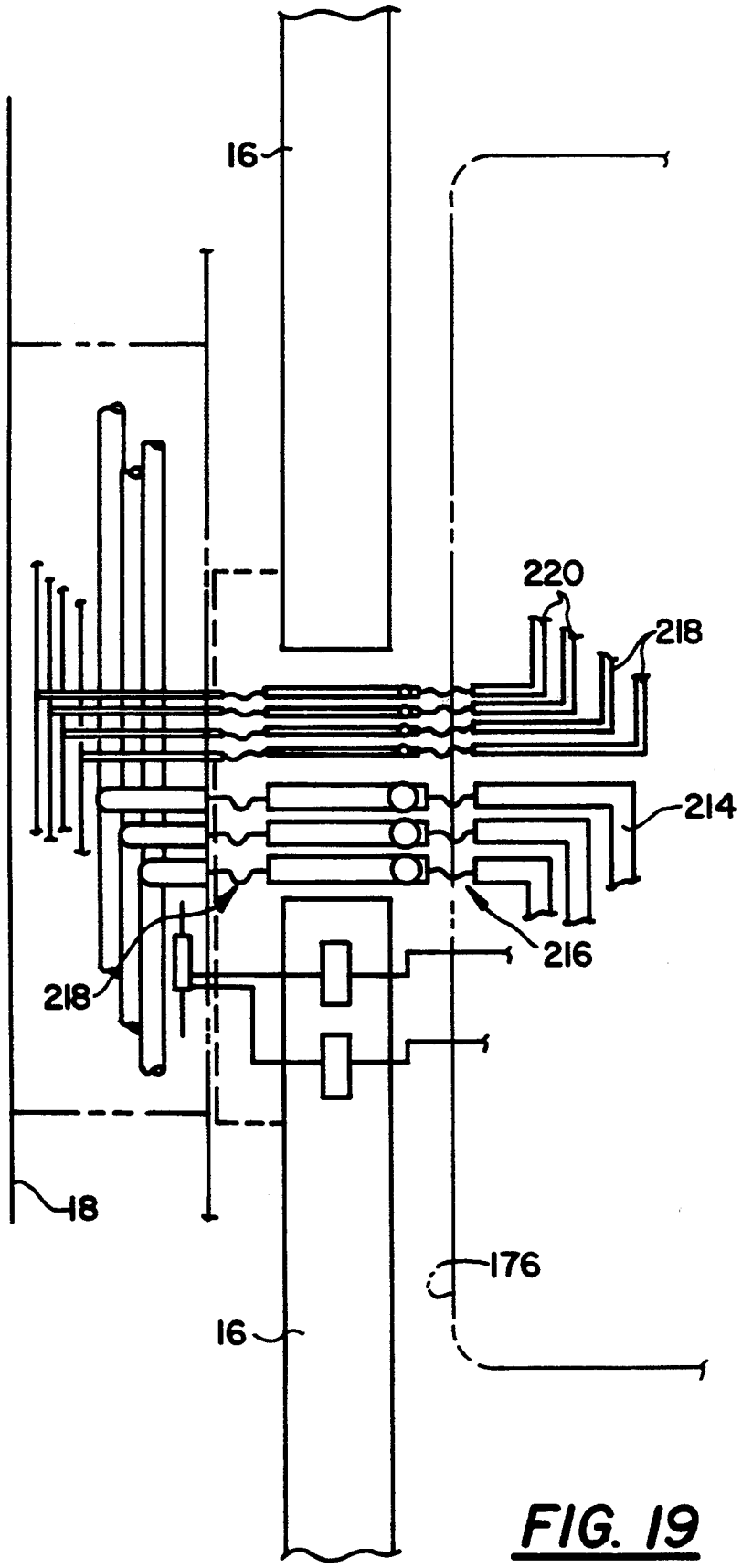
Figure 20:
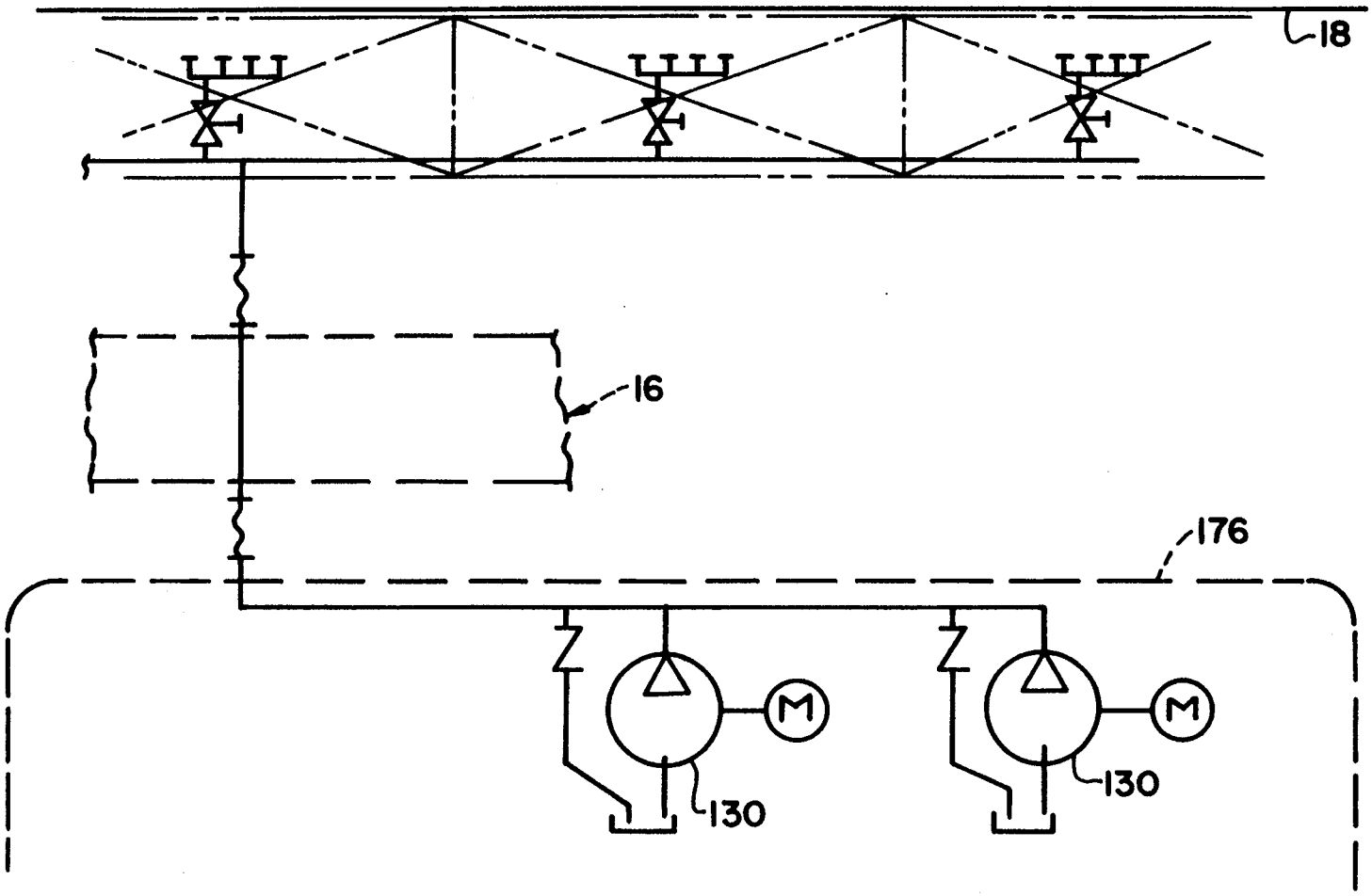

FIG. 15 is a schematic front elevational view of a ship supported in a floating drydock served by a support barge for the shrouded staging system, supply and recovery lines to and from the support barge being shown comprising some permanently installed segments on the barge, drydock wingwall and staging device modules, with flexible, disconnectable connections;

FIG. 16 is a larger scale fragmentary schematic rear elevational view of the part of the structure shown in FIG. 15;

FIG. 17 is a smaller scale schematic top plan view of the structure shown in FIGS. 15 and 16;

FIG. 18 is a perspective view from above, one side and one end of the support barge of FIGS. 15 and 17;

FIG. 19 is a larger scale fragmentary schematic top plan view of the wingwall of the floating drydock, showing service line segments and flexible connections via the wingwall to and from the staging device modules and the service barge; and FIG. 20 is a smaller scale fragmentary schematic top plan view of the hydraulic service line connections depicted in FIG. 19.

FIGS. 21–28 depict improvements to staging device tower structure and deployment.

Figure 21:
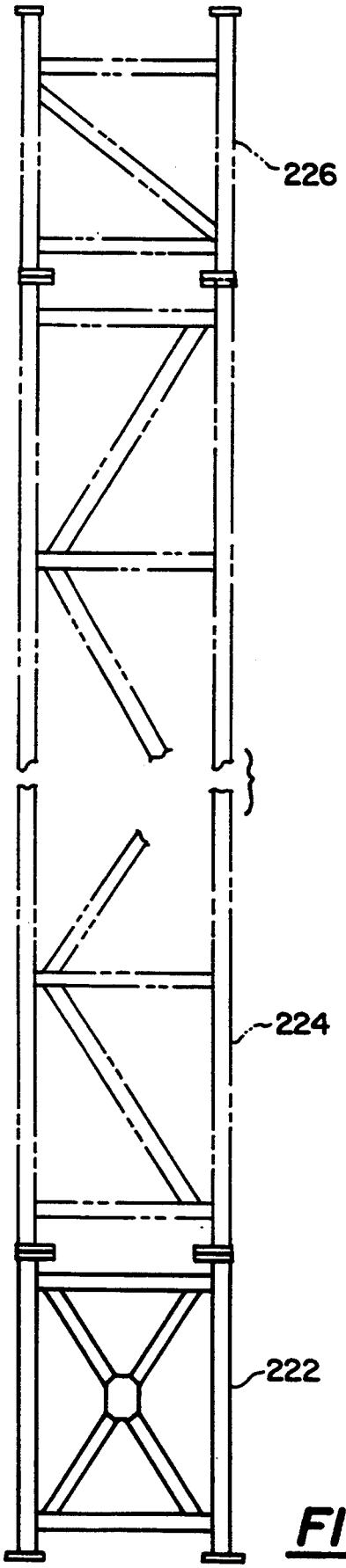
Figure 22:
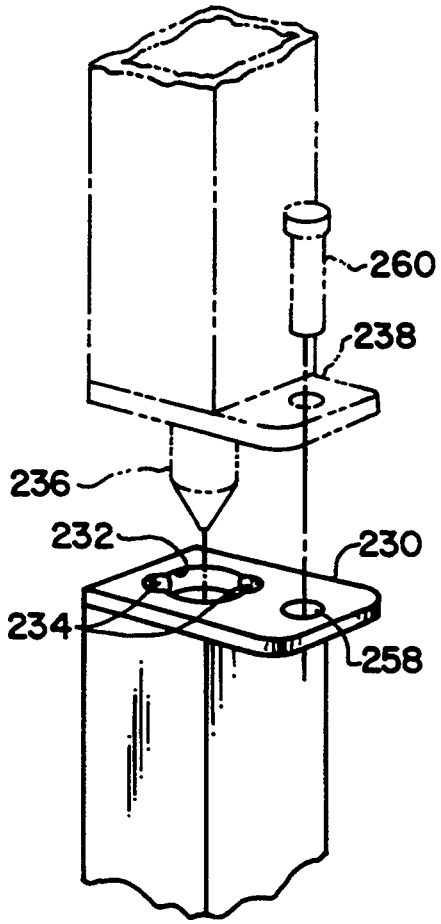
Figures 23, 24:
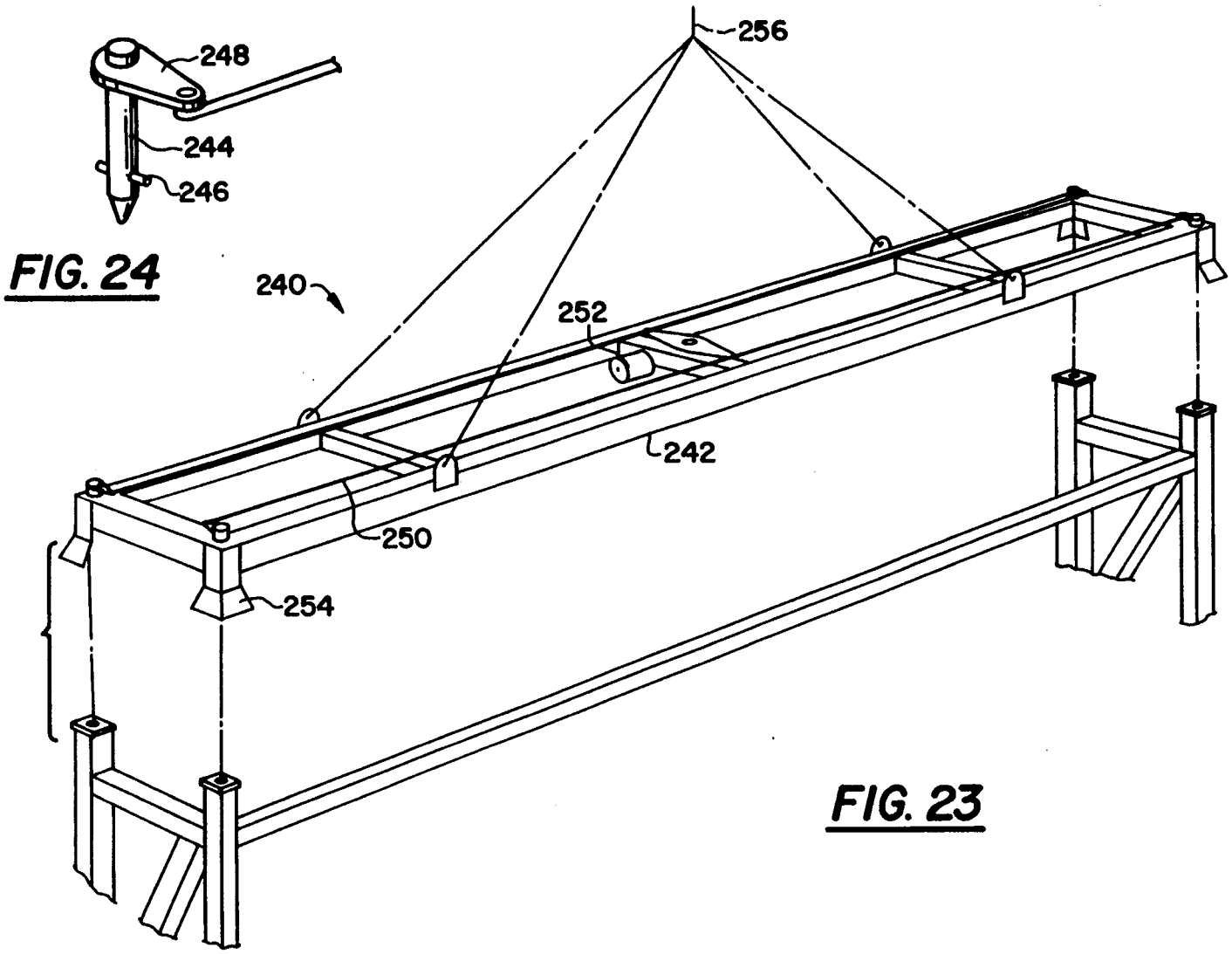
Figure 25:
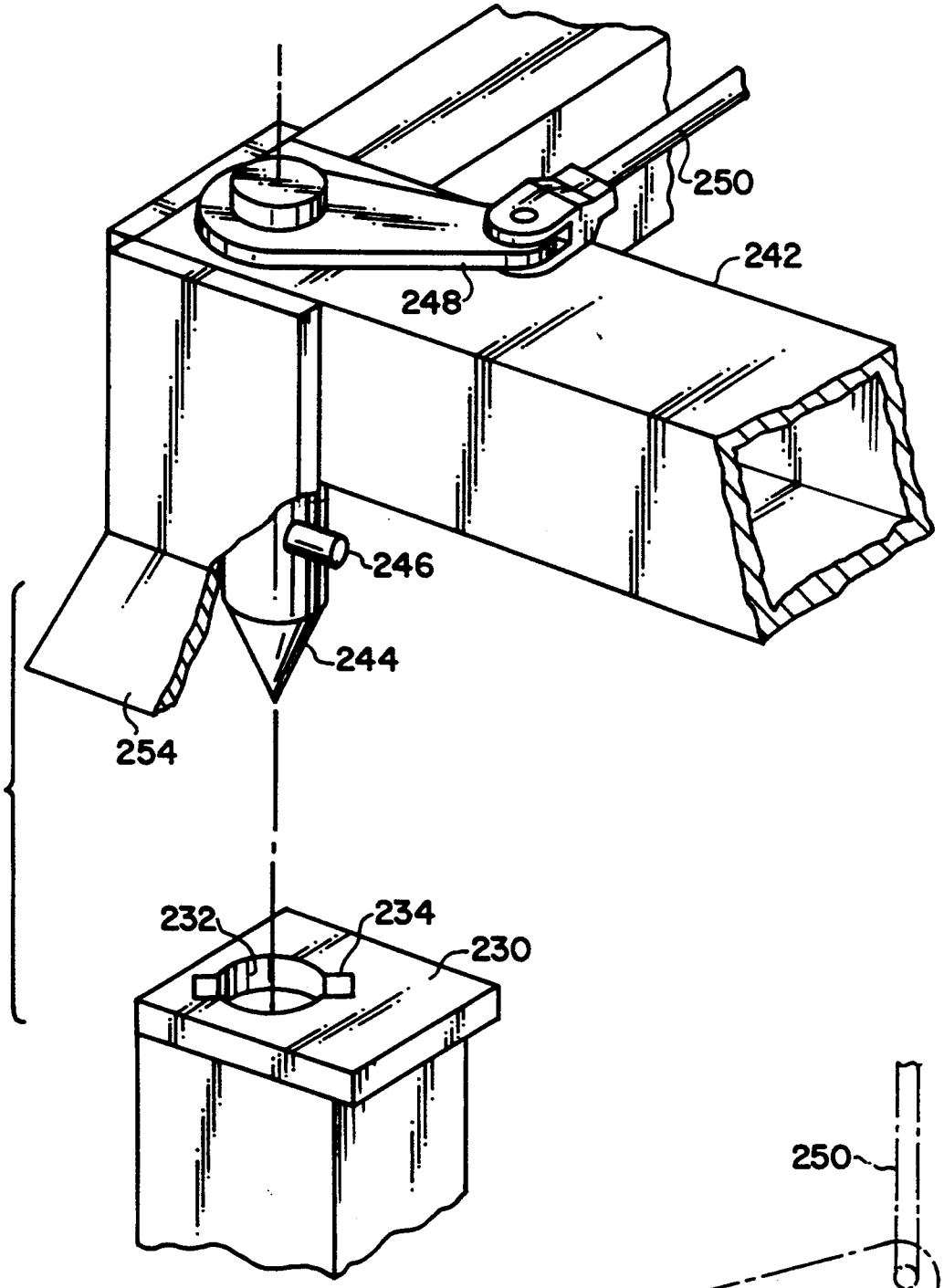
Figure 26:
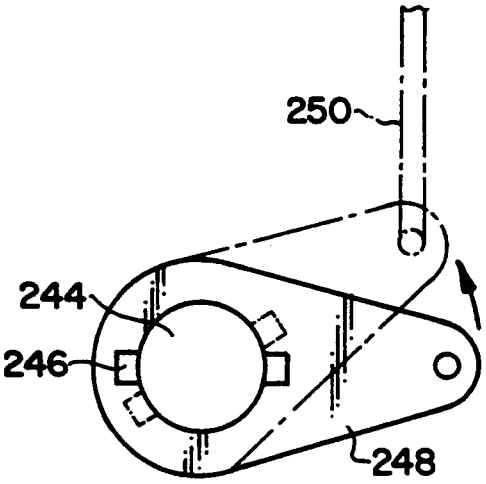
Figure 27:
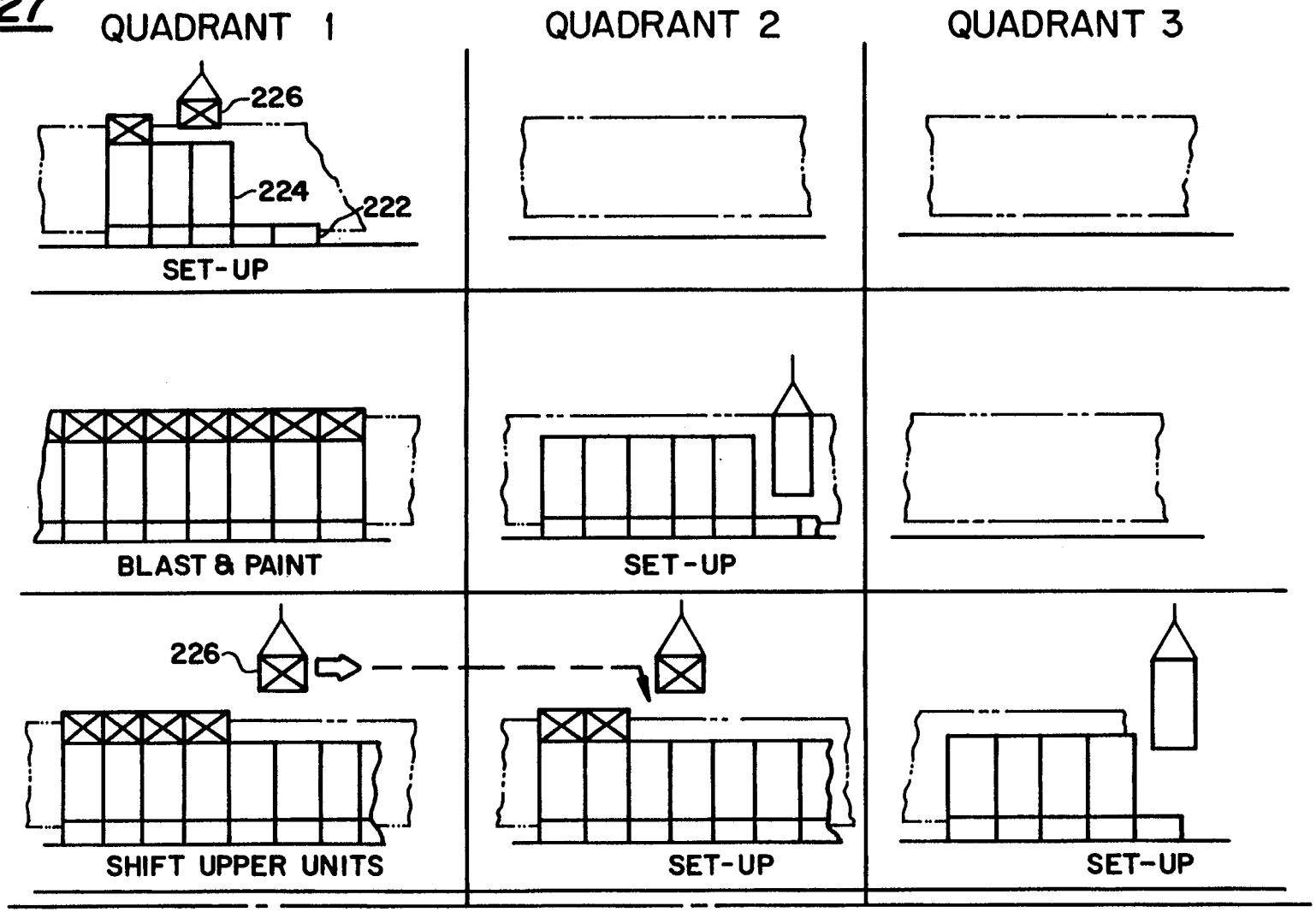
Figure 27:
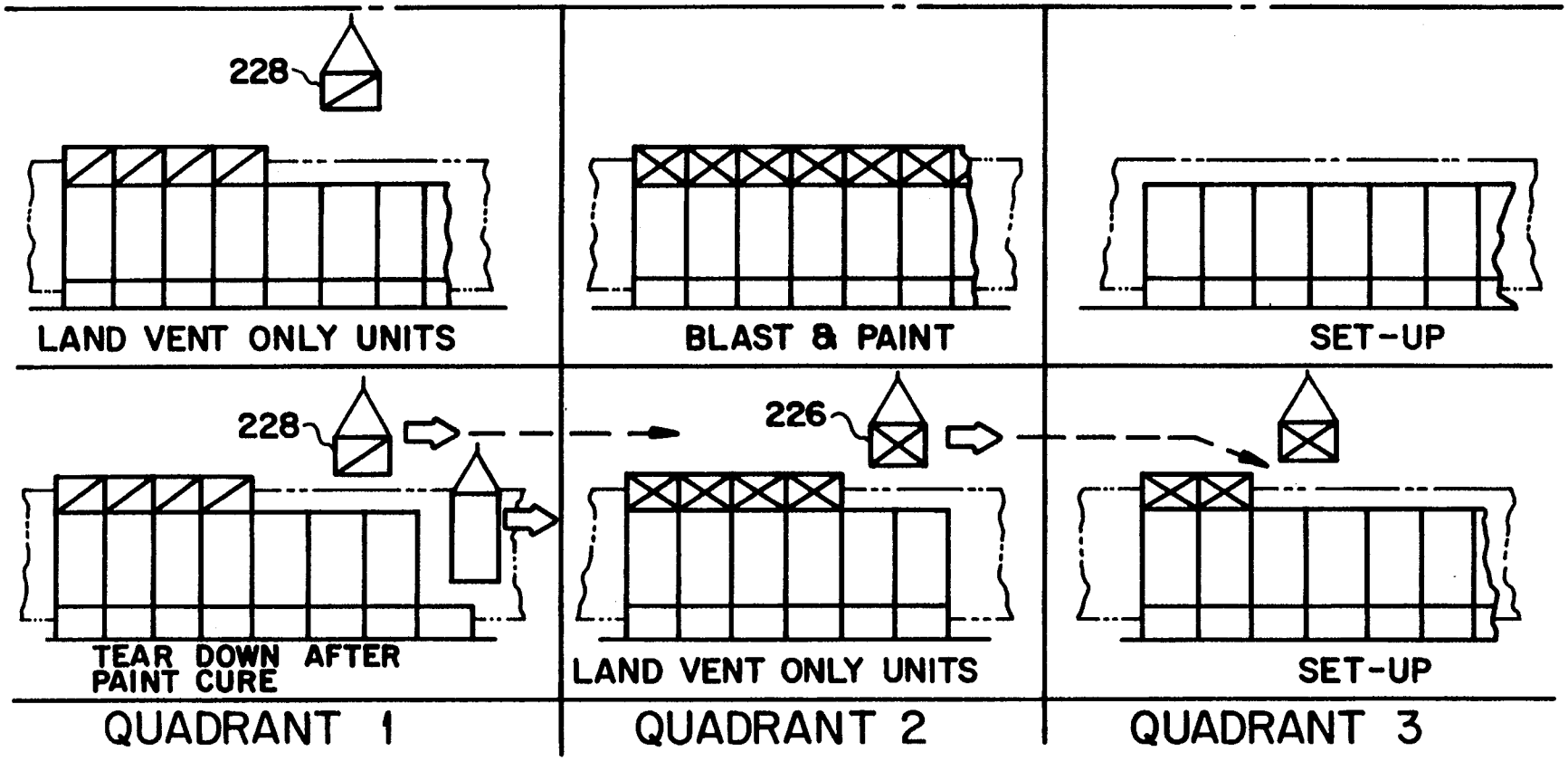
Figure 28:
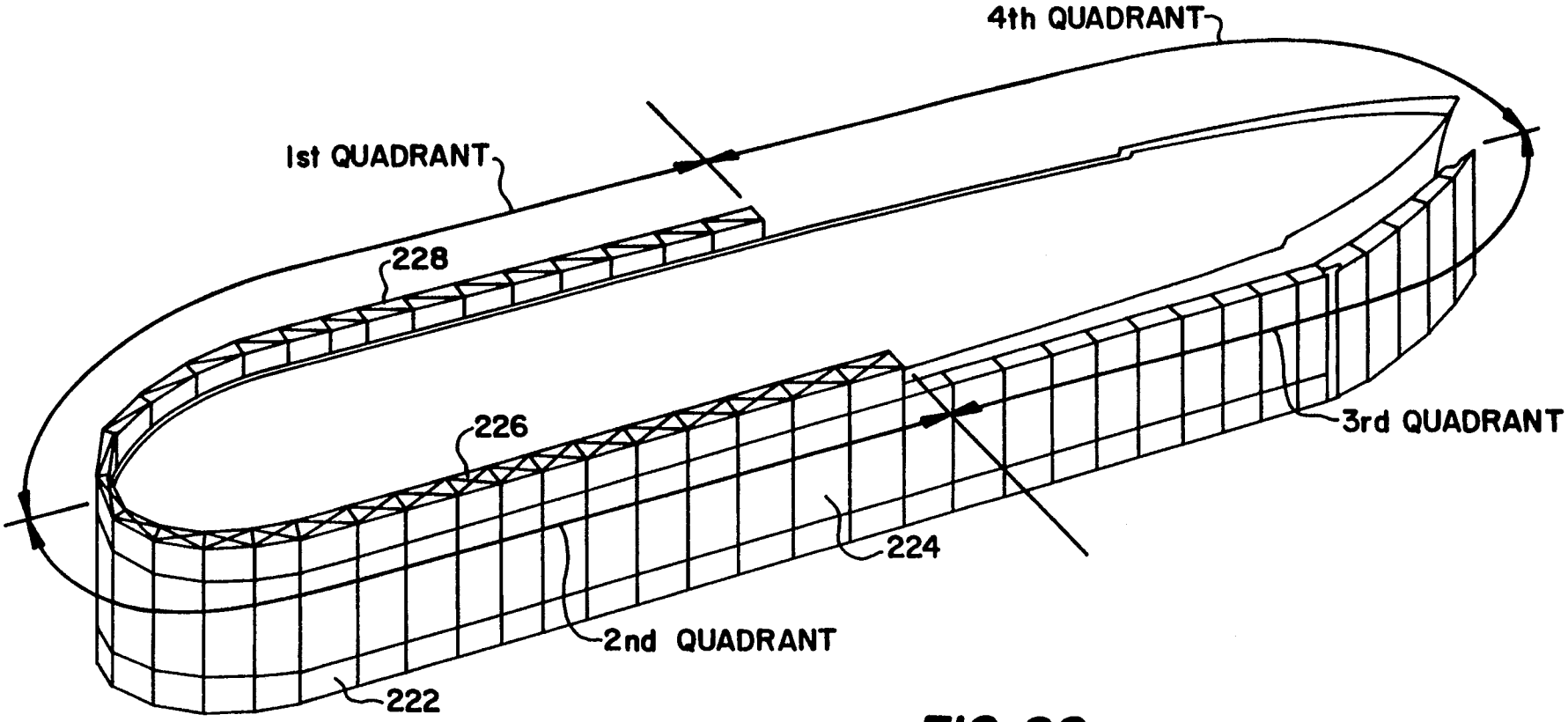

FIG. 21 shows in side elevation in full lines a base module for a staging device tower, and, in phantom lines, surmounting intermediate and upper modules;

FIG. 22 is a larger scale fragmentary perspective view showing a typical connection being reversibly made or broken between a base module corner column upper end and a respective intermediate module corner column lower end (a connection between the upper end of the intermediate module and lower end of the upper module being the same in structure and appearance;

FIG. 23 is a smaller scale fragmentary perspective view showing use of a lifting frame for assembling, disassembly or moving a staging device tower;

FIG. 24 is a larger scale fragmentary perspective view of a twist lock pin of the lifting frame of FIG. 23;

FIG. 25 is a larger scale fragmentary perspective view of one corner of the lifting frame of FIG. 23, poised over an upper end of a corner column of a staging device tower module;

FIG. 26 is a schematic top plan view illustrating twisting, in use, of a twist lock pin of the lifting frame of FIGS. 23–25;

FIG. 27 is a schematic flow chart showing successive stages in blasting and painting a ship hull using the tower modules and assembly, disassembly and moving techniques that are shown and described in relation to FIGS. 21–26; and FIG. 28 is a schematic perspective view of a ship on which the method of the invention is being practiced in a progressive stagewise manner as laid out in FIG. 27.

FIGS. 29–32 show preferred adjustable cantilever arm arrangements for connecting the work platform to the trolley of a staging device tower.

Figure 29:
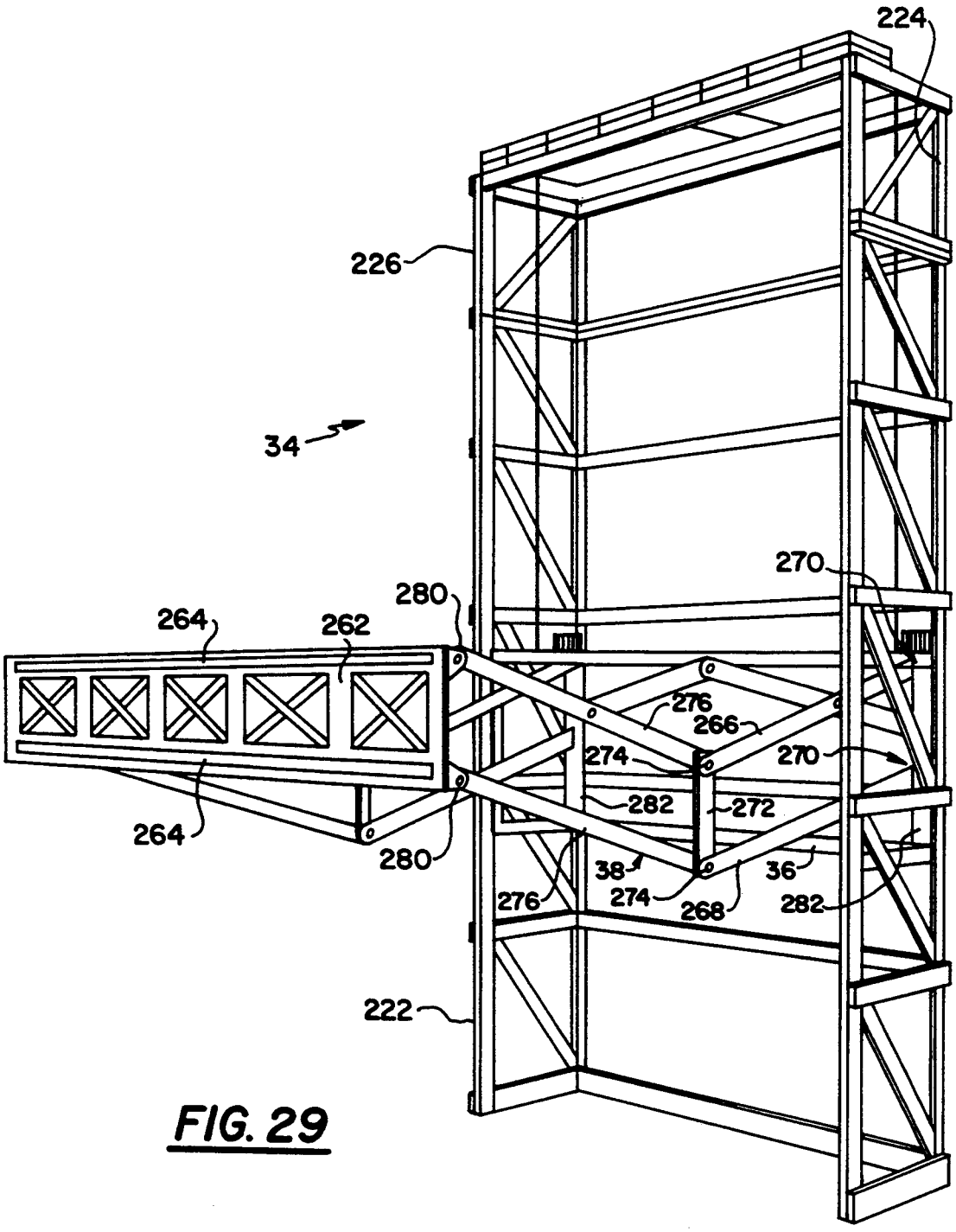
Figure 30:
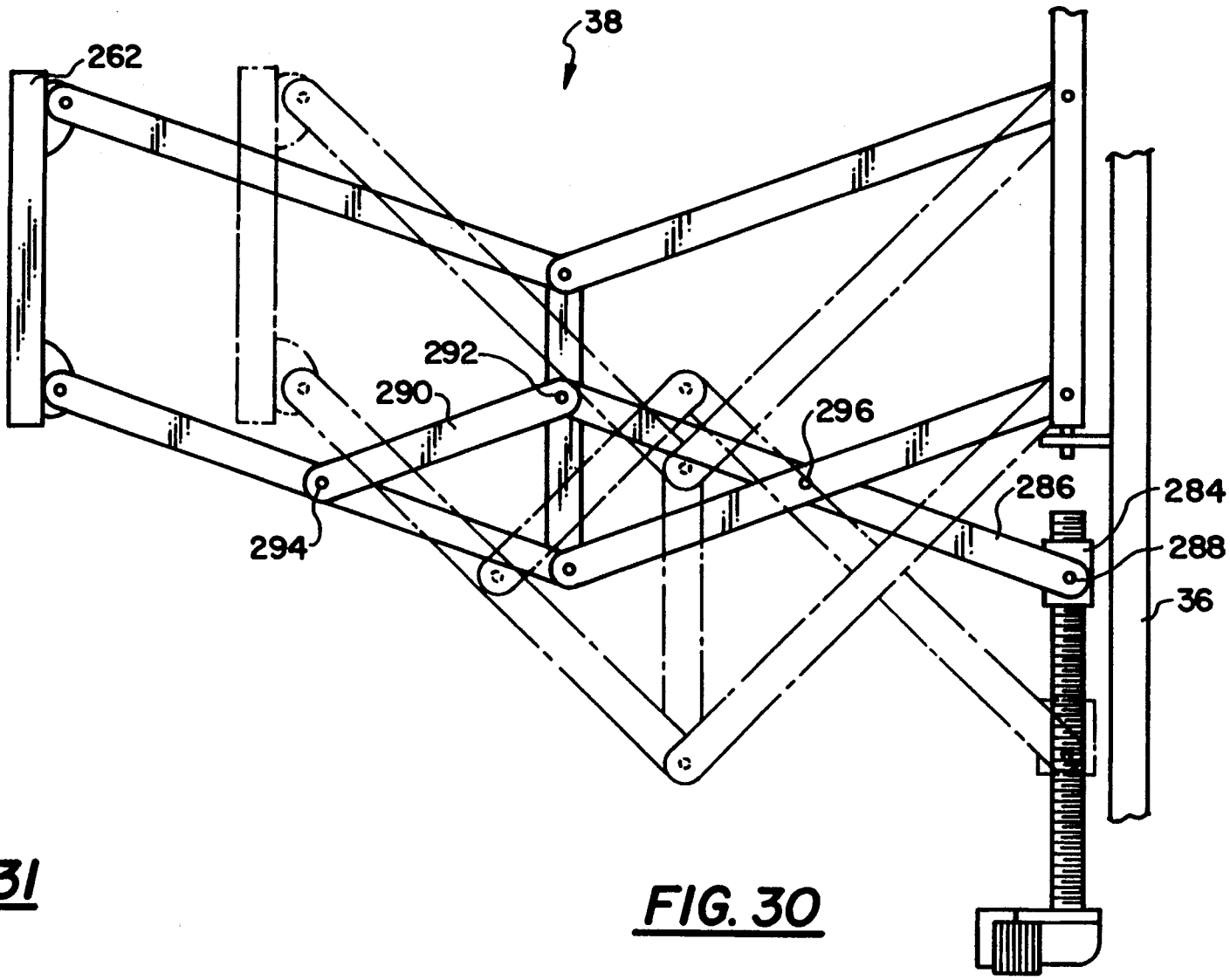
Figure 31:
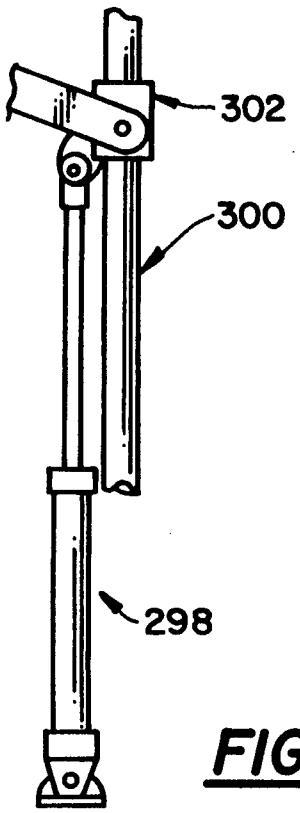
Figure 32:
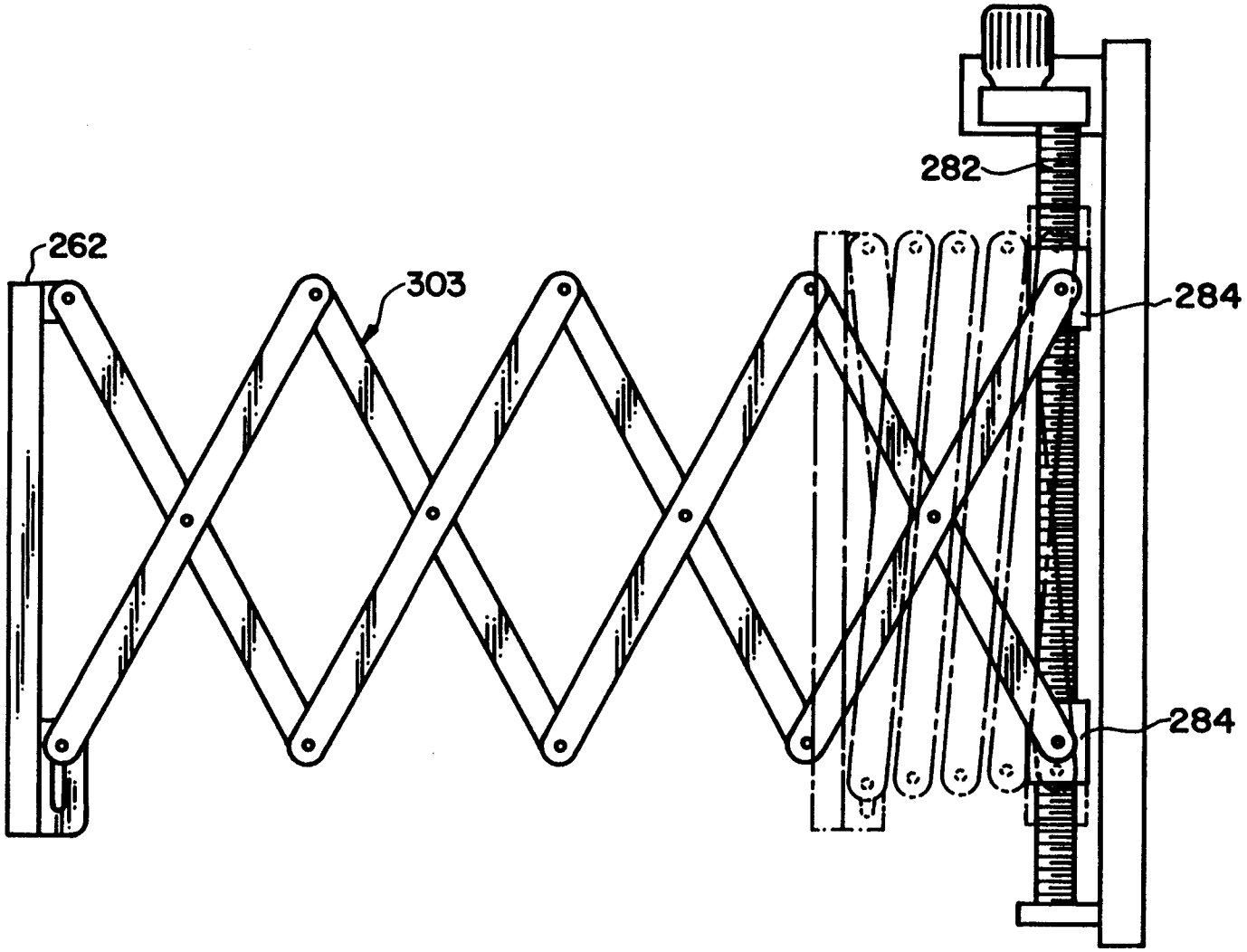

FIG. 29 is a perspective view from the front and right side of a preferred embodiment of the tower showing one preferred cantilever arm arrangement;

FIG. 30 is a larger scale fragmentary side elevational view thereof, showing arm movement geometry as the work platform is extended and retracted;

FIG. 31 is a fragmentary side elevational view showing an alternative form of drive for extending and retracting the arm structure of FIGS. 29 and 30; and FIG. 32 is a fragmentary side elevational view, comparable to FIG. 30, but showing an alternative arm structure.

FIGS. 33–41 show preferred work platforms, work-applying heads, particularly abrasive and paint applying and recovering devices.

Figure 4:
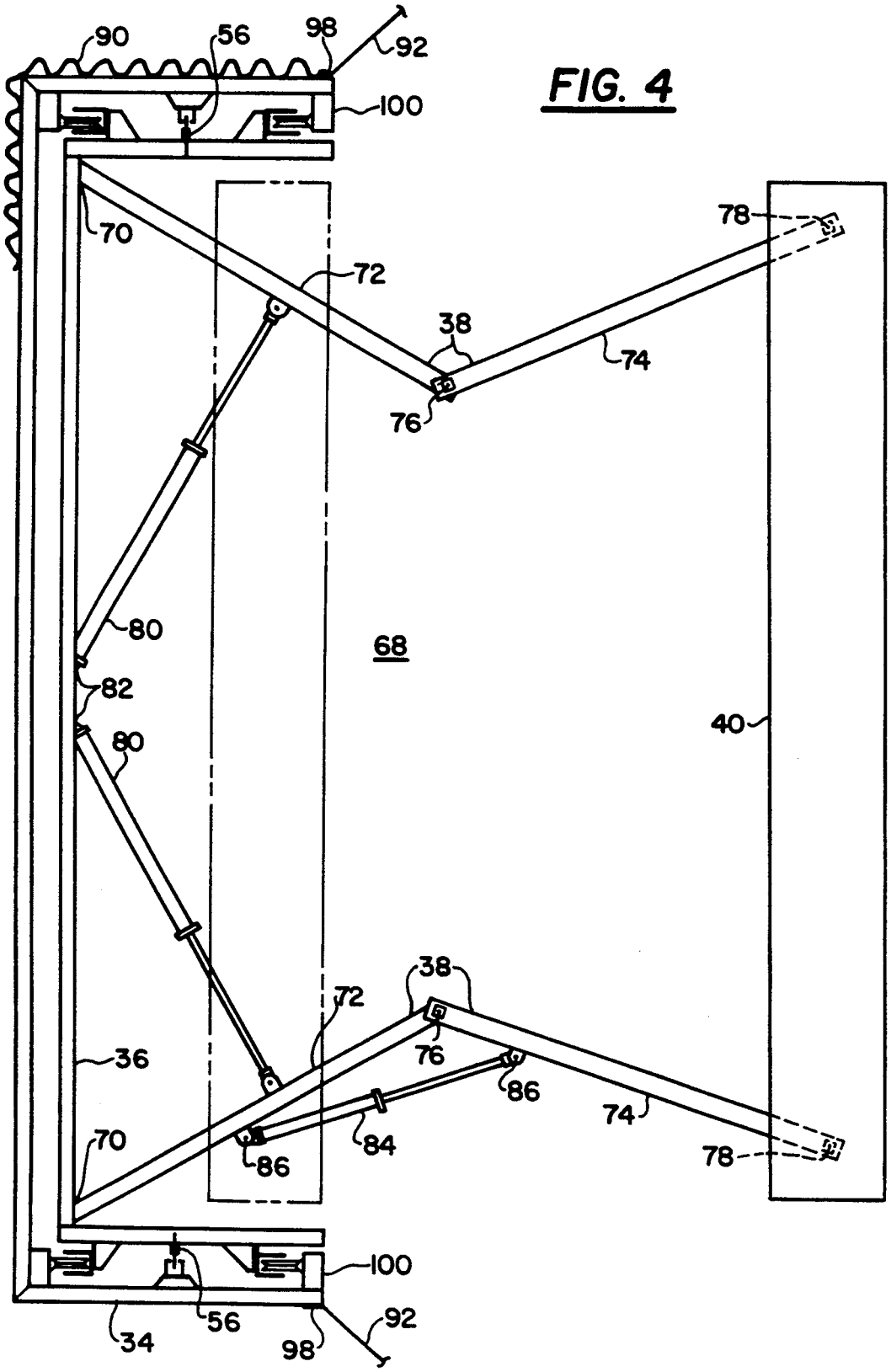
FIG. 4 is a downward-looking transverse sectional view thereof, taken at a level below the hoist but above the trolley, showing the cantilevered truss arms supporting the work platform at a variably transversally extended position relative to the tower.
Figure 5:
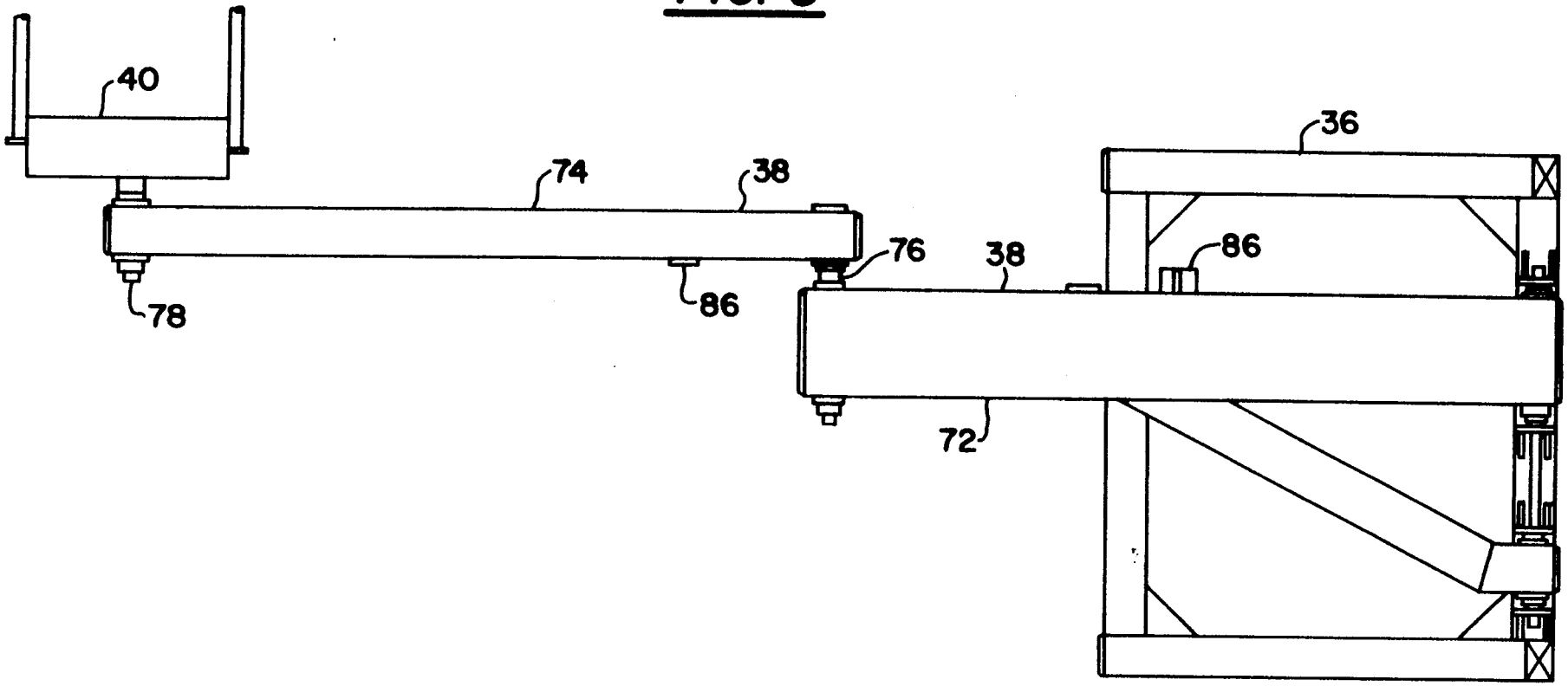
FIG. 5 is a side elevational view of the structure shown in FIG. 4, with the trolley in longitudinal section.
Figure 6:
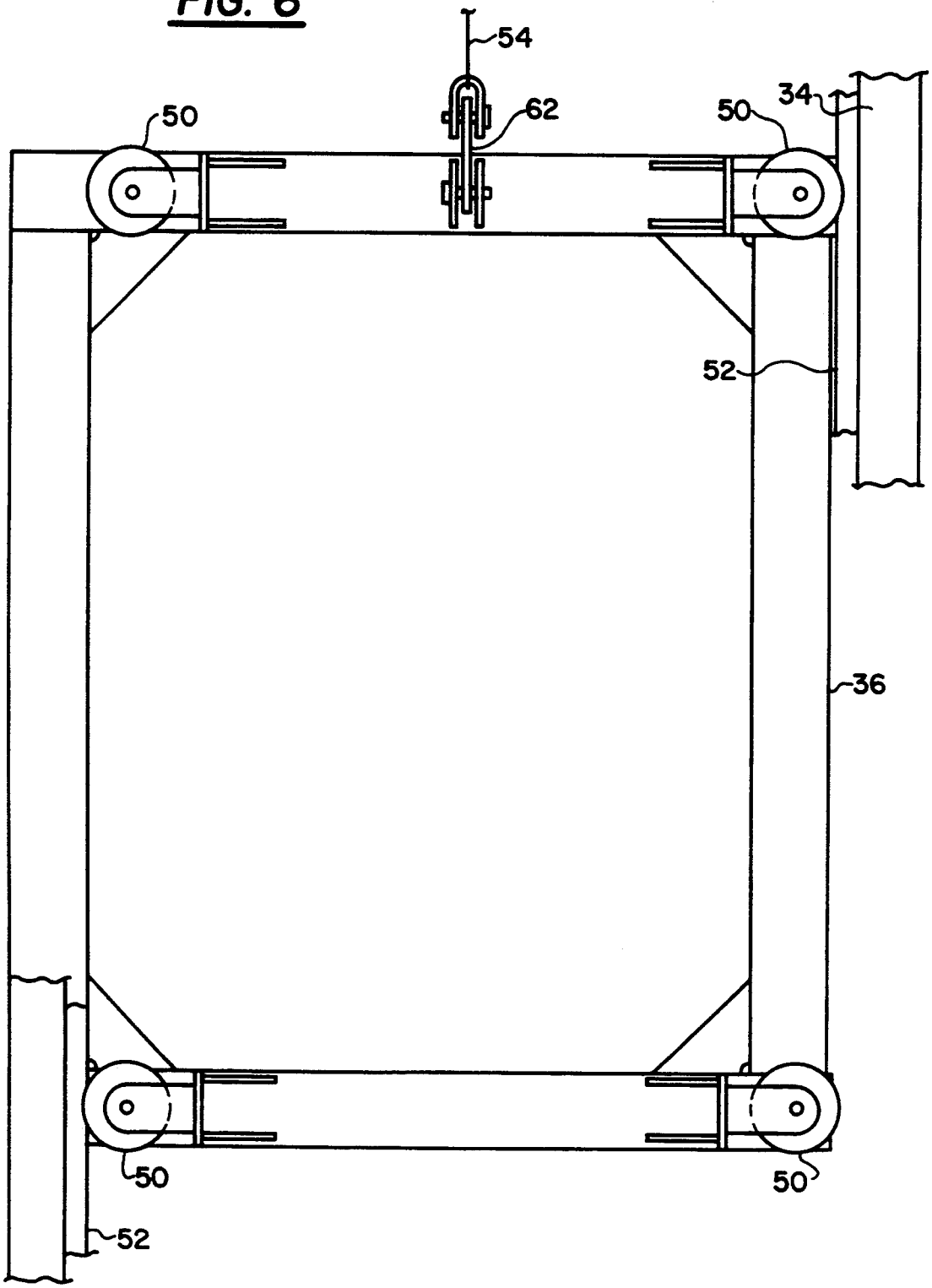
FIG. 6 is a side elevation view of the trolley, with the arms omitted, showing the relation of the trolley to the frame.
Figure 7:
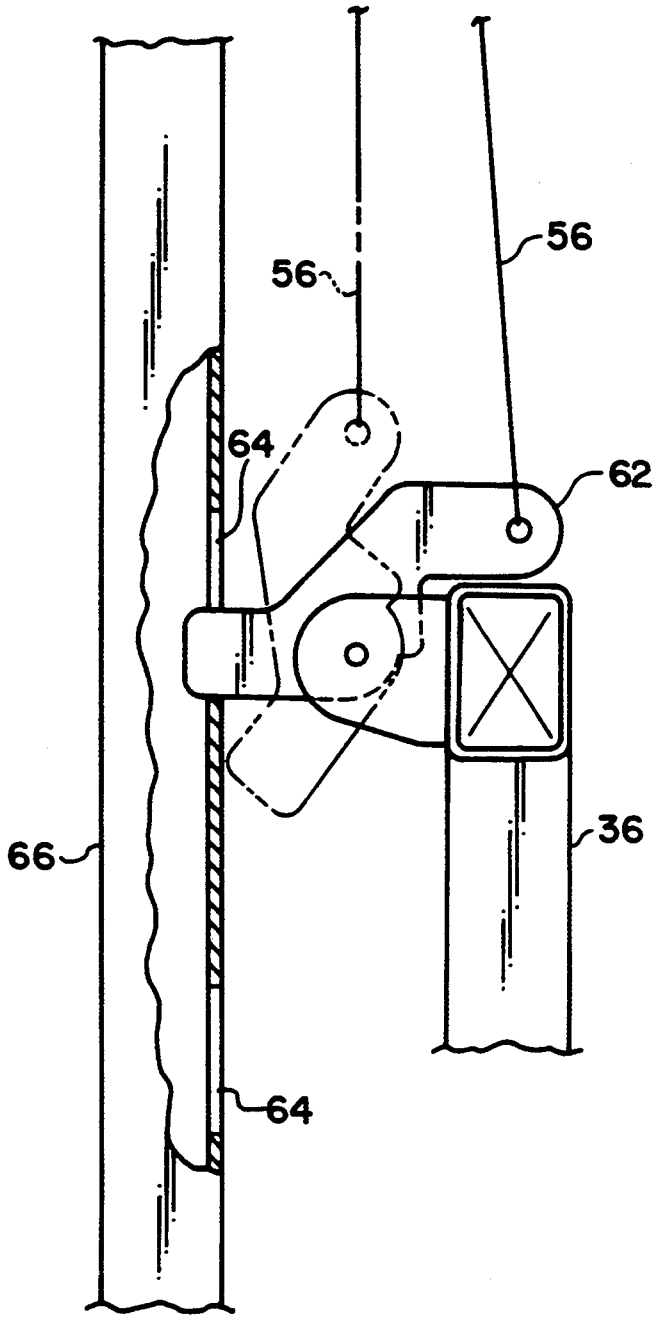
FIG. 7 is a fragmentary elevational view, with some parts cut away and sectioned, showing one of the preferred safety ratchet assemblies for each of the two lift points for the trolley.
Figure 33:
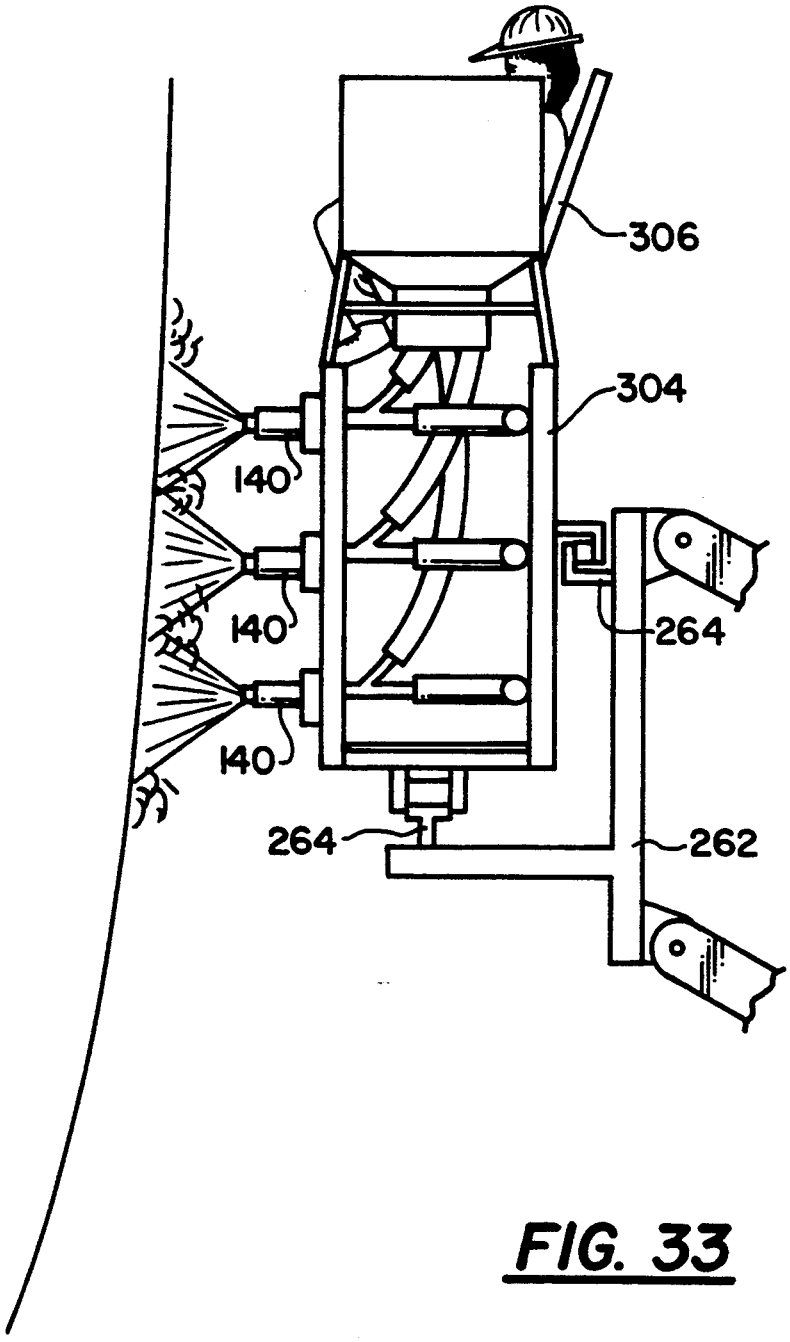
Figure 34:
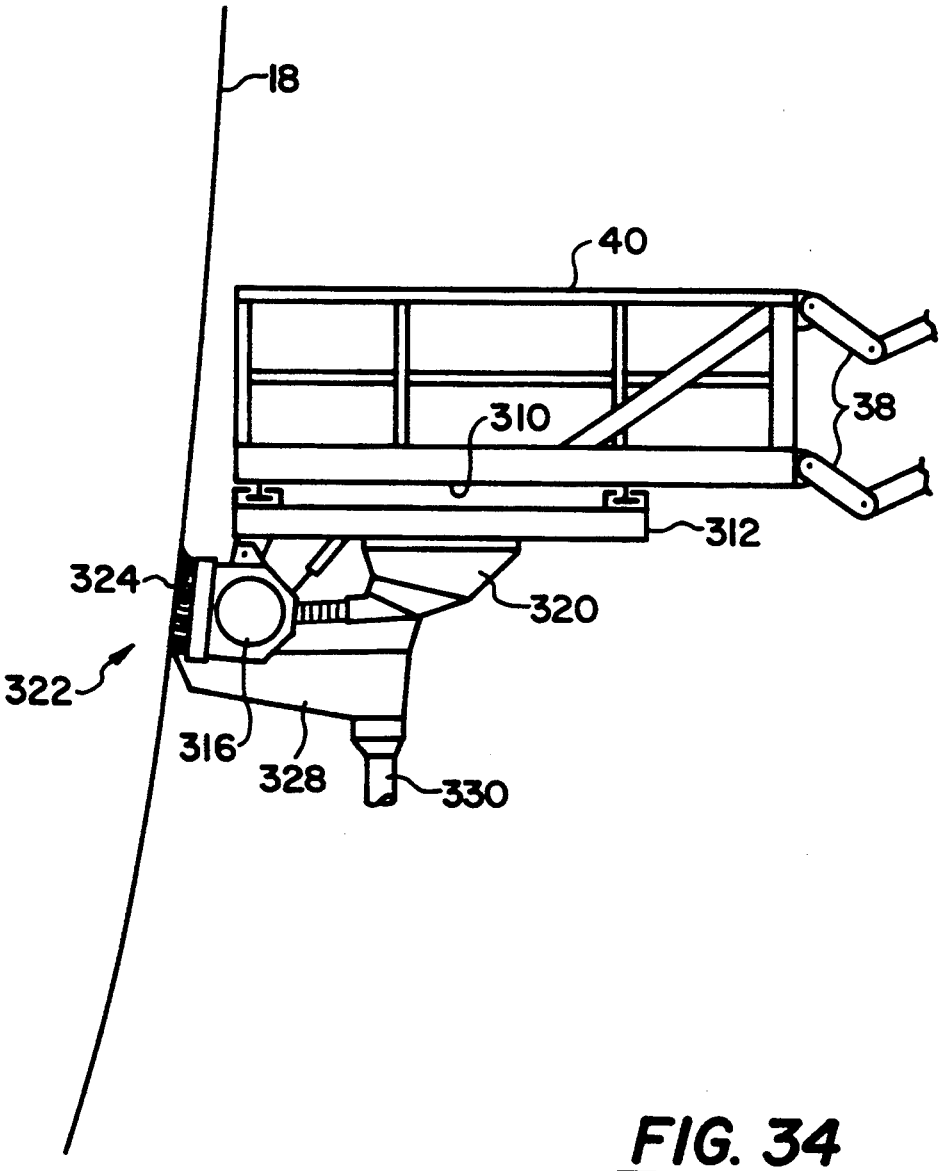
Figure 35:
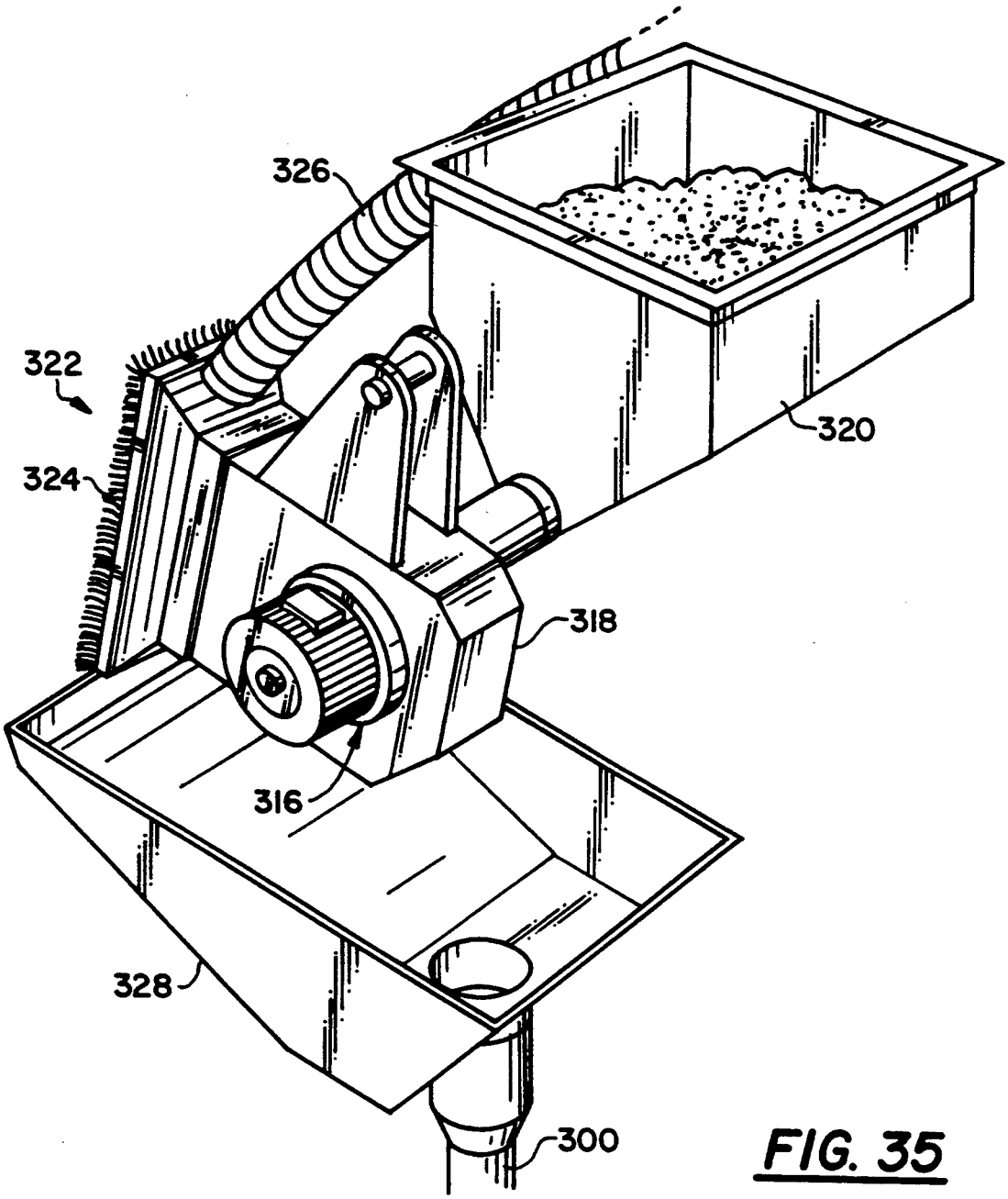
Figure 36:
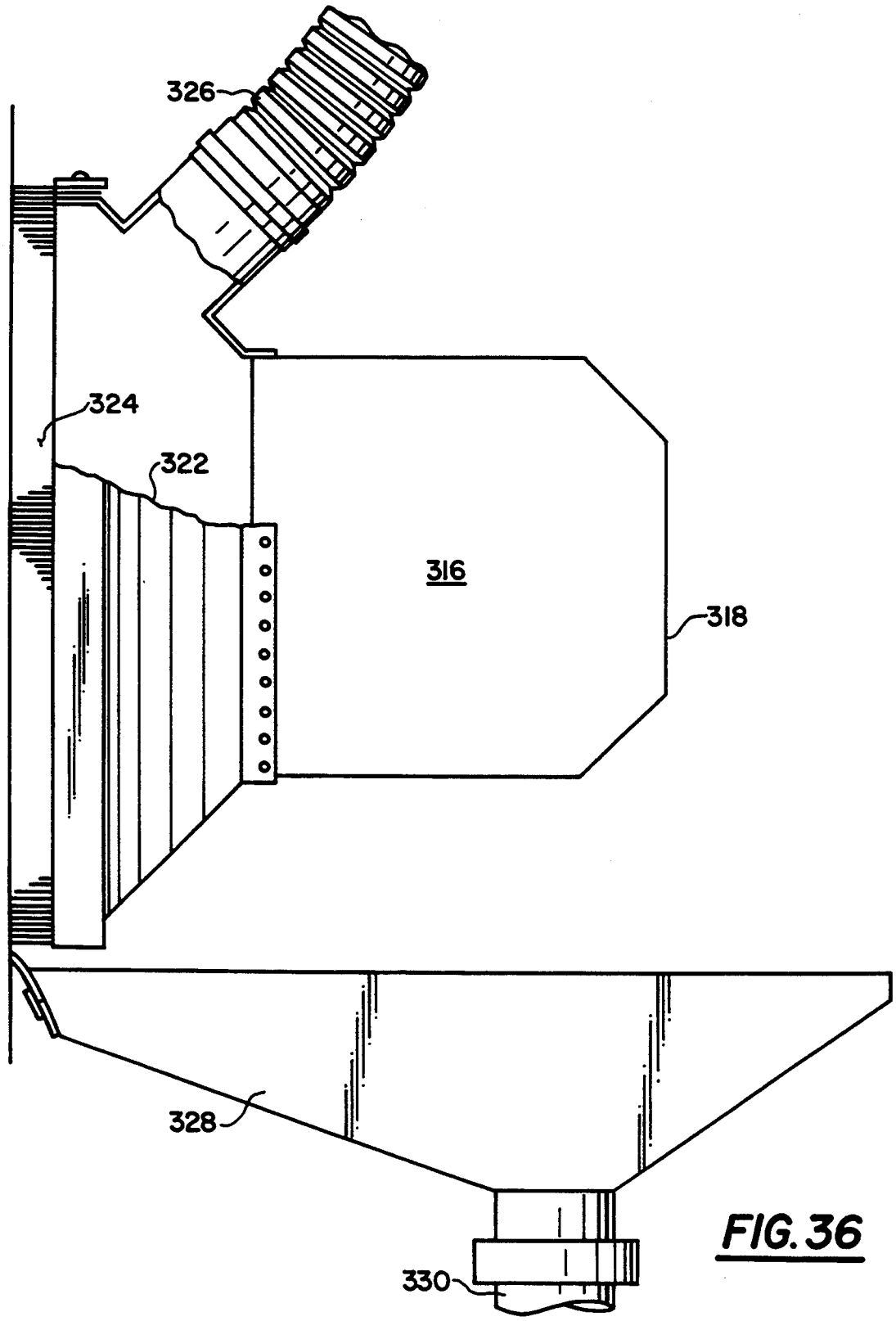
Figure 37:
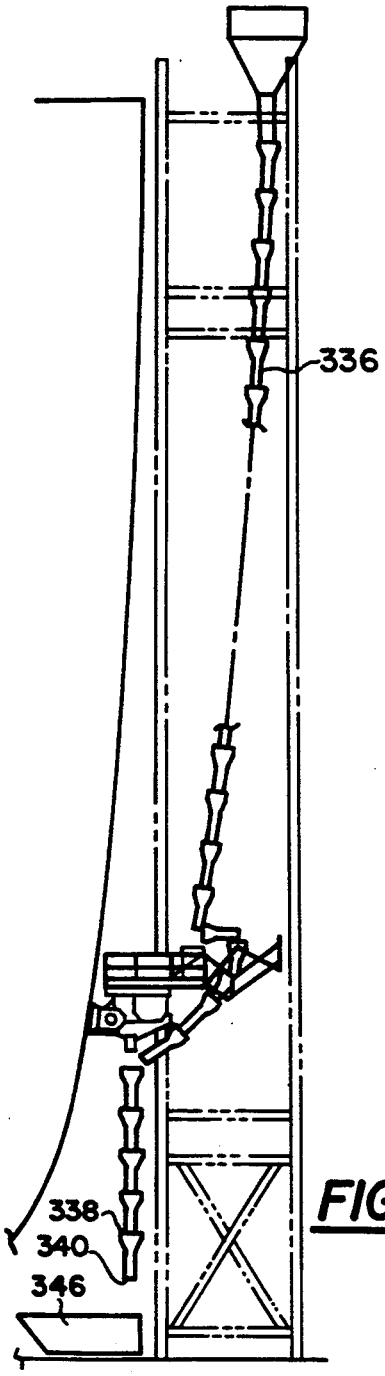
Figure 38:
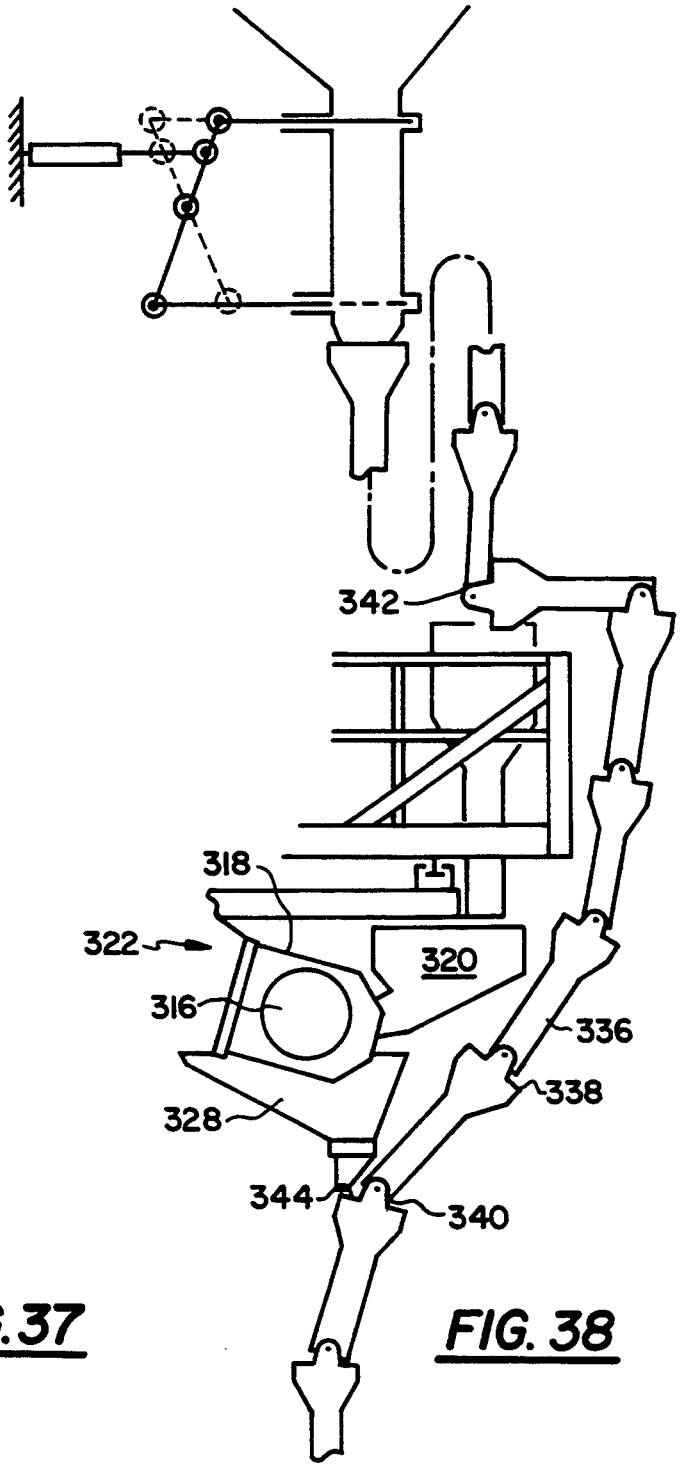
Figure 39:
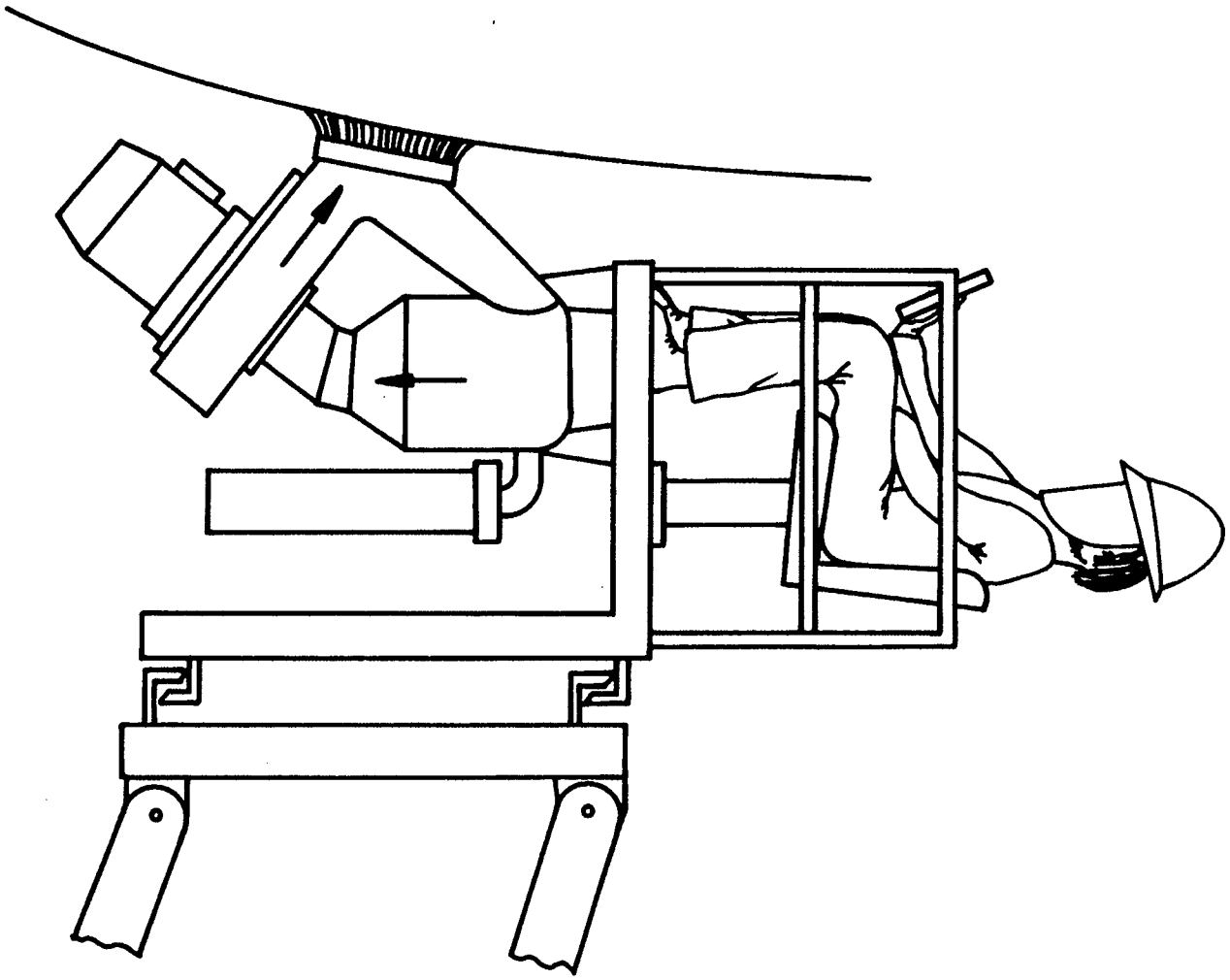
Figure 40:
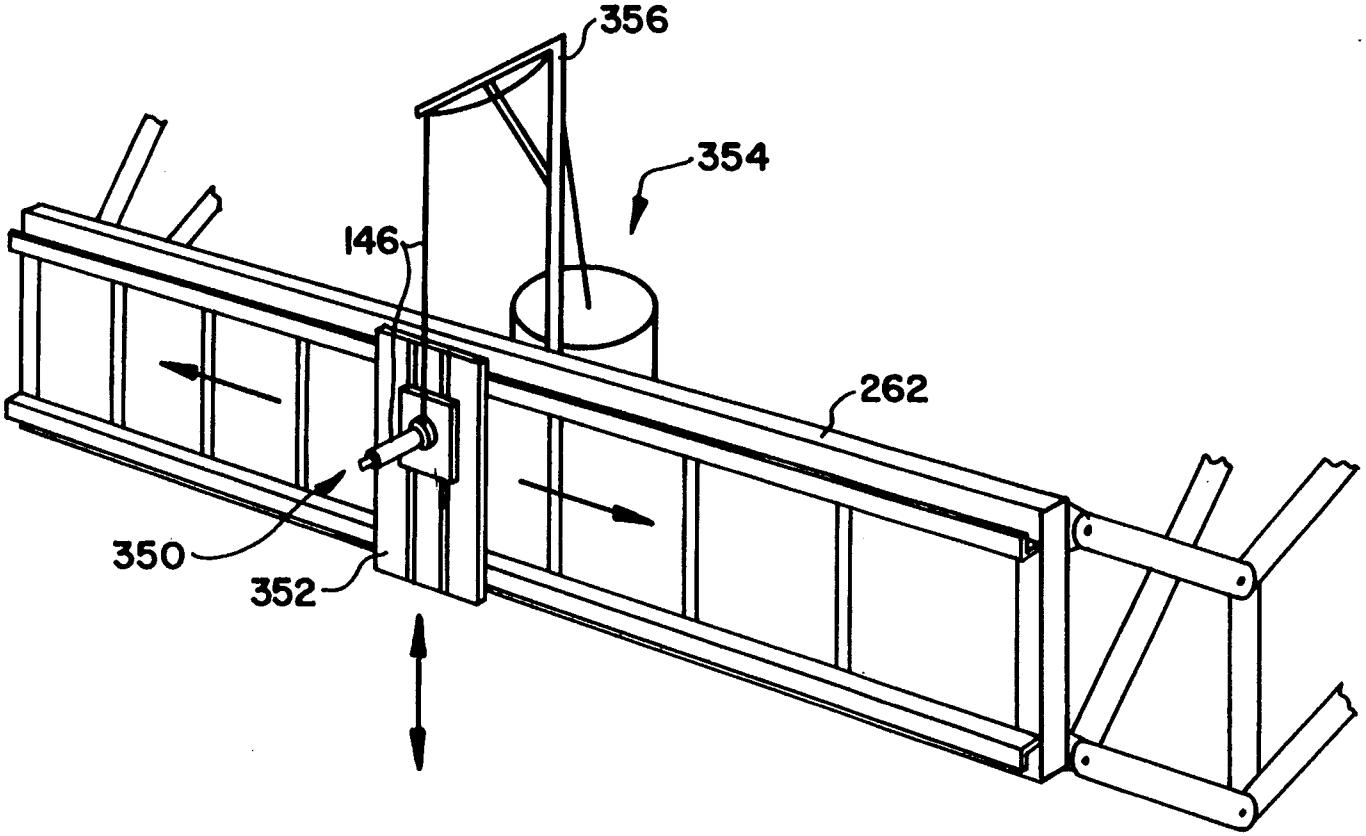
Figure 41:
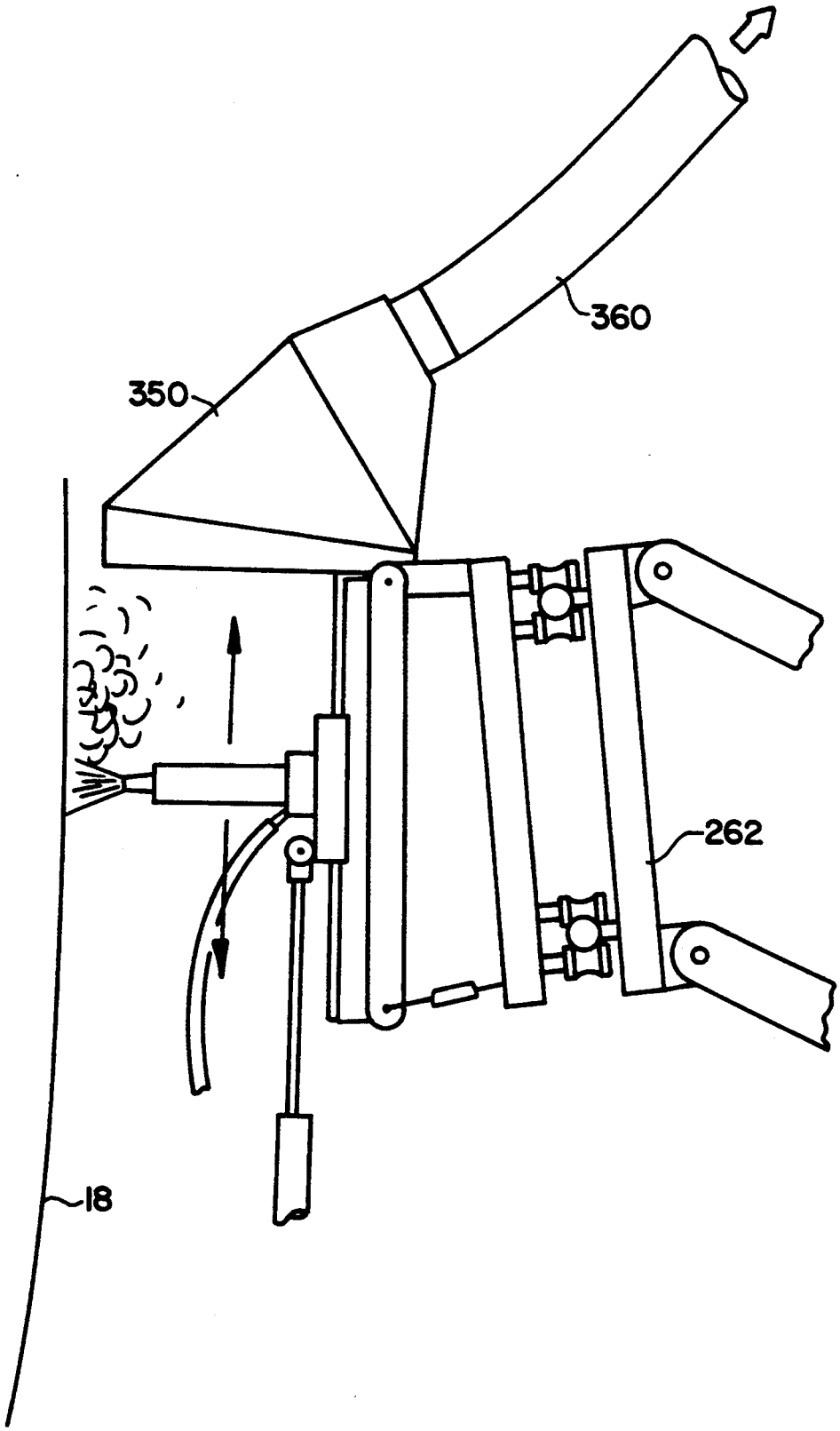

FIG. 33 shows a work platform on which an operator traverses a track structure provided on the outer ends of the adjustable cantilever arms, for traversing multiple blast heads along a respective horizontal band of a respective vertical segment of the external surface of a ship hull, for applying abrasive grit supplied from a hopper on board the work platform;

FIG. 34 shows a similar arrangement having a different type of abrasive applicator, notably including an open-cycle rotary blast wheel;

FIG. 35 is a larger scale perspective view of the open-cycle rotary blast wheel-type abrasive applicator of FIG. 34;

FIG. 36 shows a dust collector useful with the abrasive applicators of FIGS. 34–38;

FIGS. 37 and 38, respectively, show on a smaller scale, and fragmentarily on a larger scale, how to serve the apparatus of FIGS. 34–38 with the abrasive and to recover the spent abrasive, with its burden of chips and scale;

FIG. 39 shows a similar arrangement to that shown in FIG. 4, but having a different type of abrasive applicator, notably including a closed-cycle rotary blast wheel;

FIG. 40 shows a humanly or roboticly operated airless paint spraying apparatus mounted to a simple, traversing work platform; and FIG. 41 shows in fragmentary side elevation the paint spraying apparatus of FIG. 40, equipped with a fume-recovery system.

FIGS. 42–49 show preferred arrangements for sealing between the forward edges of an enclosure shroud and the external surface of a hull, between the shroud portions of two adjoining towers, between the towers and the support platform on which the towers are supported, and (for the floating ship embodiment) between the barge and the bottom margin, near the waterline, of the hull surface segment being worked on.

Figure 42:
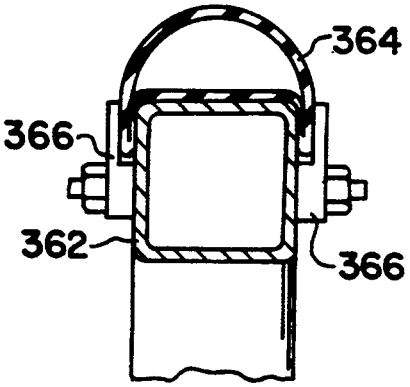
Figure 43:
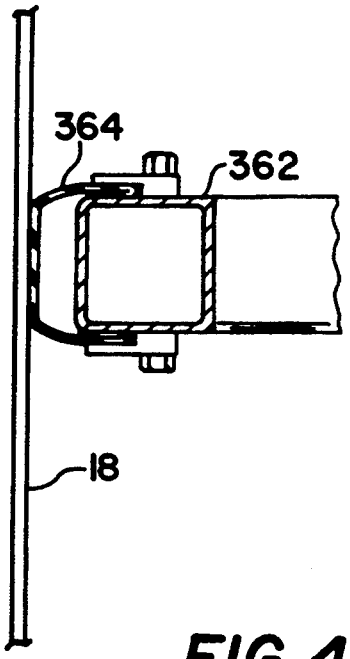
Figure 44:
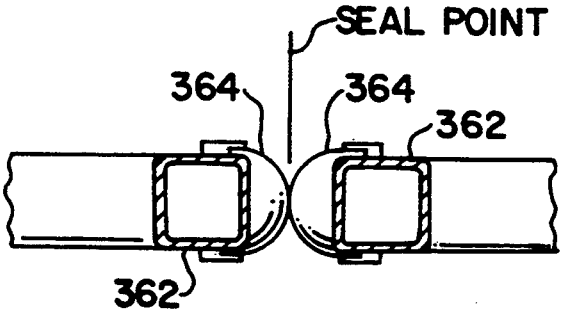
Figure 45:
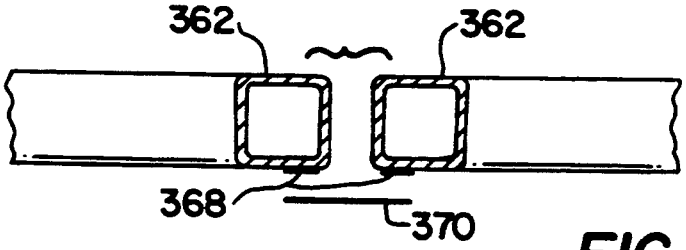
Figure 47:
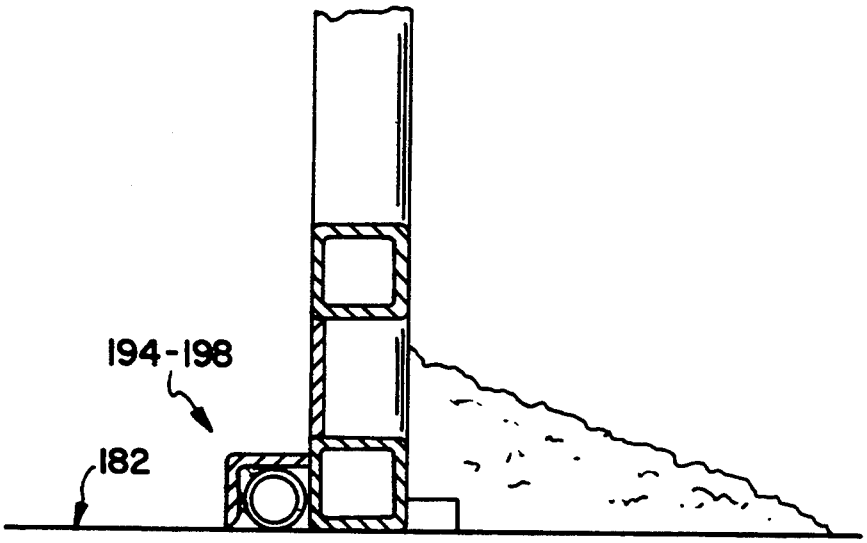
Figure 46:
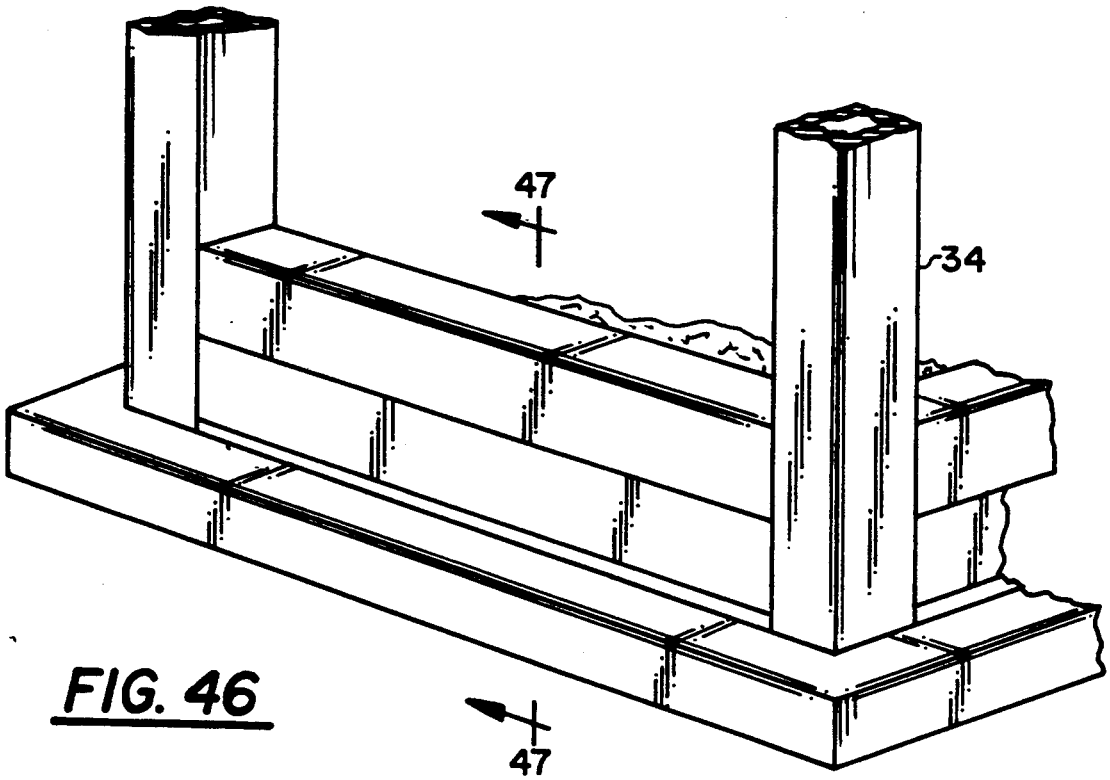

FIG. 42 shows in fragmentary transverse cross-section a preferred form of inflatable seal for sealing between part of the tower and the hull, or between adjoining parts of the tower;

FIG. 43 shows an example of the inflatable seal of FIG. 42 sealing against the hull;

FIG. 44 shows two examples of the inflatable seal of FIG. 42 sealing against one another;

FIG. 45 shows use of a hook-and-loop fastener-type of seal used as an alternative to the sealing arrangement shown in FIG. 44;

FIG. 46 shows in fragmentary perspective sealing between a tower base module and tower supporting platform surface;

FIG. 47 is a fragmentary sectional view taken on line 47—47 of FIG. 46; and

Figure 48:
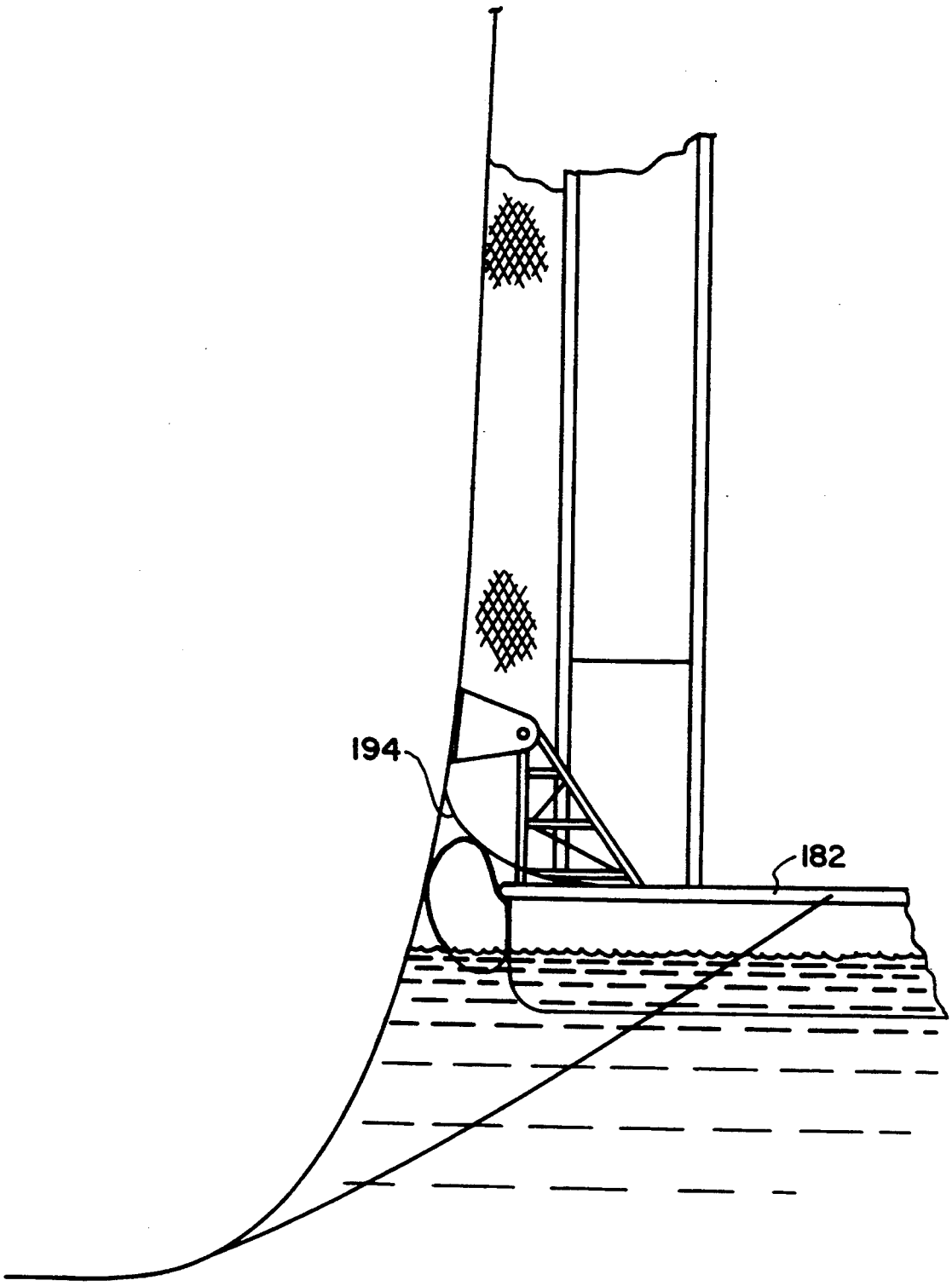
Figure 49:
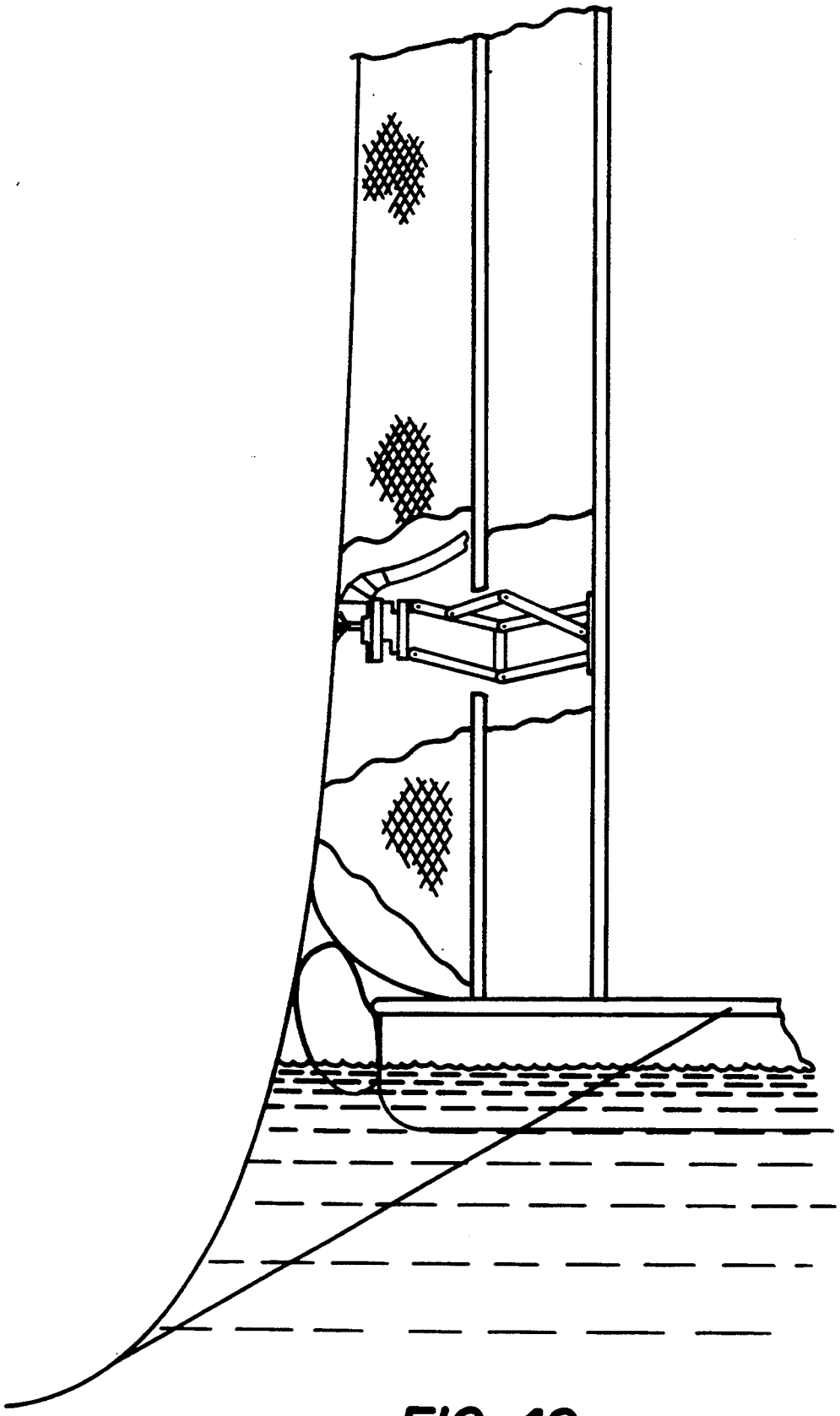

FIGS. 48 and 49 are fragmentary schematic side elevational views of a floating ship being worked on using inflatable seals for preventing contamination of the body of water with spent abrasive, removed chips and scale, and paint overspray.

In several of the drawing figures, some elements such as the curtains of the shroud have been simply omitted, or only partially shown, particularly if they are more fully shown and described in other figures, for simplification of illustration and description.

DETAILED DESCRIPTION

Figure 1:
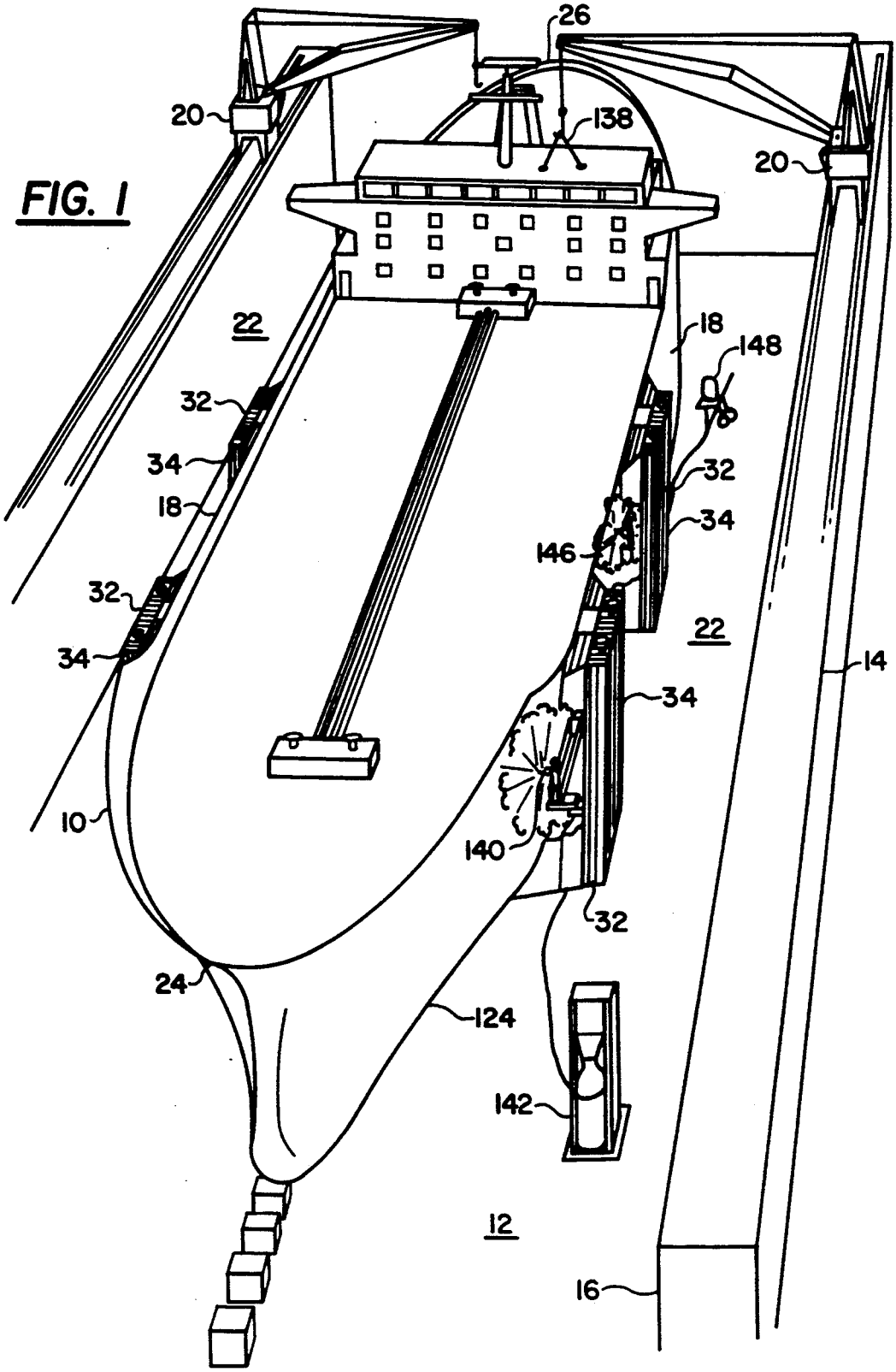
FIG. 1 is a pictorial view, from above, of a ship in drydock, showing four ship staging devices provided in accordance with principles of the invention, being used for conducting enclosed cleaning and painting operations on a respective four increments, on two sides, of the exterior of the ship hull, the shroud on the device in the foreground being shown partly broken away so as to show the operation in progress. The dry-dock crane which can be used for moving the devices to address successive increments of the hull should be noted.
Figure 2:
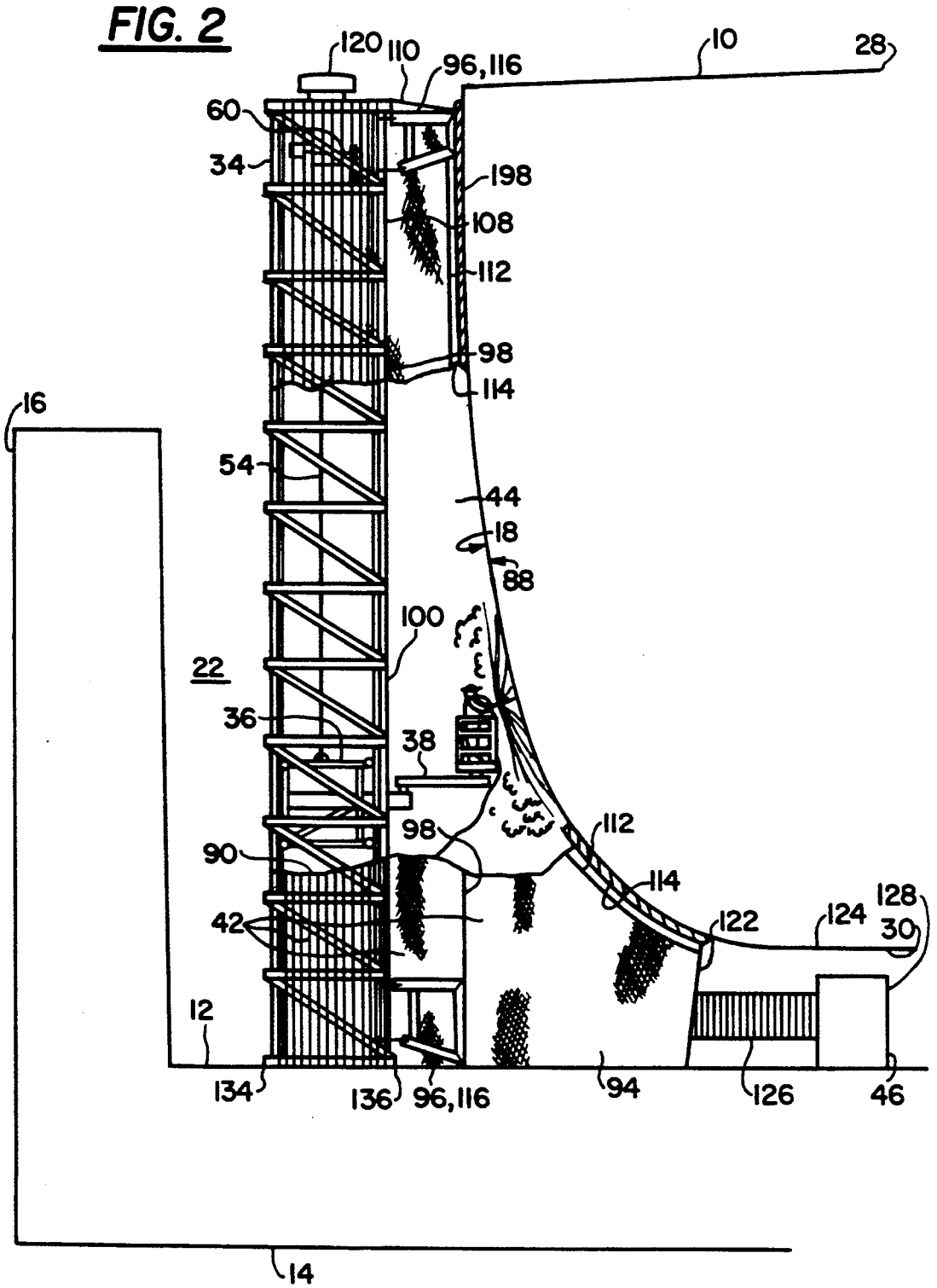
FIG. 2 is a side elevation view of one of the ship staging devices of FIG. 1, on a larger scale.

A typical ship is shown at 10 in FIGS. 1 and 2, supported on the pontoon deck 12 of a dry dock 14 which has upstanding wingwalls 16 that spacedly flank the two opposite sides 18 of the exterior of the hull of the ship. The dry dock 14 typically includes a conventional crane 20, which is typically used for moving parts and supplies to and from the ship, and for shifting the locations of apparatus which are used for performing various fitting and repair functions in relation to the ship. The crane 20 therefore is capable of placing and shifting apparatus at any selected location (e.g., in the alleys 22 between the wingwall and hull) on each side of the ship, between the ship bow 24 and ship stern 26.

A conventional ship hull has its maximum width dimension from the fore and aft centerline of the ship, at its weather deck that is usually located approximately midway along the length of the ship (midships). At any given location along the length of a ship, the distance of the hull from the fore and aft centerline tends to progressively reduce in the downward direction, between the weather deck height 28 and the keel height 30. Forward and aft of midships, the distance of the hull from the longitudinal centerline at any selected vertical height tends to further reduce progressively, until the minimum dimension is reached at keel height at the bow and stern (normally zero). Along given twenty-foot length (longitudinal) increments, most hulls have compound curvature in which the width dimension of the hull from the fore and aft centerline at greater distances below the weather deck reduces more radically at locations further from midships.

The present invention provides one or more enclosed staging devices 32 which can be used for enclosing coating work on the exterior of the ship hull while the ship is in dry dock or afloat. Typically, the ship is a used ship that has come in for maintenance, repairs, and/or refitting. Thus, there may be other work needing to be done, relatively simultaneously, to interior, deck and superstructure parts of the ship, as the apparatus and method of the present invention are being used in connection with work being done on the outside of the ship hull. Typically, the coating work to be done on the outside of the ship hull principally includes abrading-away of debris, corrosion, marine encrustations, scale, old coatings, and applying new coatings, typically by spraying. (In this document, such coatings are generically sometimes referred to as being "painted", without regard to whether a coatings specialist might use that term more restrictively.) The ship may also be a new ship which is on the building ways waiting to be launched or is being drydocked just before delivery after pierside work has been completed. Whether one or a plurality of the devices 32 are used will depend on the size of the ship, how quickly the work must be done, and the size of the workforce. Whether one size or two or more differently size devices 32 are used, may depend on how radically the sides of the hull slope inwardly at various sites along the hull. (That is, in some instances, it may be more advantageous to reach certain areas using a smaller, supplemental device, or a different technique, such as vacuum blasting, then to construct the device 32 so as to be able to cantilever its platform to an extremely extended disposition.)

In very general terms, each enclosed staging device 32 includes a vertical tower 34 which is shiftably supported in an alley 22 on the deck of the drydock, a vertical elevating trolley 36 which can be raised and lowered in the tower and stationed at a selected height, a set of cantilevered arms 38 mounted to the vertical elevating trolley so that their forward ends, on which a work platform 40 is mounted, can extend towards and retract away from the ship hull, a closure assembly 42 which substantially completely encloses a volume of space 44 that is confronted by a vertical segment or increment of the ship hull from weather deck to keel, if the ship is in drydock, or to barge-deck-height above the waterline, if the ship is floating (and which typically is twenty feet horizontally long, longitudinally of the ship), an air movement control system 46 for controlled ventilation of the enclosed space; and power system 48, for operating the trolley, extending and retracting the work platform, and adjusting the forward margin of the shroud to keep it close to the hull along the leading and trailing vertical edges of the particular hull segment being worked on.

Of course, despite the fact that the device 32 has been developed to facilitate the conducting of surface preparation abrading the spray painting operations, additional, or other operations could be conducted within the space 44, using the device 32 as a protective enclosure.

By preference, each tower 34, is a portable framework of struts, ties, braces, connectors and other elements which can be removably secured together so as to provide a unit of the required height to permit access to the whole of the height of a given ship's side, from the height of the weather deck, down to the keel or waterline. Of course, in the instance of a yard which anticipates only working on one size of hull for the whole of the working life of a device 32, each tower could be permanently secured together, e.g., by flame cutting of plates, extrusion of long members, welding of joints, etc. In general, each tower 34 may be made of steel or aluminum, and in substantially the same way and of the same elements and materials, as are conventionally used in the manufacture of elevators used at building construction and retrofitting sites for conveying workers and/or materials to various floors of the building.

A respective cage, car or vertical elevating trolley 36 is mounted to each tower 34 (e.g., by opposed sets of flanged wheels 50 which roll on vertical tracks 52 provided by respective elements of tower 34).

The vertical elevating trolley is suspended in the tower 34 for elevation, by cables 54 which connect to the vertical elevating trolley at 56 and to the drum of a hydraulic winch 60. The connection mechanism 56 each are provided in the form of a spring-loaded ratchet lever 62 which seats in a respective notch 64 in a vertical rail 66 of the tower 34, unless and only for so long as there is lifting tension drawn on the lifting cables 54. Where safety regulations provide otherwise, the vertical elevating trolley may be suspended in the tower using counterweighted cables, other braking or locking systems, redundant cabling, and/or similar conventional means for preventing the trolley from suddenly or unexpectedly dropping due to mechanical or power failure.

It should now be noticed that, whereas various ties and braces preferably are provided around the rear and sides of each tower, each tower front, which, in use, faces the ship side, is substantially open and unobstructed at 68, from the level of the ship's weather deck, down to the keel or waterline (i.e., over the full height of the increment of the ship that will need to be worked on using the device 32).

Both of the rear internal corners of each vertical elevating trolley 36 are provided with respective vertical axles 70 on which are journalled for rotating the rear ends of respective cantilevered horizontal platform support arms 38. By preference, each arm 38 comprised a rear section 72, hinged at its forward end to a forward section 74, hinged at its forward end to a forward section 74 by a vertical axle 76, and each forward section 74, at its forward end is provided with a vertical axle 78. A work platform 40 is mounted to the forward ends of the horizontal platform support arms 38, by the axles 78. Accordingly, the arms 38 are articulated by the joints 70, 76 and 78 between the vertical elevating trolley and the work platform so that they can extend and retract the work platform horizontally (transversely, laterally) relative to the vertical axis of the respective tower, for moving the work platform towards and away from the longitudinal centerline of the hull. In use, each work platform, as a result, can be retracted as the respective elevator is raised or lowered, in order to avoid bumping into the hull, and may be extended further as the respective vertical elevating trolley is lowered, so that the workers or robotic devices riding on the work platform can maintain their close proximity with the exterior of the hull, despite the fact that the width of the hull decreases with height throughout at least a part of the height of the ship.

Of course, the horizontal platform support arms could be operated manually or, more elaborate means could be provided for coordinating extension and retraction of the cylinders.

On each tower, the work platform is retracted by coordinately retracting the piston-cylinder arrangements 80 and 84, and extended by coordinately extending the piston and cylinder arrangements 80 and 84.

The work platform may be configured as necessary (e.g., as to whether it has seats, handholds, rails). At its most basic, it includes a grating support 40 capable of supporting up to two side-by-side human workers or preferably one worker seated in a horizontally moving trolley. A typical work platform is on the order of eighteen feet (5.5 m) wide (lengthwise of the ship), and two feet (0.6 m) deep (widthwise of the ship). Similar support for a robotics device instead of or in addition to one or more human workers is within the contemplation of the invention.

The shroud assembly 42 may be comprised of several components, all of which cooperate to define (together with a respective increment 88 of the exterior of a side 18 of the hull, typically from weather deck to keel and about twenty feet (6.1 m) long, longitudinally of the hull), an enclosed space 44 within which work on the increment of the exterior of the hull can be conducted.

Thus, one necessary component of the shroud assembly 42 is one for confining the rear side of the space. This component may conveniently be provided by securing panels of clear corrugated fiberglass-reinforced plastic siding 90 to the outsides of the rear, fore side, aft side and top of the tower. In use, the fiberglass-reinforced plastic panels 90 may have shorter lives than the tower, and be subject to localized replacement as they wear through or otherwise become too worn.

Figure 3:
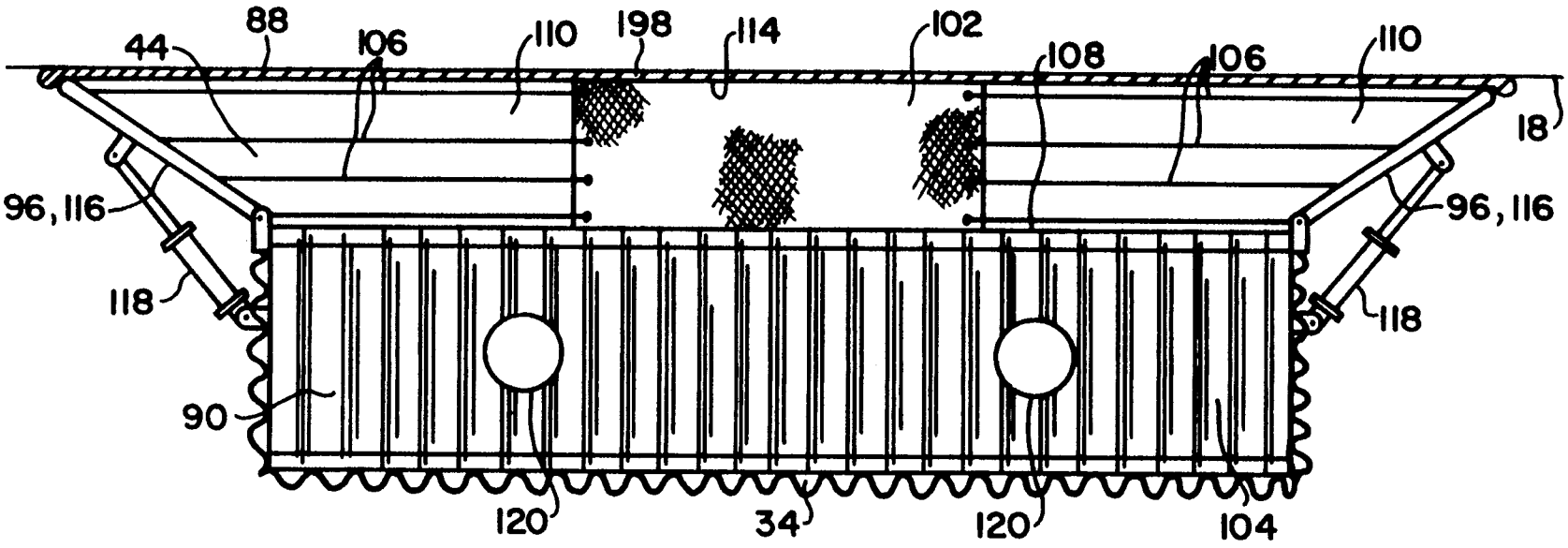
FIG. 3 is a top plan view of the tower and shroud structure thereof.

The other major components of the shroud assembly 42 are side curtain assemblies 92. Each side curtain assembly 92 includes a respective curtain 94, which may be made of canvas, and spreaders 96 provided as vertical axis forward, extensions of the tower at the top and base of the tower; these usually respectively project obliquely towards fore and aft (as best seen in FIG. 3), so that the space 44 broadens from the tower towards the hull. An alternative such as Herculite® flexible sheeting material may be used in place of standard marine quality canvas. Each curtain 94 may be made of one piece, or of several pieces laced, shock corded grommeted, Velcro® fastened or otherwise secured to one another. Similar securement means (lacing, shock cords, Velcro® tabs, etc.) are used at 98 to removably secure the rear edge 108 of each curtain to the respective spreaders 96, and to the front legs 100 of the tower 34, from tower base to tower top, and across in front of the tower top to provide a continuation at 102 of the top wall 104 of the tower 34. In fact, in FIG. 3, the two side curtains are shown somewhat overlapped at the middle of the top 102, with the ends 110 shock corded at 106 to the respective upper spreaders 96.

The front margins 112 of the curtains 94 are preferably provided with a series of electromagnets or permanent magnets 114 sewn or otherwise secured to them (much as is conventionally done to the lower hem of a conventional bath tub shower curtain liner) for permitting the front edges of the curtains 94 to be adjustably held close against the vessel hull at the longitudinal extremes of the hull segment being enclosed by the device 32. The strength and placement of the magnets will need to depend on the weight of the curtain, and the winds locally expected to be encountered which the ship is being worked on. The virtue of electromagnets is that they can be turned off to disconnect them when the device 32 is to be moved.

The curtains 94 may be provided so as to be adjusted entirely manually, or, by preference, manual adjustment may be supplemented by one or more hydraulically actuated batwing skeleton-like structures 116 secured to the respective curtains 94, and mounted at rear edges to the front legs 100 of the tower. The hydraulic-piston-cylinder assemblies 118 of these structures 116 are extended to extend the curtains forwardly, and retracted so as to buckle the structures 116 and, thus, retract or facilitate retraction of the curtains. By preference, the structures 116 are somewhat flexible, and mechanically latch in an extended condition (much as does the metal framework of an umbrella), so that hydraulic pressure is not necessarily relied-upon to maintain the structures 116 in their extended condition.

Figure 8:
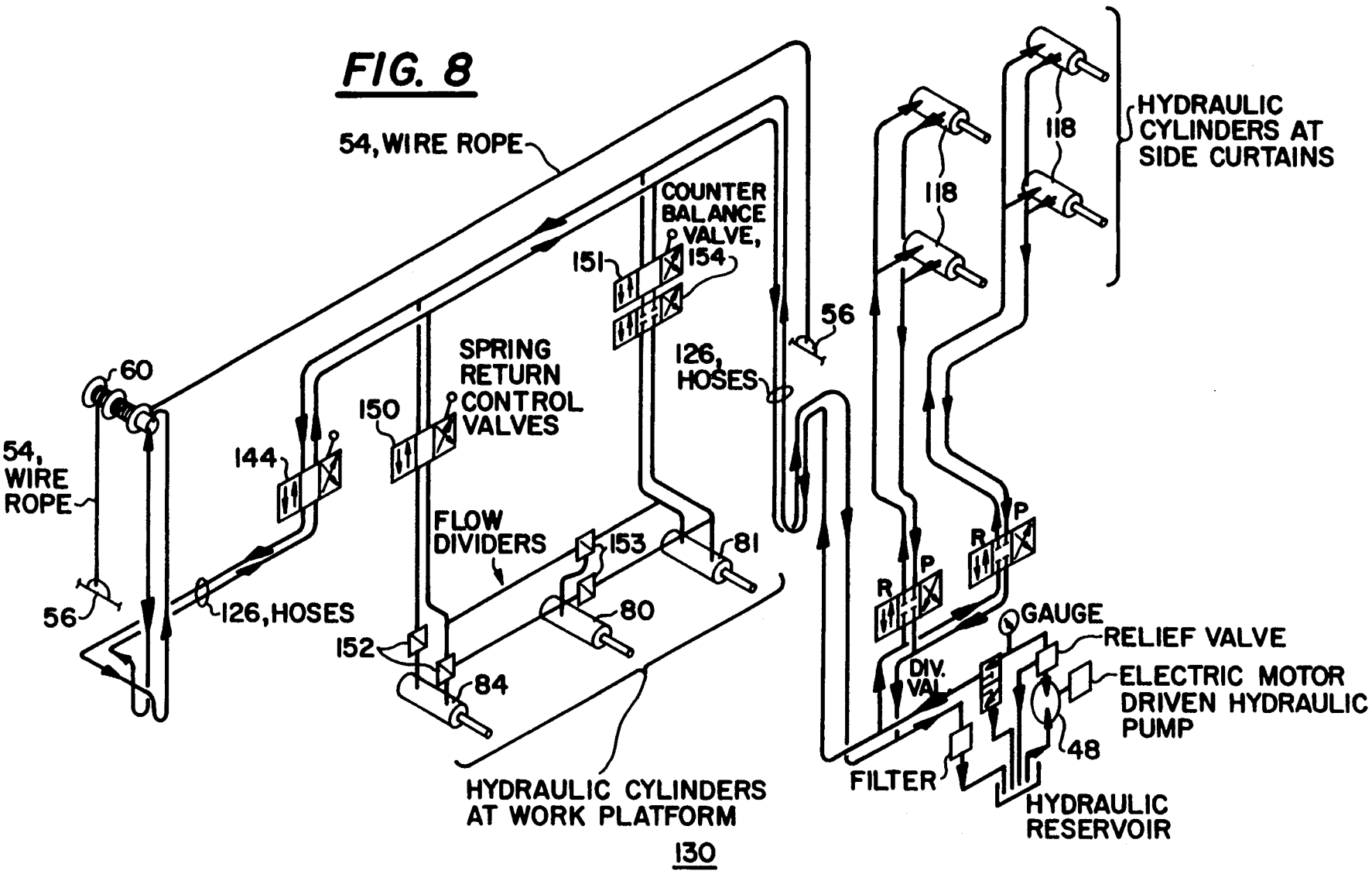
FIG. 8 is a schematic diagram of the hydraulic power system for the device.

A typical electrohydraulic system for operating the hoist, extension and retraction of the work platform, and the curtain-spreading skeletal structure 116 is illustrated at 130 in FIG. 8.

The apparatus and method disclosed in the copending U.S. patent application of Goldbach et al. 07/975,520 provides improvements for controlling the movement of the work platform using control valves and flow dividers, relative to the apparatus and method disclosed in the co-pending U.S. patent application of Garland et al., Application No. 07/782,315.

Manually operating control valve 150 allows fluid to flow through flow divider 152 where eight units of flow are divided, allowing two units to travel to cylinder 84 and six units to flow to flow divider 153. The six units are divided into two equal flows of three units each which travel to cylinders 80 and 81. Since cylinder 84 has a travel of two feet (61 cm), cylinders 80 and 81 have travels of three feet (91 cm) and each cylinder has the same bore, the cylinders will each make their full travel at the same time. This will cause the platform 40 to remain parallel to the carriage 36 at all times. The counterbalance valve 154 blocks control valve 151 so that flow cannot travel back into valve 151. The same arrangement works to return the platform 40 to the parked position.

After the platform 40 is extended the angle of the platform 40 can be changed by releasing control valve 150 and actuating control valve 151 allowing fluid to travel through the counterbalance valve 154 to cylinder 80 and moving one end of the platform 40. The opposite end will always remain fixed and in the same plane.

Benefits of this improved apparatus and method are that it is simpler and safer to operate, its use requires less training and the platform will always remain within the lateral confines of the shroud.

The device 32 further includes an air movement control system 46. At its simplest, this system is shown including a set of dome-lidded air inlet vents 120 provided in the top 104 of the tower (through the shroud assembly 42, into the enclosed space 44), and through a lower lip area 122 (where the two shroud curtains 94 overlap and are overlapped and secured together, e.g., by shock cords, to close the space 44 between the bottom 124 of the ship hull at the base of the side 18) out of the enclosed space 44 by a flexible hose 126 leading into the suction side of a forced air dust collector 128 (which may be visualized as being an industrial-strength vacuum cleaner, of conventional construction. Actually, it may include a bag house, cyclone separator, grit/paint separation facility (for grit reclamation, if feasible), a scrubber and/or a burner for incinerating VOCs.

The bottom four corners of the tower 34 are preferably provided with height adjustable leveling jacks 134, with foot pads 136 which rest on the pontoon deck 12 of the drydock 14, and, as disclosed in the second above-mentioned copending U.S. patent application, the top of the tower 34 is provided with a sling 138, e.g., made of wire rope, which can be hooked by the crane 20 for lifting the device 32 and moving it longitudinally fore or aft to a succeeding increment of hull.

The typical full extent of the path of extension-retraction of the work platform relative to the trolley is ten feet (3 m).

The tower 34 preferably is fabricated in modules of framework, such that for each job, the tower can be shortened or heightened, as necessary, typically in ten foot (3.0 m) segments.

In a typical use of the device 32, it is set up relative to a ship hull increment as shown in FIGS. 1–3. Then, two abrasive-blasting workers enter the enclosed space 44 with their abrasive blasting hoses and nozzles 140, which are connected to externally sited abrasive-blasting supply machines 142. (In the practicing baseline apparatus and methods, these abrasive blasting machines 140, 142 were preferably of the conventional type using compressed air to propel abrasive grit. As further described below, rotary wheel-propelled abrasive blasting rather than compressed air propelled abrasive blasting is now preferred, according to the present invention.

The abrasive blasters raise the trolley 36, and thus, the platform 40 to its uppermost position using the work platform controls 144 and begin the abrasive blasting process. They work downward, blasting a twenty foot (6.1 m) wide vertical swath for the full ship height, lowering and extending the work platform using the work platform controls 144, as necessary, to facilitate access to the hull of the ship. This process takes approximately one shift.

One paint-spray worker then enters the work platform and (using conventional paint-spraying apparatus having a hose and nozzle 146 within the space 44 but a supply machine 148 located outside the space 44) paints the area just blasted by the abrasive-blasting workers operating the work platform in a like manner. This process takes approximately four hours.

Laborers then shovel/sweep up the spent abrasive on the dry-dock floor within the enclosure to the extent it is not otherwise collected. This spent abrasive is placed into suitable containers for disposal and/or recycling as desired.

Figure 12:
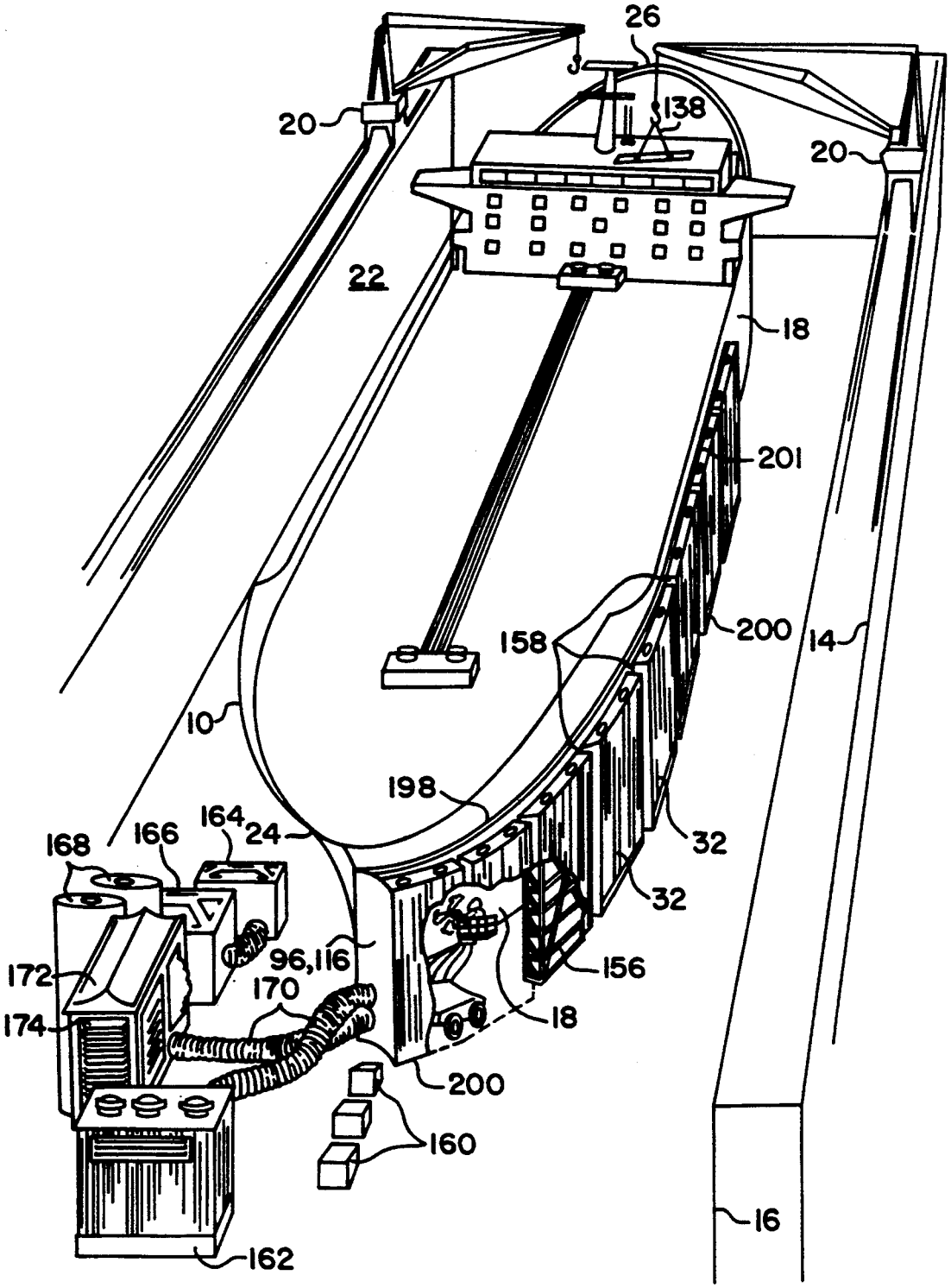
FIG. 12 is a pictorial view of use of composite enclosure assemblies mounted on a drydock floor (rather than on the floating barge of FIGS. 9 and 10) for use in conducting a coating operation from weather deck level down to keel level on a ship's hull, or for completing on the normally submerged portion of a ship's hull, a coating operation that had been begun and completed on the normally exposed portion of the ship's hull using the process and apparatus that is described with reference to FIGS. 9, 10 and 14.

Referring to FIG. 12, the preferred way of using the improved apparatus and method on a ship in drydock, a plurality, e.g., eight to twenty enclosed staging devices 32 laterally adjoining each other longitudinally of and spacedly confronting the portion of the hull which is fully accessible by the extended platform 40, preferably in combination with one to four compatible enclosures 156 without staging devices laterally adjoining each other and spacedly confronting bow and stern areas where there is extreme shape change are placed on the drydock floor 12 around, e.g., one-quarter of the perimeter of a ship 10 and individually attached at the top of the enclosure to the ship 10 using a temporary attachment 201. The top joints between the enclosures 42, 156 and the ship's hull 18 are sealed by an inflatable or other seal 198 as shown in FIG. 2. Inflatable seals 158 at one end of each individual enclosure unit along the top and outside are inflated to seal the joint between the shroud of each enclosure unit 42 or 156 and its adjacent enclosure unit 42 or 156. An adjustable non-porous curtain 94 with magnets 114 to attach to the ship's hull 18 is installed on the aft end of the aftermost enclosure unit 42 and the forward end of the forwardmost enclosure unit 156. When these shrouds are closed and a non-porous covering 122 placed on the side of keel blocks 160, one-quarter of the ship's hull area to be coated is thereby sealed in a large composite enclosure comprised of a plurality of the individual enclosure units 42, 156. Each shroud assembly 42 houses a tower 34 as has been described in relation to FIGS. 1–8. Some or all of the curtains 94 can be omitted at the sides between adjoining enclosed staging devices 32 for selectively isolating or merging respective portions of the space enclosed by the array of enclosure units 42, 156.

Portable storm water dams of gutter bars 200 with magnets 202 or other means of temporary attachment to the deck 12 of the drydock 14 are then placed around the perimeter of the enclosure and sealed by grouting, gasketing or other means 203.

In practicing some embodiments of the baseline apparatus and methods, ventilation units 162, heating units 164, dehumidification units 166, abrasive blasting dust recovery units 168, paint overspray filter units and solvent evaporation VOC incineration units 172 are temporarily placed on the drydock floor, hooked up and connected to the large enclosure sealing off the ship's hull area to be coated by portable ventilation ducting 170. Any of the units 162, 164, 166, 168, 172 can be provided singly or in plurality, as needed. Each enclosed staging device 32 can be separately provided with such units, or two or more enclosed staging devices 32 can be served by any of such units in common. Likewise, ducting and service lines for such units can be provided separately for each enclosed staging device or unit, or in common for two or more enclosed staging devices or units. Ventilation units, heating units and dehumidification units, are operated during all coating phases. Abrasive blasting dust recovery units 168 are operated during abrasive blasting. Consumable or recyclable abrasives may be used based upon current balance of economic factors including abrasive cost, abrasive equipment capital cost and abrasive recycling cost. Paint overspray filter units 174 and solvent evaporation VOC incineration units 172 are operated during paint application and curing periods.

Figure 11:
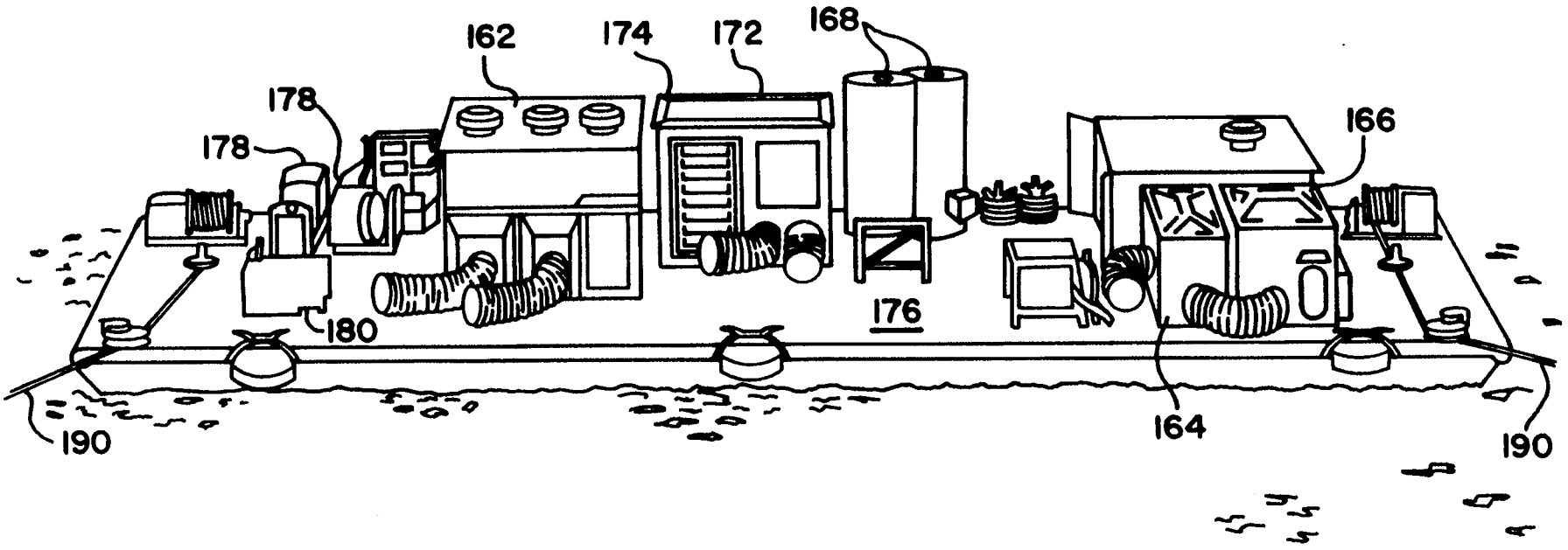
FIG. 11 is a pictorial view showing by itself the support barge of FIGS. 9, 13 and 14.
Figure 13:
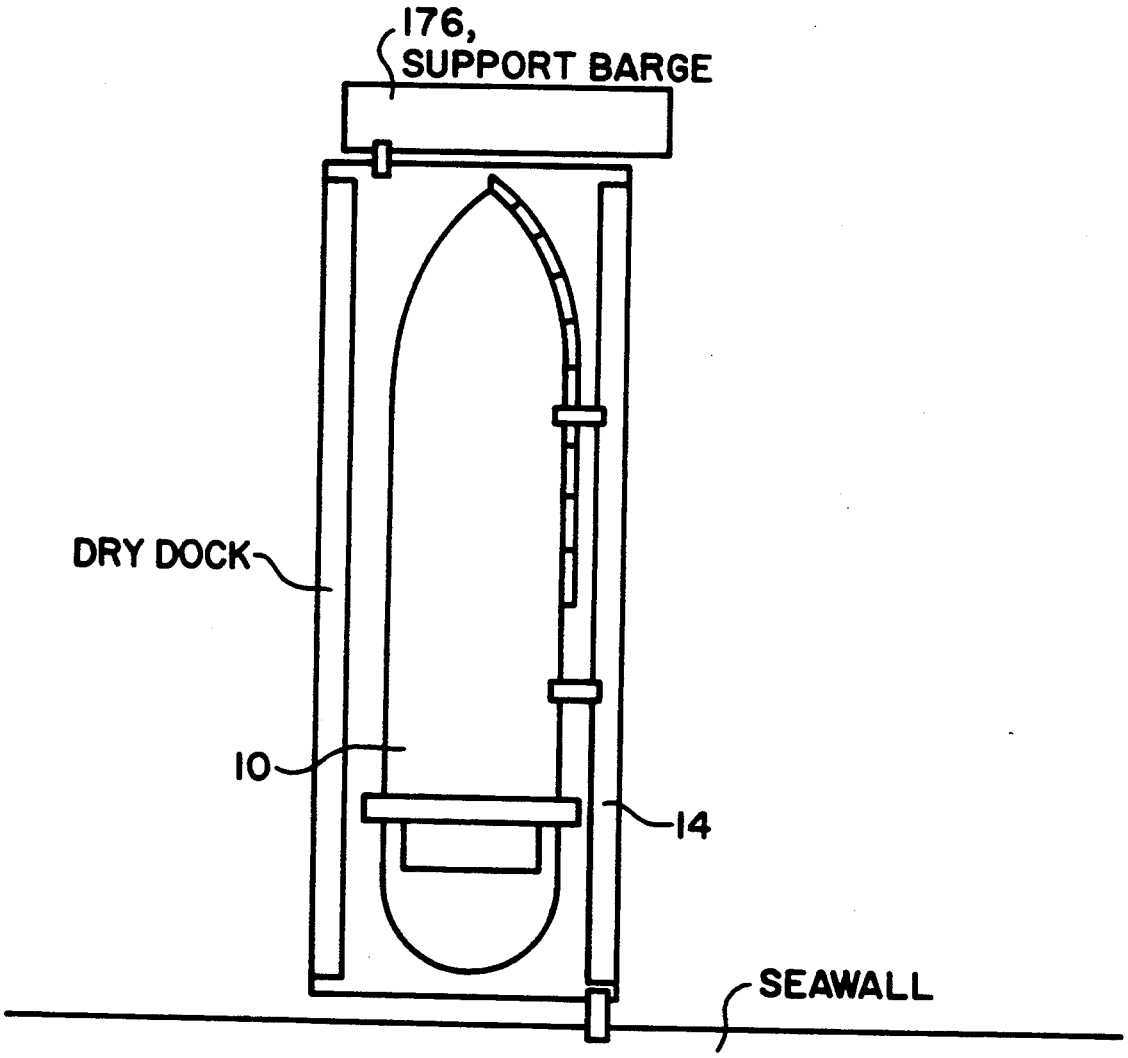
FIG. 13 is a schematic top plan view showing a practice of the coating operation which is described with reference to FIG. 12, also using the support barge which is described with reference to FIG. 11.

Preferably, if permitted by water access to an end of the drydock 14, FIG. 13, ventilation units 162, heating units 164, dehumidification units 166, abrasive dust collection units 168, paint overspray filter units 174 and solvent evaporation VOC incineration units 172 are permanently installed on a support barge 176 FIGS. 11 and 13, together with electrical generating equipment units 178 and fuel oil storage 180. This support barge 176 can be moored to the end of the drydock which corresponds to the end of the ship being coated. Air compressor, abrasive hoppers, abrasive pots, paint mixing machines and paint pots utilized in the coating process can also be located on the support barge, if that practice is judged to be appropriate and economical.

Figure 9:
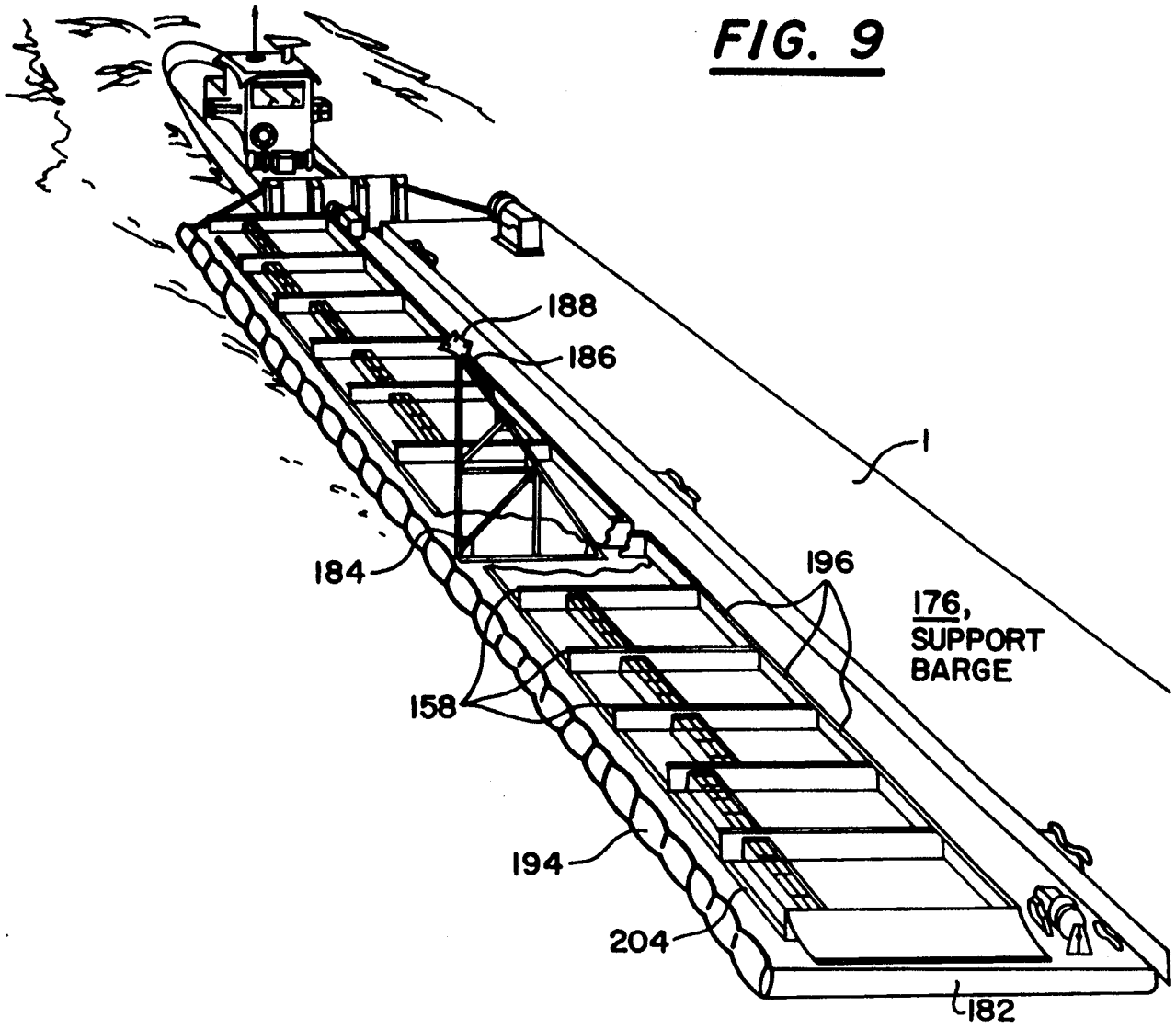
FIG. 9 is a pictorial view of a barge and support barge, with composite enclosure assemblies laid-over to horizontal positions on the barge deck, as the barge and support barge are being towed to position for conducting a coating operation on a floating ship (not shown in this figure)
Figure 10A:
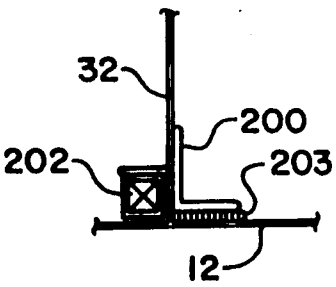
FIG. 10A is a larger scale transverse cross-sectional view of the region shown circled in FIG. 10.
Figure 10:
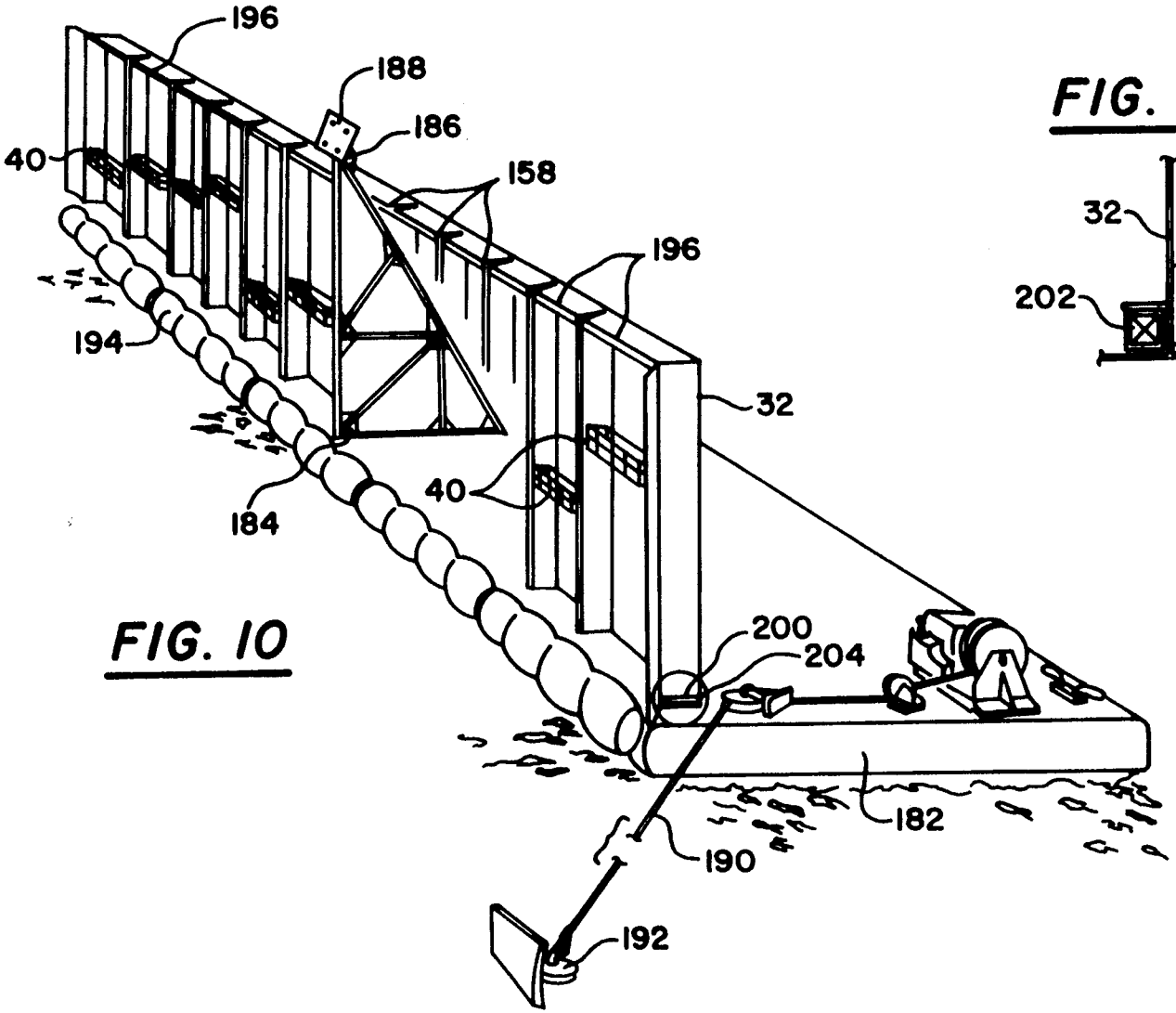
FIG. 10 is a pictorial view showing the barge of FIG. 9, with the enclosure assemblies erect for conducting a coating operation on a floating ship (not shown, but which would be at the left if shown in this figure), the support barge of FIG. 9 having been omitted from this figure.
Figure 14:
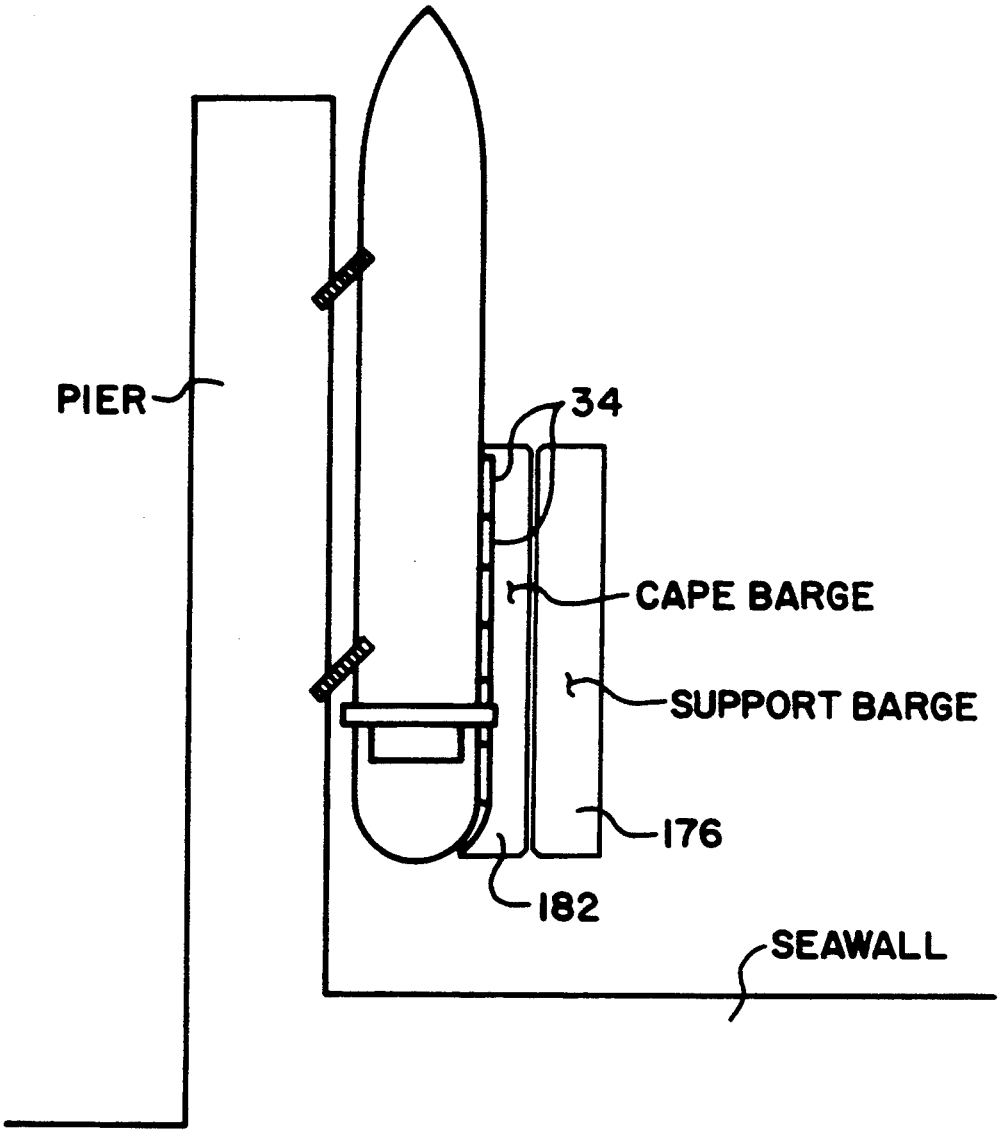
FIG. 14 is a schematic top plan view showing a practice of the coating operation which is described with reference to FIGS. 9 and 10, also using the support barge which described with reference to FIG. 11.

Referring to FIGS. 9, 10 and 14 (which show an alternative to the drydock deck-supported system of FIGS. 1, 2, 12 and 13), in the preferred way of using the improved method of coating hull areas above the waterline on ships afloat in the water, a plurality, e.g., eight to fifteen enclosed staging devices 32 are installed on a barge 182. The barge 182 has a vertical truss 184 comprised of segments which permit its height to be adjusted between twenty and eighty feet high. This truss is located at the longitudinal center line of the barge. At the top of the vertical truss 184 is located a connection 186 to the attachment device 188, the other end of which is attached to the ship's hull 18 at the highest practical point, by temporary welding, magnet, vacuum device or other means, but preferably by a mechanical connection to the ship's structure. At each end of the barge 182, at deck edge, are located winch-tautened attachment lines 190. Two attachment devices 192 are used to attach the ends of the lines 190 to the ship's hull 18, by temporary welding, magnet vacuum device or other means. Attachment devices 186 and 192 have six degrees of freedom, including change in relative draft of barge and ship upward and downward, plus rotation in both the horizontal and vertical directions. This type of attachment enables the large composite enclosure comprised of individual enclosure units 42 to remain sealed to the side of the ship without overstressing the attachment points, while absorbing loads caused by wind, waves, tide and variations in ship and barge drafts caused by changed loading.

The towers 34 of the staging devices (which towers are not shown but actually present in use of the FIG. 10 alternative) are pinned at 204 to the deck of the barge. The towers 34 are otherwise constructed and operated as has been disclosed in relation to FIGS. 1–8.

During transits of the barge 182 to and from the ship 10, the enclosed staging devices are laid horizontal, as shown in FIG. 9, with staging platforms 34 disposed in their lowered positions. After the barge 182 is attached to the ship 10 at the three attachment points 188 and 192, the enclosed staging devices 34 are raised into a vertical position using a floating derrick or winch with block and tackle attached to the ship. Inflatable seals 158 located between individual adjacent enclosed staging devices 34 are inflated. An inflatable seal at barge deck edge 194 between the barge 182 and the ship 10 is inflated. An inflatable seal 196 is installed in the gap between the top of the erect enclosed staging devices 34 and the ship and inflated. Impermeable shrouds 94 installed at the after end of the aftermost enclosed staging device 34 and forward end of the forwardmost enclosed staging device 34 are attached to the ship's hull using magnets 114. Portable storm water dams or gutter bars 200 with magnets 202 or other means of attachment either permanent or temporary to the deck of the coating barge 182 are placed around the perimeter of the enclosure and sealed at 203 by grouting, gasketing or other means. The ship's hull area to be coated is consequently fully enclosed and sealed off.

A support barge 176 is then moored to the enclosure barge 182, FIG. 14. Vent ducting, electrical power cabling, hoses as appropriate for the coating equipment (FIG. 11) are then connected from appropriate points on the support barge 176 to appropriate points in the enclosure and/or to coating equipment as has been described in relation to FIGS. 1–8 and 12. The coating process is then conducted using existing procedures, e.g., as further described in-the above-mentioned U.S. patent application of Garland et al., with abrasive blast support equipment on the support barge energized during abrasive blasting, with paint application and curing support equipment aboard the support barge energized during paint application and curing.

All of the foregoing part of the detailed description has been carried forward from the detail description provided in the aforementioned U.S. patent and copending U.S. patent application, as being germane to preferred practices of the apparatus and method of the present invention. The following part of the detailed description builds upon those details to provide further information about presently preferred embodiments of the present invention.

In FIGS. 15–20, the ship which is to be worked on is again indicated at 10, supported on keel blocks 160 on the pontoon deck 12 of a floating drydock 14. The wingwalls 16 of the drydock are spaced from the sides 18 of the ship, providing alleys 22. In this view, the bow 20 of the ship faces the viewer. A set of enclosed staging devices 32 is shown supported on the pontoon deck 12 in one of the alleys 22. A shroud or closure assembly 42 is provided about the set of staging devices 32 for forming a single composite enclosure 44. Seals have been formed between the forward edges of the curtains of the shroud 42 and the external surface of the hull, between top and sides of neighboring staging devices 32 of the set, and between the set of staging devices and the support platform surface 12 on which the set of staging devices is supported.

A support barge 176 is moored along side one wingwall of the drydock 14, e.g., at midship by conventional mooring lines (not shown).

By preference, according to the present invention, hydraulic power for the apparatus, e.g., for powering the power systems 48, 130 for the trolley and shroud and for extension and retraction of the cantilevered arms, is provided centrally by a hydraulic power unit mounted on a skid 212 which can be lifted by crane to a suitable location, e.g., onto the support barge 176 for providing an enclosure-support facility. By preference, the enclosure support facility also includes fans, pumps and compressors for the air movement control system 46 (for serving ventilation, heat and dehumidification supply and dust, paint overspray and VOC exhaust service lines 214, 216 to and from the composite enclosure 44, hydraulic oil service lines 218 and compressed air service lines 220, as well as associated equipment and materials for servicing and supplying the enclosure.

By preference, the service lines 214, 216, 218 and 220 include certain portions more fixedly connected to one another and to respective supports as ducting, piping runs and headers, notably to the skid at 212, to the wingwall at 214 and to upper modules of at least certain ones of the staging devices 32, and certain intervening portions between portions, between the skid and the wingwall at 216, and between the wingwall and at least certain ones of the staging devices, within the enclosure, at 218, as easily made-up and separated flexible connections, which may be of conventional description.

By preference, the support barge on which the skid 212 is supported is stationed on the outboard side of the floating drydock, at midship, so as to facilitate providing service through the various lines 214–220, while minimizing losses due to line lengths.

Changes in preference, and elaborations in regard to the tower structures 34 of the enclosed staging devices are described below with reference to FIGS. 21–27.

By preference, the individual tower structures 34 which together form the respective sets of tower structures, are made-up from four different kinds of stackably, demountably mountable modules including base modules 222, intermediate modules 224, full machinery upper modules 226 and ventilation-only upper modules 228. (In particular practices of the invention, intermediate modules could be used singly or in plurality in each tower structure, intermediate modules could be combined with upper modules or base modules, and/or ventilation-only upper modules could be eliminated in favor of more full machinery or partially machinery-equipped upper modules.

But for the existence of the intermodular connectors (to be described below), the towers 34 made-up of modules are constructed and function substantially as has been described above in relation to FIGS. 1–14.

The full machinery upper modules 226 mount machinery including hydraulic winches 48, vertical elevating trolleys 36, cantilevered arms 38, respective portions of ventilation supply and exhaust ducting 214, 216, hydraulic oil service lines 218 and compressed air service lines 220, as well as serving as mounting bases for abrasive grit supply equipment and paint supply equipment.

The ventilation-only upper modules 228 lack all of the above-enumerated elements of the full machinery upper modules, except for respective portions of the ventilation supply and exhaust ducting 214, 216.

The base modules 222 include the leveling jacks 134 with footpads 136.

The intermediate modules 224 include respective intermediate portions of the towers 34.

The upper ends of each base, intermediate and upper module are provided at the four corners thereof with respective vertically apertured lifting and mounting plates 230, each of which has a central circular opening 232 having two diametrically opposed perimetrical notches 234.

The lower ends of each intermediate and upper module are provided at the four corners thereof with vertically downwardly projecting, bluntly pointed locating and mounting pins 236. The pins 236 project down through respective support plates 238.

In order to facilitate erecting, changing, tearing down and shifting modular towers 34 using a crane (such as the crane 20 that was described in relation to FIGS. 1–8), the present invention preferably provides a staging device module lifting rig 240, which includes a horizontally arranged rectangular frame 242 having located at its four corners four downwardly projecting, bluntly pointed locating and lifting pins 244.

The pins 244 are each provided at a comparable intermediate level with a pair of diametrically opposed bosses or horizontally projecting pin ends 246 which are sized to fit through the notches 234 when the pins 244 are properly angularly aligned about respective vertical axes relative to the openings 232. The pins 244 are journalled on the corners of the rig 240 for limited, coordinated angular rotation about respective vertical axes. Coordinated rotation is provided by respective crank arms 248 (FIGS. 24–26) coordinated by operating rods 250 connected to a power-operated reversible actuator 252. Control signals for the actuator (which may be electrically, hydraulically or pneumatically powered) can be supplied via a control cable (not shown) or remotely e.g., by infrared or radio signals.

The frame 242 is shown provided at its corners with downwardly flaring corner guides 254 for facilitating alignment of the rig 240 with a module which is to be picked-up. The frame 242 is adapted for being lifted, lowered and moved by a crane, by being equipped with a conventional wirerope sling 256 or the like.

A tower, tower portion or tower module is lifted by lowering the rig 240 into place so that its pins 244 project down through the openings 232 until the bosses 246 pass down through the notches 234. Then, the actuator 252 is operated to rotate the pins 244 so that the bosses 246 are no longer aligned with the notches 234, but instead underlie portions of the respective plates 230. Lifting the rig 240 thereby lifts the module or modules which are effectively connected to the respective plates 230. As a module or set of modules is lowered into place on an underlying module, its lowermost downwardly projecting pins 236 project down through the respective openings 232 of a respective plate 230, and the respective plates 230 come to rest upon the respective plates 238. Then, the actuator 252 is operated to rotate the pins 244 so that the bosses 246 are again aligned with the notches 234 and the rig can be lifted free of the respective tower, module or stack of modules.

For stabilizing towers or stacks of modules, each of the plates 230 and 238 preferably is provided with one or more fastener reception openings 258, through which nut and bolt assemblies or other fasteners 260 can be removably installed.

Referring to FIGS. 27 and 28, a ship can be efficiently cleaned and painted in a preferred practice of the present invention, by using three sets of base modules 222, three sets of intermediate modules 224, one set of full machinery upper modules 226 and one set of ventilation-only upper modules 228. For each tower, a base module and an intermediate module may remain secured together to serve as a respective lower module throughout usage for work on a particular ship or particular size of ship. The number of modules in each set preferably is sufficient to surround one-quarter of the perimeter of the ship.

The basic reason for using two different types of upper modules is to economize on providing the relatively expensive furnishings of the full machinery upper modules, so that such furnishings are present only when needed, and when no longer needed, the respective upper modules are shifted along to the next set of towers.

As is illustrated in FIGS. 27 and 28, in a typical preferred practice of the present invention, in a first phase, a set of enclosed staging devices 32 is erected about a first quadrant of the perimeter of the ship. In this set, each tower is topped by a full machinery upper module. Nothing is yet happening around the second through fourth quadrants.

As abrasive blasting and painting is being carried out on the first quadrant, work begins on setting up the lower modules of a second set of towers around the perimeter of the second quadrant. Nothing is yet happening around the third and fourth quadrants.

As abrasive blasting and painting is completed in the first quadrant, the full machinery upper modules are shifted from the first set to the second set, and work begins on setting up the lower modules of a third set around the third quadrant. Nothing is yet happening around the fourth quadrant.

As illustrated in the fourth row of the flow chart shown in FIG. 27, in the next phase, the towers in the first set are provided with ventilation-only upper modules, abrasive blasting and painting begins on the second quadrant and set-up of lower modules of the third set is completed around the third quadrant.

After paint on the first quadrant has cured and blasting and painting have been completed on the second quadrant, full machinery upper modules are shifted from the second set to the third set, ventilation only upper modules are shifted from the first set to the second set, and lower modules are shifted from around the first quadrant, to around the fourth quadrant.

In a corresponding manner, in ensuing stages, work is performed on the respectively successive quadrants until each has been completed.

Presently preferred embodiments of the cantilever arms 38 are now described with reference to FIGS. 29–32.

A first variation is shown in FIG. 29 and, somewhat modified, in FIG. 30. In FIG. 29, the tower is depicted at 34 and the trolley at 36. In this variation, the arms at their forward ends mount a track base plate 262 on which are located horizontally, laterally extending tracks 264 for mounting other equipment. Each arm includes upper and lower rear parallel links 266, 268 pivoted at respective rear ends to the trolley at 270 and at respective front ends to a vertical tie link 272 at 274, and upper and lower front parallel links 276, 278 pivoted at respective rear ends to the vertical tie link 272 at 274 and to the track base plate 262 at 280. Each arm further includes a power-operated lead screw 282 having a drive nut 284, operably connected in driving relation to the respective arm by a rear drive link 286 having its rear end pivotally connected to the drive nut at 288 and a front end pivotally connected to the rear end of a front drive link 290 at 292. The front end of the front drive link is pivotally connected to an intermediate location on the upper front parallel link 276 at 294, and an intermediate location on the rear drive link 286 is pivotally connected to an intermediate location on the upper rear parallel link 266 at 296. Thus, the parallel links, trolley, track base plate and vertical tie link provide two-tandem, four-bar parallelogram linkages, which are related scissors-linkage fashion to the drive links, so that as the lead screws turn, the drive nuts move vertically, causing the parallelogram linkages to horizontally extend and retract the track base plate. If the power-operated lead screws 282 are wired to be operated only coordinately, all of the pivot joints can provide only pivoting about transverse horizontal axes, but if the lead screws are made to be operated independently to a limited extent, at least some of the pivot joints must also provide for pivoting about longitudinal horizontal axis, or be universal joints, so that the track base plate can be cocked to a limited extent, if viewed in plan, for placing one end thereof further than the other from the trolley, for accommodating work on a correspondingly curved bow-approaching or stern-approaching segment of the ship hull.

FIG. 31 shows an alternate to the power-operated lead screw 282, in the form of a hydraulically powered double-acting piston and cylinder drive unit 298, having a slide bar 300 and slide collar 302 in place of the lead screw and drive nut of FIGS. 29 and 30.

FIG. 32 shows a further variation in which the track base plate 262 is driven from the twin-powered lead screws 282 via respective arms 303 provided in the form of multiple-link scissors linkages having rear ends mounted by respective drive nuts 284 to respective oppositely threaded portions of the respective lead screws, and forward ends pivotally mounted at respective ends to the track base plate by pivotal connections which accommodate movement of these pivots vertically towards and away from one another as the arms are extended and retracted by coordinated rotation of the lead screws in respective directions. (The conventional mounting and operating linkages of footrests of reclining chairs provide models for details of these and possibly other extending and retracting arm and drive designs for the track base plate relative to the trolley.)

Variations of work platforms and abrasive blasting and painting equipment to be mounted on the track base plate 262 are described with reference to FIGS. 33–41.

In FIG. 33, the track base plate 262 is shown mounting for traverse along its tracks 264 a work platform 304 which mounts one or more compressed air-operated abrasive blasting nozzles 140 below an operator's perch 306, from which a human or robotic operator can control traversing movement of the work platform 304 along the tracks 264, elevation of the trolley 36 on the tower 34, and valves for operating the abrasive blasting nozzles 140.

In a variation shown in FIGS. 34 and 35, the work platform 40 (rather than the track base plate) is pivotally mounted directly to the forward ends of the cantilevered arms 38. The track base plate is provided at 310 on the floor of the work platform 40 with rails along which an equipment carriage 312 can be laterally moved using controls (not illustrated, operable by the operator as has been described in relation to element 144 of the embodiment of FIGS. 1–8).

In the embodiment of FIG. 34, and by current preference, the abrasive blasting mechanism is not a compressed air powered nozzle for blowing abrasive grit against the hull surface, since a disadvantage of such a system is that while in operation, it continually inflates the enclosed volume of space within the set of enclosed staging devices 32 with compressed air. In order to prevent the air from causing the shroud to balloon-out and to leak dust, spent abrasive, chips and scale through joints and crevices of enclosure, the ventilation system 162 of the apparatus must be robust and work in coordination with the number of operators that are at any time adding spent compressed air to the enclosure.

Accordingly, a rotating wheel-propelled abrasive blasting mechanism has come to be preferred, and that is what is illustrated in FIGS. 34–38. It is based on wheel-propelled abrasive blasters which have been commercially available in the United States from the company now known as Wheelabrator Technologies, Inc. In such equipment, a wheel (not shown in detail) is mounted at 316 within a housing 318 for rotation at high speed. Indeed, compressed air motors can be used for powering rotation, but with no or little venting of powering compressed air to the enclosed space 44. The housing 318 is served by a hopper 320 for storing and supplying abrasive grit to the wheel, and has an outlet opening 322 out through which grit impelled by the wheel is flung against the hull surface 18. The housing outlet opening 322 is preferably gasketed against the hull surface 18 by a peripheral bristle brush 324, and spent air, dust, some spent grit, paint chips and scale are drawn-off by the ventilation system 162 through the exhaust vent line 326.

The bulk of the spent abrasive, with its burden of contaminants (principally paint chips and scale) is collected under the blaster (much as a ceiling plasterer catches falling plaster) in a recovery hopper 328 mounted to the equipment carriage 312 under the housing 318. The recovery hopper 328 drains into a recovery line 330, the outlet of which may be valved as indicated at 332.

FIGS. 37 and 38 show an open system for serving the abrasive blaster 314 of a respective tower 34 with an abrasive grit. It is similar to systems used for funneling to the ground, construction debris from various floors of a building being built or remodeled. As shown, the full machinery upper module 226 of the tower 34 mounts a main hopper 334 which serves a series of pivotally interconnected, funnel-like chute sections 336, each of which has an inlet 338 and an outlet. When arranged in a straight line or gently curved, each chute section receives from a preceding section and pours into a preceding section and pours into a successive section, but the series can be pivotally more sharply bent, as illustrated, for causing the outlet of one section, at 342 to dump abrasive into the supply hopper 320 for the abrasive-propelling wheel, rather than to have the abrasive continue down the chute, and as illustrated at 344 for receiving spent, contaminated grit from the valved outlet 332 of the recovery hopper 328. The outlet end of the chute is shown dumping into a container 346, from which spent contaminated grit can be collected for reprocessing (separation, recycling and disposal). As described in relation to FIGS. 1–8, grit which does not land in the collection container 346 can be vacuumed and/or swept-up manually from the staging device support surface 12 for reprocessing.

FIG. 39 illustrates a variation, in which the wheel-propelled abrasive blaster is a closed-cycle unit mounted to a traversing work platform of the type shown in FIG. 33. In this unit, spent abrasive is collected and returned to the input side of the wheel for a specified period, and periodically replenished or replaced with fresh abrasive grit.

FIGS. 40 and 41 show the track base plate 262 provided with a paint sprayer 350, which is shown including a traversing and elevating carriage 352 for a nozzle and hose assembly 146 of an airless spray unit 354 provided with a hose-handling mast 356. The paint spraying nozzle is served by a hood 358 through which overspray and fumes are collected and suctioned away through a collection line 360 for particle precipitation and VOC incineration. The collection line 360 is supported from the full machinery upper module of the respective tower.

Some details of the preferred seals for the closure assembly or shroud 42 for each set of enclosed staging devices 32 are illustrated in FIGS. 42–49.

In connections with FIGS. 1–14, the shroud or enclosure 42 and various elements for providing seals for its perimeter and portions are described with relation to elements 90–98, 108–118, 122, 130 and 194–203. Preferred embodiments of those seals are shown and now further described with reference to FIGS. 42–49.

For sealing between framing elements located on edges of the tower modules 222–228 which, in use, will laterally engagingly confront other such framing elements or the ship hull surface 18, each such element (generally designated 362) is provided from end-to-end thereof along the respective face thereof with a low-pressure inflatable seal 364 which, when conventionally inflated (through inflation valves, not shown such as those provided on football bladders or bicycle tire tubes), cause some expansion and turgidification which improves sealing between the respective element and the neighboring element or ship surface.

In FIG. 42, an inflated seal 364 is shown mounted on an element 362 by a typical set of mounting clamps 366. In FIG. 43, an inflated seal 364 is shown sealing with the surface 18 of the ship. In FIG. 44, two such seals are shown providing seals between adjoining modules on the same tower, or between adjoining modules on adjoining towers. The flexibility of the seals 364 also helps to accommodate sealing despite the arcuate arrangement of modules needed near the bow and stern of the ship (which arcuateness is best shown in FIG. 28).

An alternative form of seal appropriate for the context of FIG. 44 but not for the context of FIG. 43, is shown in FIG. 45 in which each frame corner element 362 which is to confront another is provided all along a respective non-confronting (i.e., outer, or inner, top or bottom) face thereof with a strip 368 of one member of a hook and fleece fastener set, such as that which is sold under the brand name Velcro ®. A double-width strip 370 of the complementary member can be pressed into place bridging the crevice, or stripped-off to make, and break a seal between the respective elements.

FIGS. 46 and 47 illustrate in more detail the preferred seals at 200, 203, which are also shown and described in relation to FIG. 10A. The seal may be an inflatable or static seal.

FIGS. 48 and 49 illustrate in more detail the preferred seals at 194-198 for use with the CAPE barge 182-using version of the apparatus and method. Note also the showing of the seal 194 as including an apron-type of sheet neoprene primary seal over an inflatable low-pressure fender-type back-up seal. Stand-off plates help by maintaining a minimum of spacing between the CAPE barge 182 and the ship as the winch-tautened attachment lines maintain the CAPE barge 182 pulled into proximity with the side of the ship.

Although operation of the apparatus has been described above in several segments in order to help the reader to understand the structure and intended operation of the various elements, a reiteration of the operation is provided below, in relation to the floating drydock-using version of the apparatus and method.

As soon as a ship that is to be worked on is high and dry on the drydock, staging device lower modules are positioned around one quadrant of the ship's perimeter and leveled. Seals between modules are inflated.

Portable dams are installed at the base of each module. Curtains of end modules are secured to the hull with magnets.

Meanwhile, the enclosure support barge is moored to the wingwall of the drydock preferably at the drydock longitudinal centerline. This vessel is equipped with an electric air compressor, a fresh air supply unit with dehumidification and heat, a hydraulic power supply unit, a dust collector, a VOC collector/incinerator unit, and permanently installed associated ducting and piping all mounted on one or more skids. Alternately, if the drydock longitudinal centerline is not a convenient location, the barge can be located in another location which permitted convenient and efficient hookup of ducting and piping to the enclosure. If no convenient water location for the barge is available, skid-mounted support equipment can be lifted off the barge and placed in another location such as a pier, drydock wingwall or ship weather deck.

Staging device upper machinery modules are positioned atop lower modules as lower modules are leveled and secured to the ship's hull. Seals between individual upper modules and between upper modules and the ship's hull are inflated.

Portable quick-disconnect hoses and ducts between individual upper module units, between the enclosure and the drydock and between the drydock and the enclosure support barge are installed providing continuous systems for compressed air, hydraulics, ventilation and exhaust from the support barge throughout the enclosure.

An abrasive hopper and paint spray machine is mounted in position on each staging device upper module. The upper module seal is inflated providing a fully weathertight enclosure. Quick-release connections are made between the support system for individual headers on all upper modules, the drydock, and the enclosure support barge for ventilation supply, exhaust, compressed air, and hydraulics.

Meanwhile, a second set of staging device lower modules is being set in place around the next uncoated adjacent quadrant of the ship's hull and leveled, ready to receive the staging device upper machinery modules when coating is complete in the first quadrant. As staging device upper machinery modules are moved from the first to the second quadrant, they are replaced with staging device ventilation-only upper modules for the duration of the final VOC collection period. This process is repeated until all quadrants are completely coated with VOCs finally collected.

Module units of staging devices are moved from location to location by being lifted by a crane utilizing a lifting rig similar to those used by containership port cranes. All module units of staging devices are equipped to accommodate this lifting rig which minimizes time and labor required to attach on to and let go of module units.

When the staging devices of a set are ready to function, for initiating cleaning of the hull, vertical elevating trolleys with cantilevered arms are lowered to their bottom positions.

Preferably, a horizontal track mechanism with mechanized shrouded abrasive blasting wheel(s) without recovery and with operator position is mounted at each end on the mounting pads located at the end of each cantilevered arm. Alternately horizontal truck mechanisms with air blast nozzles(s) or abrasive blasting wheels with recovery are mounted.

Using the preferred method, a measured charge of steel grit abrasive is released from an abrasive hopper on top of the staging device to an articulated chute which then discharges the measured change of abrasive to the storage reservoir on top of the abrasive blasting wheel.

The operator then starts the shrouded abrasive wheel and moves it from one end of the track to the other adjusting the length of the articulated cantilevered arms to keep the wheel shroud in contact with the ship's hull so that the maximum amount of contaminated abrasive is collected in the contaminated abrasive reservoir located below the wheel.

During the abrasive blasting transit, abrasive dust is continuously being sucked through the ducting attached to the wheel shrouding to the exhaust header across the upper modules through the drydock and to the dust collector on the enclosure support barge where dust is removed from the air and from there to the VOC incinerator/collector from which the clean air is evacuated to atmosphere or recycled through the ventilation system as appropriate. Meanwhile, fresh clean heated and dehumidified air is continuously provided from ventilation equipment aboard the enclosure support barge through the drydock and across the upper modules using the ventilation header. Compressed air to operate the abrasive wheel and hydraulic pressure to operate the staging device winch, vertical elevating trolley and articulated cantilevered arms is provided through corresponding piping headers extending from the enclosure support barge through the drydock to the individual staging devices making up the enclosure.

When an abrasive blasting wheel has been operated through a single one-way transit on its track, the respective vertical elevating trolley is raised an amount approximately equal to the height of the swath abraded off by the abrasive wheel and the abrasive wheel mechanism is operated through a full return transit. When the return transit is complete, the valve at the bottom of the contaminated abrasive reservoir is opened which discharges the contaminated abrasive into a lower section of the same chute used for loading abrasive which then discharges the contaminated abrasive into a collection bin located on the floor of the drydock. This bin will continue to fill during remaining abrasive blasting in this location. When coating is complete and all modules of the enclosure are moved, this bin is lifted by crane to a recycling location where contaminates are removed and the abrasive is prepared for reuse.

Another charge of clean abrasive is then received into the clean abrasive reservoir on the abrasive wheel mechanism and the process is completed until all sections of ship's side hull within the enclosure is abraded. Bottom shell and touch-up blasting are accomplished using air blast nozzles with steel grit abrasive or other method as appropriate with the enclosure still in place and before painting commences. Loose steel abrasive on the floor of the drydock within the enclosure from air blast nozzle blasting or escaped from the abrasive blast wheel shroud are cleaned up using shovels, brooms, vacuums, magnets or the like, before painting commences.

When painting is ready to commence, using the preferred method, the vertical elevating trolley with cantilevered arms is lowered to the bottom position. The horizontal track mechanism with mechanized shrouded abrasive wheel(s) without recovery and with operator position is removed from its mountings on the cantilevered arms and preferably replaced with a horizontal track mechanism on which is mounted an operator position and a mechanized laterally moving paint spray device containing one or more oscillating airless paint spray nozzles and a hood with filter connected by duct to the enclosure exhaust system. The oscillating paint spray nozzles are connected to a paint storage and supply system located on top of the staging device through a penetration from the bottom side of the top of the upper module.

Using an alternate manual spray painting approach, a worker platform is mounted on the cantilevered arms in place of the oscillating spray nozzle track and mechanism.

During painting, the enclosure continues to be supplied with heated dehumidified clean air and exhausted, the same as during abrasive blasting.

The operator then starts the oscillating spray nozzle mechanism and operates it back and forth keeping the nozzles an appropriate distance from the hull and raising it between transits until the prime coat of paint is fully applied. Touch-up is performed by the operator using an airless spray gun. After the prime coat of paint is fully cured, subsequent coats of paint are likewise applied.

The enclosure is maintained in place, as earlier described, until the full paint system is sufficiently cured to reduce VOC emissions to an acceptable level.

All components of the enclosure device are preferably designed to be non-sparking. All modes of operation of the horizontal abrasive blasting and painting mechanisms are preferably capable of manual, semi-automatic or fully automatic control, either separately or in combination.

It should now be apparent that the apparatus and method for painting of the external surface work on ship hulls as described herein above possesses each attribute set forth in the specifications heading "Summary of Invention" herein before. Because it can be modified to some extent without departing from the principles thereof as they have been outlined and explained in this specification, the present invention should be understood as encompassing all such modifications as they are within the spirit and scope of the invention.

What is claimed is:

1. Apparatus for performing surface work such as cleaning and painting on an external generally vertical surface of a ship hull, comprising:

a plurality of towers arranged side by side in a set to be supported on a generally horizontal support surface in confronting relation to a longitudinally and vertically extensive portion of a generally vertical external surface of a ship hull, each tower comprising a plurality of modules destackably stacked one upon another and including at least a base module arranged to be directly supported on said support surface, and an upper module arranged to provide an upper end for the respective tower;

shroud means mounted to said towers for cooperating with said ship hull surface for enclosing a confined space within and forwardly of said set of towers;

a ventilation system including ducting for supplying fresh air through said shroud means to said confined space, and ducting for recovering air laden with dust, paint overspray and/or volatile organic chemicals through said shroud means from said confined space, said ventilation system including ventilating machinery and respective portions of both said ducting for supplying and said ducting for recovering, all mounted on said upper modules.

2. Apparatus for performing surface work such as cleaning and painting on an external generally vertical surface of a ship hull, comprising:.

a plurality of towers arranged side by side in a set to be supported on a generally horizontal support surface in confronting relation to a longitudinally and vertically extensive portion of a generally vertical external surface of a ship hull, each tower comprising a ..plurality of modules destackably stacked one upon another and including at least a base module arranged to be directly supported on said support surface, and an upper module arranged to provide an upper end for the respective tower;

shroud means mounted to said towers for cooperating with said ship hull surface for enclosing a confined space within and forwardly of said set of towers;

a ventilation system including ducting for suppplying fresh air through said shroud means to said confined space, and ducting for recovering air laden with dust, paint overspray and/or volatile organic chemicals through said shroud means from said confined space, said ventilation system including ventilating machinery mounted on said upper modules;

said shroud means comprising end curtains for sealing between end towers of said set and said ship hull surface, face panels for closing off respective faces of said tower modules, corner seals for sealing between adjoining edges of adjoining ones of said tower modules both on same ones of said towers and on adjoining ones of said towers, between an upper horizontal edge of each said upper module and said ship hull surface, and with said hull surface at a lower, forward extent of said shroud means.

3. The apparatus of claim 2, wherein:

at least some of said seals are inflatable seals, which, when inflated, tend to form a gasket against respectively opposed seals or said ship hull surface.

4. The apparatus of claim 2, further including:

a floating drydock providing said support surface, said floating drydock having a wingwall;

a respective header portion of said ducting for supplying and a respective header portion of said ducting for recovering being mounted to said upper modules of said towers and having a first set of connectors;

respective intermediate portions of said ducting for supplying and said ducting for recovering being mounted to said wingwall and having at opposite ends thereof second and third sets of connectors;

a skid having mounted thereon ventilation fan means, dust recovery means and volatile organic chemical treatment means, and respective portions of said ducting for supplying and said ducting for recovery effectively connected therewith and mounted to said skid and being provided with a fourth set of connectors;

said ducting for supplying and said ducting for recovering further including first flexible portions disconnectably connected between said first and second sets of connectors, and second flexible portions disconnectably connected between said third and fourth sets of connectors.

5. The apparatus of claim 4, further comprising a barge floating in a same body of water as said floating drydock, adjacent said drydock; said skid being supported on said barge.

6. The apparatus of claim 5, wherein:

said barge is located outboard of said wingwall and at midship in relation to said ship hull.

7. The apparatus of claim 2, wherein:

on each said tower, each module includes at four corners of an upper end thereof respective vertically apertured plates for receiving through openings thereof respective locating pins from above, and each module but for said base module includes at four corners of a lower end thereof respective virtually downwardly directed locating pins projecting through respective support plates and telescopically received through respective said openings in respective vertically apertured plates of respective corners of respective underlying ones of said modules, respective ones of said support plates being supportingly engaged on respective ones of said apertured plates.

8. The apparatus of claim 7, further including:

securement means disconnectably securing together respective engaged ones of said support plates and apertured plates.

9. The apparatus of claim 7, further including:

tower assembly, disassembly and shifting means comprising a crane-attachable sling horizontally suspending a rectangular lifting frame having at four corners thereof downwardly directed locating and lifting pin means; said locating and lifting pin means being movably mounted to said lifting frame for shifting between a locking position in which each is arranged to lock with a respective said apertured plate, and a releasing position in which each is arranged to approach, enter and leave a respective said apertured plate.

10. The apparatus of claim 9, wherein:

each said opening of each said apertured plate is provided with perimetrical notch means, each said locating and lifting pin means is provided with horizontally projecting boss means; and each said locating and lifting pin is arranged to be shifted between said locking and releasing positions thereof by being rotated about a respective vertical axis relative to said lifting frame.

11. Apparatus for performing surface work such as cleaning and painting on an external generally vertical surface of a ship hull, comprising:

a plurality of towers arranged side by side in a set to be supported on a generally horizontal support surface in confronting relation to a longitudinally and vertically extensive portion of a generally vertical external surface of a ship hull, each tower comprising a plurality of modules destackably stacked one upon another and including at least a base module arranged to be directly supported on said support surface, and an upper module arranged to provide an Upper end for the respective tower;

shroud means mounted to said towers for cooperating with said ship hull surface for enclosing a confined space within and forwardly of said set of towers;

a ventilation system including ducting for supplying fresh air through said shroud means to said confined space, and ducting for recovering air laden with dust, paint overspray and/or volatile organic chemicals through said shroud means from said confined space, said ventilation system including ventilating machinery mounted on said upper modules;

at least one of said towers supporting a vertical elevating trolley for vertical movement and stationing at desired heights within said confined space; and further including:

a track base plate extending horizontally longitudinally of said set of towers;

a pair of longitudinally spaced cantilever arms mounted at rear ends of said trolley and at forward ends to said track base plate and arranged to extend and retract said track base plate forwardly away from and rearwardly towards said trolley;

said track base plate mounting horizontally, longitudinally extending track means for mounting work equipment for longitudinally traversingly applying work to said ship hull surface.

12. The apparatus of claim 11, further including:

power-operated lead screw means effectively coupled between said trolley and said cantilever arms for extending and retracting said cantilever arms and thereby said track base plate.

13. The apparatus of claim 11, further including:

double-acting pressurized fluid-operated piston and cylinder means effectively coupled between said trolley and said cantilever arms for extending and retracting said cantilever arms and thereby said track base plate.

14. The apparatus of claim 11, further including:

working equipment means for compressed-air propelled abrasive grit spraying, mounted on said track means for longitudinally traversingly applying abrasive blasting work to said ship hull surface.

15. The apparatus of claim 11, further including:

working equipment means for centrifugally rotating wheel-propelling abrasive grit, mounted on said track means for longitudinally traversingly applying abrasive blasting work to said ship hull surface.

16. The apparatus of claim 15, wherein:

said working equipment means is an open cycle system including a supply hopper feeding a housing-enclosed rotating wheel, said housing having an outlet directed forwards toward said ship hull surface; and a recovery hopper supported under said housing for collecting spent abrasive grit, with chips and scale abrasive-blasted from said ship hull surface.

17. The apparatus of claim 16, further including:

a series of pivotally interconnected funnel-shaped chutes suspended from said upper module of each said one of said towers;

a main hopper supported on said upper module and arranged to spill abrasive grit into an upper end of said series of pivotally interconnected funnel-shaped chutes;

a collection trough arranged to be supported on said support surface under a lower end of said series of pivotally interconnected funnel-shaped chutes for collecting spent abrasive grit;

said series of chutes being pivotally flexed at an upper intermediate level adjacent said supply hopper for diverting abrasive grit spilling in said series of chutes, into said supply hopper; and said series of chutes being pivotally flexed at a lower intermediate level adjacent said recovery hopper for collecting into said chute for spilling therethrough spent abrasive from said recovery hopper.

18. The apparatus of claim 15, wherein:

said working equipment means is a recycling system including a supply hopper feeding a housing-enclosed rotating wheel, said housing having an outlet directed forwards toward said ship hull surface; a recovery hopper supported under said housing for collecting spent abrasive grit, with chips and scale abrasive-blasted from said ship hull surface; and means for recycling said spent grit to said supply hopper.

19. The apparatus of claim 11, wherein:

said working equipment means includes means for blasting abrasive grit against said ship hull surface.

20. The apparatus of claim 19, wherein:

said means for blasting abrasive grit against said ship hull surface includes a housing having a tubular outlet aimed towards said ship hull surface, and through which abrasive grit is blasted against said ship hull surface; a tubular brush peripherally provided on said outlet and arranged to engage said ship hull surface for continuing said abrasive grit being blasted against said ship hull surface; and vacuum line means effectively penetrating said shroud and communicated to said outlet for drawing-off abrasive blasting dust confined by said housing.

21. The apparatus of claim 11, wherein:

said working equipment means is a paint sprayer.

22. A method for performing work on a generally vertical external surface extending perimetrically about the perimeter of a hull of a ship supported on a generally horizontal surface forming a deck of a floating drydock disposed in a body of water, for cleaning and painting said surface of said ship hull in a succession of phases, comprising:

erecting on said deck surface adjacent and extending longitudinally along a first portion of said surface of said ship hull a first set of enclosed staging devices; said first set of staging devices including a plurality of modular towers disposed side-by-side, and a shroud which is open towards said first portion of said surface of said ship hull and effectively encloses a confined space collectively around sides, back and top of said first set of staging devices, and against said deck surface and said surface of said ship hull perimetrically of said first portion of said surface of said ship hull; each said modular tower including a lower module directly supported on said deck surface and a full machinery upper module directly supported on a respective said lower module; each full-machinery upper module supporting for vertical movement and stationing at selected levels, a respective vertical elevating trolley; a working equipment support platform for each said trolley; for each said trolley, horizontally forwardly extensible and rearwardly retractable cantilevering arm means having near ends thereof mounted to the respective said trolley and forward ends thereof mounting the respective said working equipment support platform; air-handling ventilation lines and equipment service lines penetrating said shroud, being supported by each respective said full-machinery upper module and effectively extending to and from each said working equipment support platform;

on each of a plurality of said working equipment support platforms, connecting abrasive blasting heads to said equipment service lines and to said air-handling ventilation lines and, while traversing said abrasive blasting heads relative to said surface of said hull and varying levels of the respective said trolleys, applying abrasive grit from said heads against said surface of said hull and thereby blasting chips of paint and/or scale and dust from said surface of said hull, and carrying at least some of said chips and dust, out of said confined space through said air-handling ventilation lines;

thereafter, on each of a plurality of said working equipment support platforms, connecting paint-applying spray heads to said equipment service lines and to said air-handling ventilation lines and, while traversing said paint-applying spray heads relative to said surface of said hull and varying levels of the respective said trolleys, applying paint from said paint-applying spray heads onto said surface of said hull and thereby painting said surface of said surface of said hull and carrying at least some paint overspray and volatile organic chemicals from said paint, out of said confined space through said air-handling ventilation lines;

erecting on said deck surface adjacent and extending longitudinally along a second portion of said surface of said ship hull lower modules for a second set of enclosed staging devices;

lifting said full-machinery upper modules from respective ones of said lower modules of said first set of enclosed staging devices and transferring and lowering those full-machinery upper modules onto respective ones of said lower modules of said second set, and thereby providing a second set of enclosed staging devices likewise including a second plurality of modular towers and having a second confined space collectively around sides, back and top of said second set of staging devices; said trolleys being thereby supported for vertical movement and stationing at selected levels in said second confined space;

lifting ventilation-only upper modules and lowering them onto respective ones of said lower modules of said first set, each said ventilation-only upper module including respective portions for a shroud for being open towards said first portion of said ship hull surface and for confining respective portions of and reconstituting said confined space around sides, back and top of said first set of staging devices, as modified by replacement of said full-machinery upper modules by said ventilation-only upper modules; air-handling ventilation lines penetrating said shroud portions and being supported by respective ones of said ventilation-only upper modules;

during a period of time while volatile organic chemicals are continuing to evaporate from paint applied to said surface of said hull, carrying at least some of said organic chemicals out of said reconstituted confined space; and thereafter, dismantling said ventilation-only upper modules from said lower modules of said first set, for reuse in successive phases of work on said surface of said hull.

* * * * *